US008033546B2

(12) United States Patent
Takahashi et al.

(10) Patent No.: US 8,033,546 B2
(45) Date of Patent: Oct. 11, 2011

(54) BELT DRIVE CONTROLLER AND IMAGE FORMING APPARATUS PROVIDED WITH SAME

(75) Inventors: Minoru Takahashi, Yokohama (JP); Hiromichi Matsuda, Isehara (JP); Satoshi Imai, Sagamihara (JP); Hiroshi Koide, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 1159 days.

(21) Appl. No.: 11/558,645

(22) Filed: Nov. 10, 2006

(65) Prior Publication Data

US 2007/0126837 A1 Jun. 7, 2007

(30) Foreign Application Priority Data

Nov. 15, 2005 (JP) ..... 2005-329928

(51) Int. Cl.
*B65H 5/34* (2006.01)

(52) U.S. Cl. ..... 271/270; 271/275; 271/198; 271/202

(58) Field of Classification Search ..... 271/270, 271/275, 198, 202
See application file for complete search history.

(56) References Cited

U.S. PATENT DOCUMENTS

| | | | |
|---|---|---|---|
| 4,354,146 | A | 10/1982 | Tenmyo et al. |
| 4,391,506 | A | 7/1983 | Koide |
| 6,507,713 | B2 | 1/2003 | Koide |
| 6,760,559 | B2 | 7/2004 | Koide |
| 6,771,919 | B2 | 8/2004 | Koide |
| 6,868,244 | B2 | 3/2005 | Koide |
| 6,889,030 | B2 | 5/2005 | Koide et al. |
| 6,914,619 | B2 | 7/2005 | Koide |
| 6,931,227 | B2 | 8/2005 | Koide |
| 6,941,096 | B2 | 9/2005 | Matsuda et al. |
| 6,949,896 | B2 | 9/2005 | Andoh et al. |
| 6,996,357 | B2 | 2/2006 | Matsuda et al. |
| 7,016,635 | B2 | 3/2006 | Koide |
| 7,110,700 | B2 | 9/2006 | Andoh et al. |
| 2004/0127317 | A1 | 7/2004 | Takuroh et al. |
| 2005/0053388 | A1 | 3/2005 | Yokoyama et al. |
| 2005/0220491 | A1 | 10/2005 | Koide |
| 2006/0088338 | A1 | 4/2006 | Matsuda et al. |
| 2006/0110189 | A1 | 5/2006 | Matsuda et al. |
| 2006/0133873 | A1 | 6/2006 | Andoh et al. |
| 2006/0165442 | A1 | 7/2006 | Kobayashi et al. |
| 2006/0182471 | A1 | 8/2006 | Okamura et al. |
| 2006/0184258 | A1 | 8/2006 | Matsuda et al. |

FOREIGN PATENT DOCUMENTS

| | | |
|---|---|---|
| JP | 8-282009 | 10/1996 |
| JP | 2000-330353 | 11/2000 |
| JP | 2003-103857 | 4/2003 |
| JP | 3564953 | 6/2004 |
| JP | 2005-75529 | 3/2005 |
| JP | 3658262 | 3/2005 |
| JP | 2005-115398 | 4/2005 |
| JP | 2005-312262 | 11/2005 |

*Primary Examiner* — David H Bollinger
(74) *Attorney, Agent, or Firm* — Oblon, Spivak, McClelland, Maier & Neustadt, L.L.P.

(57) ABSTRACT

A belt drive controller for controlling each belt stopping position with high accuracy during intermittent movement of a belt. This belt drive controller controls driving of a belt to intermittently move a belt wrapped around a plurality of supporting rollers including a driven roller and a drive roller. This controller detects a rotation angular displacement or a rotation angular velocity of two supporting rollers having mutually different diameters, and controls driving of the drive roller based on the detected rotation data so that the position of the belt in the direction of movement becomes a predetermined target position.

53 Claims, 17 Drawing Sheets

| | 0°C | 5°C | 10°C | 15°C | 20°C |
|---|---|---|---|---|---|
| SECOND ROLLER DIAMETER | 31.2000 | 31.2145 | 31.2290 | 31.2435 | 31.2580 |
| FIRST ROLLER DIAMETER | 15.6000 | 15.6015 | 15.6030 | 15.6045 | 15.6060 |
| DIAMETER RATIO | 2.0000 | 2.0007 | 2.0015 | 2.0022 | 2.0029 |

BELT DRIVE CONTROLLER AND IMAGE FORMING APPARATUS PROVIDED WITH SAME

BACKGROUND OF THE INVENTION

1. Field of the Invention

The present invention relates to a belt drive controller for controlling the driving of a belt so as to intermittently move an endless belt wrapped around a plurality of supporting rotating bodies, and an image forming apparatus of an ink jet recording type and so forth provided therewith.

2. Description of the Background Art

A known example of this type of image forming apparatus is an ink jet recording type of image forming apparatus which forms an image on a recording material by intermittently moving a recording material transport member to repeatedly advance the recording material in steps when forming an image on a recording material supported and transported on a recording material transport member comprising an endless belt.

In this type of image forming apparatus, a conveyor belt (recording material transport member) may be used as a recording material transport mechanism. In this type of recording material transport mechanism, a code wheel (encoder disk) is installed on supporting rollers (supporting rotating bodies) on which the conveyor belt is wrapped around, and a code on the code wheel is read with an encoder. The conveyor belt is moved intermittently based on the output of the encoder, and driving is controlled so that the recording material stops at each target stopping position. As a result of carrying out this type of driving control, since the accuracy of each stopping position during intermittent transport of the recording material can be improved, the accuracy of the impact position of the ink droplets on the recording material can be improved, there by making it possible to enhance image quality. An image forming apparatus employing this type of driving control method is described in, for example, Japanese Patent Application Laid-open No. 2001-248822. The image forming apparatus described in this publication transports a recording material in a secondary scanning direction by arranging a transport roller and a discharge roller on the upstream side and down stream side of a platen. A code wheel is installed on the transport roller shaft, a code on the code wheel is read with an encoder, and the transport roller and conveyor belt are moved intermittently based on the encoder output.

In addition, Japanese Patent Application Laid-open No. 2005-115398 describes a method for controlling driving of an endless belt provided in a so-called electrophotographic type of image forming apparatus. This driving control method controls driving by detecting the rotation angular displacement or rotation angular velocity of a driven supporting rotating body among a plurality of supporting rotating bodies around which a belt is wrapped, and suppresses fluctuations in the movement velocity of the belt caused by periodical fluctuations in thickness in the circumferential direction of the belt based on the detection result so that the belt moves at a constant movement velocity.

Ink jet recording types of image recording apparatuses have recently come to use pigment-based ink instead of dye-based ink so as to improve ink light resistance and deterioration over time, resulting in a trend in which ink viscosity is increasing. Although bleeding on to the recording material has decreased considerably as a result of increasing the viscosity of the ink, poor accuracy resulting from shifts in the impact position of the ink droplets on the recording material is readily apparent visually in the form white lines, black lines and banding. This deterioration in image quality has a particularly large effect on the accuracy of each belt stopping position during intermittent movement by the conveyor belt which supports and transports the recording material in the direction of secondary scanning (direction of transport of the recording material) in particular. Consequently, controlling each belt stopping position during intermittent movement of the conveyor belt to attain even higher accuracy has become an important technical issue. However, conventional methods for controlling driving as described in the above-mentioned Japanese Patent Application Laid-open No. 2001-248822 had the problem of being unable to control each belt stopping position during intermittent movement of the conveyor belt with sufficiently high accuracy so as to be able to adequately suppress deterioration of image quality in the form of white lines, black lines and banding.

A first cause of being unable to control each belt stopping position with sufficiently high accuracy during intermittent movement of the conveyor belt is fluctuation during belt driving in the distance from the roller surface to the belt pitch line, namely the pitch line distance (PLD), at the portion of the belt wound around the drive roller (driving supporting rotating body). More specifically, the movement velocity of a belt is typically determined by the PLD. This PLD is equivalent to the distance between the center of the belt in the direction of thickness and the belt inner surface, namely the roller surface, in the case of a single-layer belt made of a uniform material and the absolute value of belt flexibility of the inside and outside of the belt being nearly equal. Thus, since the relationship between PLD and belt thickness is nearly constant in the case of such a single-layer belt, the movement velocity of the belt can be determined according to the amount of unevenness in belt thickness. However, as a result of different mutual flexibility between hard layers and soft layers in a belt composed of a plurality of layers, the distance from a position shifted from the center of the belt in the direction of thickness and the roller surface becomes the PLD.

If PLD fluctuates in the portion of the belt wound around the drive roller during belt driving, the belt movement velocity increases when a portion of the belt having a large PLD is wound around the drive roller, while conversely the belt movement velocity decreases when a portion of the belt having a small PLD is wound around the drive roller. As a result, the belt movement distance becomes longer when a portion of the belt having a large PLD is wound around the drive roller, while conversely the belt movement distance becomes shorter when a portion of the belt having a small PLD is wound around the drive roller. Consequently, if fluctuations in the PLD occur in a portion of the belt wound around the drive roller during belt driving, even if the drive roller rotates by the same rotation angle, the distance over which the belt moves as a result of that rotation changes. As a result, even if the drive roller is rotated by the same rotation angle during each movement of the conveyor belt during intermittent transport of the recording material, each distance by which the recording material is transported ends up being different. For this reason, the belt stopping position during intermittent movement of the conveyor belt ends up shifting from the target position, and each belt stopping position cannot be controlled accurately during intermittent movement of the conveyor belt.

In addition, a second cause of being unable to accurately control each belt stopping position during intermittent movement of the conveyor belt is detection error attributable to the encoder or other detection means. In the case of detecting a single rotation angular displacement or rotation angular velocity of a supporting roller around which a conveyor belt is wrapped, and controlling driving based on that detection result, an error occurs between the belt movement distance obtained from the detection result and the actual belt movement distance due to eccentricity of the supporting roller and the assembly accuracy of the detection means with respect to that supporting roller. If driving is controlled based on a detection result which contains this type of error, the belt stopping position during intermittent movement of the conveyor belt ends up shifting from the target position, thereby preventing accurate control of each belt stopping position during intermittent movement of the conveyor belt.

In addition, a third cause of being unable to accurately control each belt stopping position during intermittent movement of the conveyor belt is a change in the diameter of a supporting roller attributable to temperature changes, wear over time and so on. If the diameter of a supporting roller changes, even if the supporting roller rotates by the same rotation angle, the belt movement distance at that time differs. As a result, if the diameter of the drive roller changes, for example, even if that drive roller is rotated by the same rotation angle, the distance the belt is driven due to that rotation changes. As a result, even if the drive roller is rotated by the same rotation angle during each movement of the conveyor belt during intermittent transport of the recording material, the distance the recording material is transported ends up differing each time, thereby preventing accurate control of each belt stopping position during intermittent movement of the conveyor belt. In addition, if the diameter of a driven roller provided with detection means changes, a result is obtained which is different from the distance the belt has actually moved even in the case of a detection result for the same rotation angle, thereby resulting in detection error. Accordingly, if driving is controlled based on a detection result which contains this type of error, the belt stopping positions during intermittent movement of the conveyor belt end up shifting from the target position, and each belt stopping position during intermittent movement of the conveyor belt cannot be accurately controlled.

Furthermore, the above-mentioned problems of the prior art are not limited to driving control which intermittently moves a belt used as a recording material transport member which supports and transports a recording material, but also can similarly occur for all types of driving control of a belt which is moved intermittently.

Technologies relating to the present invention are also disclosed in, for example, Japanese Patent No. 3,564,953, Japanese Patent No. 3,658,262, Japanese Patent Application Laid-open No. H08-282009 and Japanese Patent Application Laid-open No. 2000-330353.

SUMMARY OF THE INVENTION

In consideration of the above-mentioned problems, an object of the present invention is to provide a belt drive controller capable of accurately controlling each belt stopping position during intermittent movement of a belt, and an image forming apparatus provided therewith.

In the present invention, driving is controlled so that the position in the direction of movement of a belt is at a predetermined target position based on rotation data consisting of rotation angular displacement or rotation angular velocity of two supporting rotating bodies having mutually different diameters. As will be described hereafter, fluctuations in belt movement position caused by fluctuations in pitch line distance or fluctuations in belt thickness at a portion of the belt wound around a driving supporting rotating body during belt driving, fluctuations in belt movement position occurring at the rotation period of a supporting rotating body attributable to eccentricity of a supporting rotating body (consisting of the two supporting rotating bodies and a driving supporting rotating body) used for controlling driving of the belt or assembly error of detection means, and fluctuations in belt movement position caused in the diameter of a supporting roller attributable to temperature changes or wear over time and soon, can be determined from the rotation data of the two supporting rotating bodies having mutually different diameters. Accordingly, in the present invention, each belt stopping position during belt intermittent movement can be controlled in consideration of these fluctuations in belt movement position.

In an aspect of the present invention, a belt drive controller is provided which controls the driving of an endless belt so as to intermittently move the belt wrapped around a plurality of supporting rotating bodies including a driven supporting rotating body, which rotates accompanying movement of the belt, and a driving supporting rotating body which transmits a driving force to the belt. The belt controller comprises a detection device for detecting a rotation angular displacement or a rotation angular velocity of two supporting rotating bodies having mutually different diameters among the plurality of supporting rotating bodies; and a control device for controlling driving of the driving supporting rotating body based on rotation data detected by the detection device so that the position of the belt in the direction of movement becomes a predetermined target position.

In another aspect of the present invention, an image forming apparatus comprises a recording material transport member comprising an endless belt wrapped around a plurality of supporting rotating bodies including a driven supporting rotating body, which rotates accompanying movement of the belt, and a driving supporting rotating body which transmits a driving force to the belt; a driving device which imparts a driving force to the driving supporting rotating body; a belt drive controller for controlling driving of the recording material transport member; and an image forming device for forming an image on a recording material supported and transported on the recording member transport member moved intermittently by the driving control of the belt drive controller. The belt drive controller comprises a detection device for detecting a rotation angular displacement or a rotation angular velocity of two supporting rotating bodies having mutually different diameters among the plurality of supporting rotating bodies; and a control device for controlling driving of the driving supporting rotating body based on rotation data detected by the detection device so that the position of the belt in the direction of movement becomes a predetermined target position.

BRIEF DESCRIPTION OF THE DRAWINGS

The above and other objects, features and advantages of the present invention will become more apparent from the following detailed description taken with the accompanying drawings in which:

FIG. 10A is a block drawing representing the block drawing of FIG. 9 in the form of a continuous system; while

FIG. 14A is a drawing showing the state of a belt wound around an eccentric second roller (drive roller); while

DESCRIPTION OF THE PREFERRED EMBODIMENTS

The following provides an explanation of an embodiment of the present invention applied to an image forming apparatus in the form of an ink jet recording apparatus.

Figure 2:
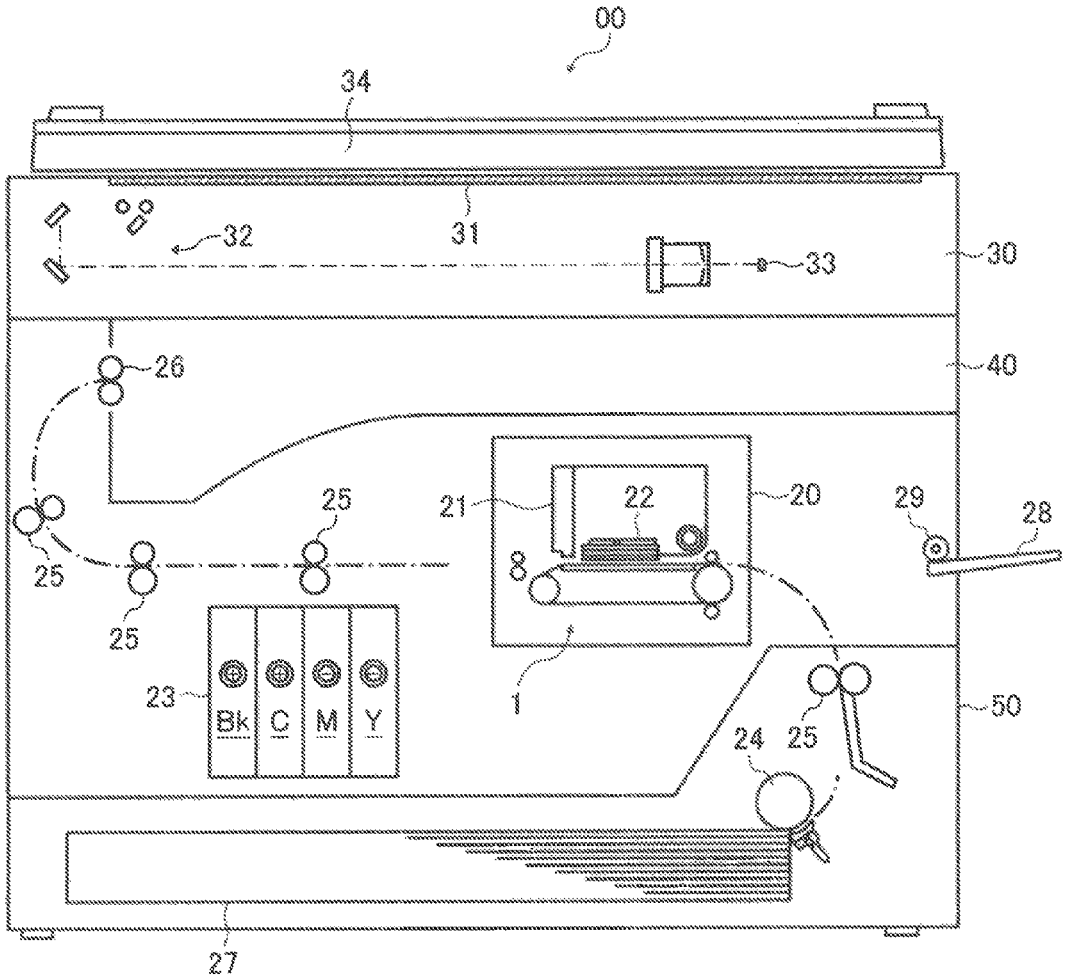
FIG. 2 is a drawing showing the entire constitution of the ink jet recording apparatus of FIG. 1.

FIG. 2 shows the cross-sectional constitution of an example of an ink jet recording apparatus as claimed in the present embodiment.

This ink jet recording apparatus has a scanner unit 30 arranged above a printer unit 50, and is composed in the form of a photocopying apparatus. A paper discharge unit 40 is formed between the scanner unit 30 and the paper discharge unit 50. The scanner unit 30 has scanning means 32 capable of traveling downward below a contact glass 31, and reflected light from a document illuminated by a light source is guided to a CCD 33 by means of mirrors, lenses and so forth where the document image is read. A pressure plate 34 is provided while being able to be opened and closed above the contact glass 31. In addition, the printer unit 50 has a recording paper transport path (indicated with a single-dot broken line in FIG. 2) extending from a paper cassette 27 arranged there below to the paper discharge unit 40. Transport rollers 25 are suitably installed at predetermined locations in the recording paper transport path. Furthermore, reference symbol 24 indicates a paper feeding roller, while reference symbol 26 indicates a paper discharge roller. In addition, a manual feed tray 28 is provided on the side of the apparatus, and recording paper is also fed from this manual feed tray 28 by means of paper feeding roller 29.

An ink jet engine 20 is loaded in the printer unit 50, and this ink jet engine 20 has a recording paper transport apparatus 1. This recording paper transport apparatus 1 transports a recording material in the form of recording paper in the secondary scanning direction using a conveyor belt composed of an electrostatic adsorption belt. The recording paper transport apparatus 1 using this type of electrostatic adsorption belt offers the advantage of allowing paper to be fed more stably than typical roller transport systems. In addition, this ink jet engine 20 is equipped with a carriage 21 on the recording paper transport apparatus 1. The carriage 21 is loaded with a printing head 22, and reciprocates in the primary scanning direction (vertical direction in the drawing) to carrying out printing by discharging ink droplets from the printing head 22. This printing head 22 employs a four-head configuration equipped with one head for each of the colors of cyan (C), magenta (M), yellow (Y) and black (Bk). However, the number of heads is not limited thereto, but rather, for example, a two-head configuration may also be employed equipped with one-head for two colors each.

In addition, the ink jet recording apparatus of the present embodiment is loaded with ink cartridges 23 for each color separate from the printing head 22, and the ink inside these cartridges 23 is supplied to printing head 22 for each color by means of supply tubes not shown. A system in which each color of ink cartridge 23 is loaded separately from the printing head enables large-capacity ink cartridges to be used corresponding to increased consumption of ink accompanying high-speed printing, and is suitable for business applications. However, a constitution of the type in which the printing head and ink cartridges are integrated into a single unit may also be employed for supplying ink.

Figure 1:
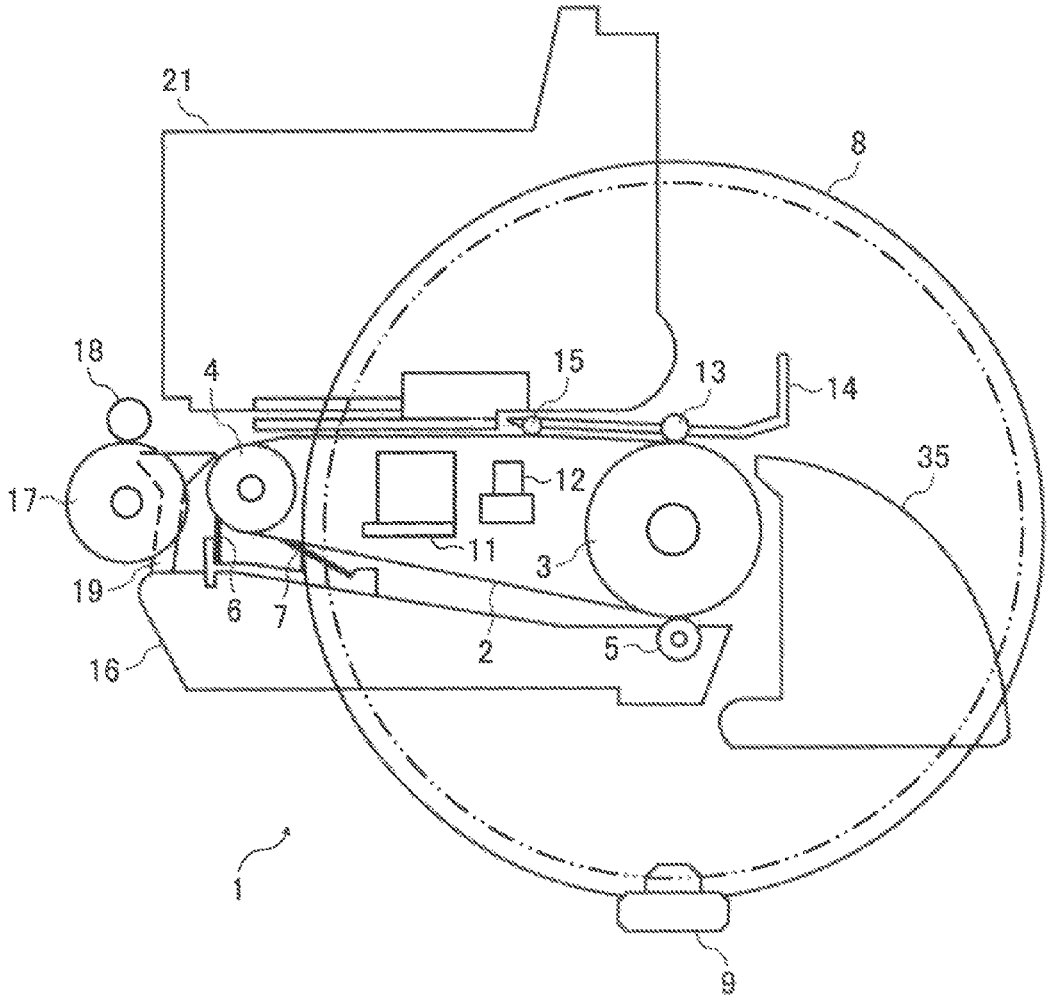
FIG. 1 is a drawing showing the constitution of a recording paper transport apparatus of an ink jet recording apparatus as claimed in the present embodiment.
Figure 3:
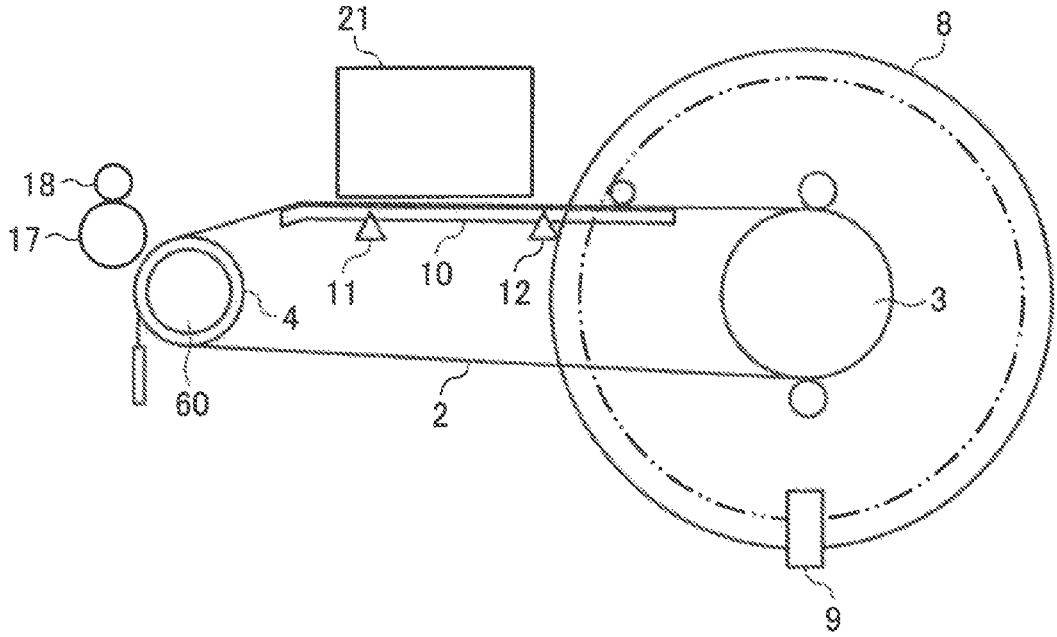
FIG. 3 is a drawing for providing a detailed explanation of the recording paper transport apparatus of FIG. 1.

FIGS. 1 and 3 are detailed drawings showing the details of the constitution of the recording paper transport apparatus 1.

An endless belt in the form of a conveyor belt 2 serving as a recording paper transport member for transporting recording paper in a secondary scanning direction is wrapped around a driving supporting rotating body in the form of a drive roller 3, and a driven supporting rotating body in the form of a tension roller 4. A charging roller 5 for imparting an electrical charge to the conveyor belt 2, a decharging roller 6 for decharging the conveyor belt 2, and a cleaning blade 7 for cleaning the conveyor belt 2 are respectively pressed against the outer periphery of the conveyor belt 2. The charging roller 5, the decharging roller 6 and the cleaning blade 7 are supported by a bracket 16. A collection unit is provided in bracket 16 for accumulating paper scraps, ink debris and so forth removed from the conveyor belt 2 by the cleaning blade 7. A pressure roller 13 supported by a pressure plate 14 is arranged in opposition to the drive roller 3. A distal end pressure roller 15 is supported on the distal end of the pressure plate 14. This distal end pressure roller 15 serves to press the conveyor belt 2 against a platen 10 (see FIG. 3) arranged on the inside of the upper section of the conveyor belt 2.

An entrance guide member 35 is arranged to the side of the driver roller 3, and recording paper which has been fed from the paper feeding unit is guided between the drive roller 3 (conveyor belt 2) and the pressure plate 14. Recording paper which has been electrostatically adsorbed to the upper surface of the conveyor belt 2 is transported from right to left in the drawings, namely in the secondary scanning direction, by the conveyor belt 2 which rotates counter-clockwise in the drawings. A paper discharge roller pair consisting of a paper discharge roller 17 and a spur 18 is provided on the downstream side of the tension roller 4. The tension roller unit 4 is provided with a separating tab 19, and recording paper which has been separated from the conveyor belt 2 by the separating tab 19 is sent to the downstream side by the paper discharge roller pair consisting of the paper discharge roller 17 and the spur 18.

A high-resolution code wheel 8 is attached to the shaft of the drive roller 3. Detection targets in the form of slits not shown are formed in the code wheel 8, and detection means in the form of a transmissive encoder sensor 9 is provided for detecting the slits. The detection means in the form of a rotary encoder is composed by the code wheel 8 and the sensor 9. A rotary encoder of 300 LPI or higher and 4800 CR or better is preferably used for the rotary encoder of the present embodiment since resolution equal to or smaller than the nozzle pitch of the printing head is required.

A correcting rotary encoder 60 is attached coaxially to the axis of the tension roller 4. In addition, the diameter of the tension roller 4 differs from the diameter of the drive roller 3, and is shown here to be smaller than the diameter of the drive roller 3. In FIG. 3, although the correcting rotary encoder 60 is mounted on the shaft of the tension roller 4, it is only required to be mounted on a shaft differing from the drive roller and which is driven by means of the conveyor belt 2. For example, an exclusive correcting roller shaft may be provided in addition to the drive roller 3 and the tension roller 4. In this case as well, the diameter of the correcting roller is required to be different from the diameter of the drive roller 3.

Figure 4:
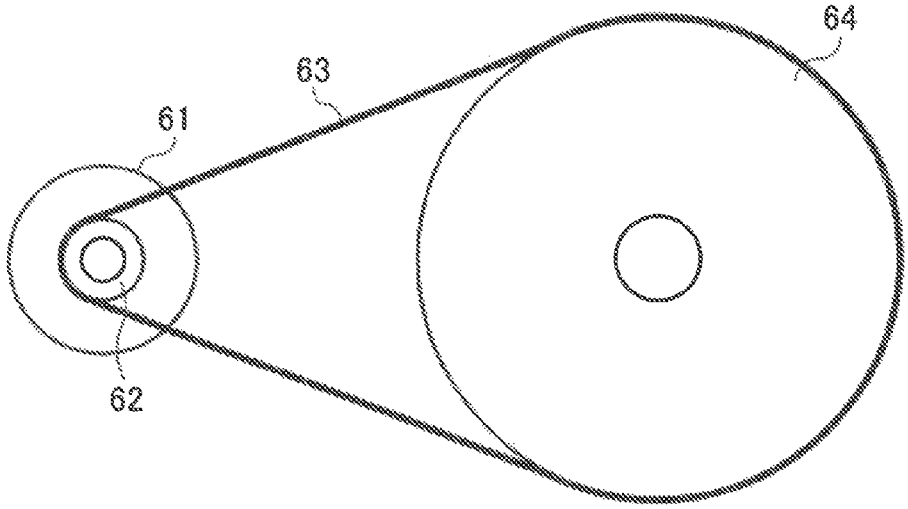
FIG. 4 is a drawing showing a transmission mechanism of a belt transport mechanism used in the recording paper transport apparatus of FIG. 1.

FIG. 4 is a drawing showing a transmission mechanism of a belt transport mechanism used in the recording paper transport apparatus 1. Driving force generated by a motor 61 is transmitted to the drive roller 3 by means of a speed reduction mechanism composed of a motor pulley 62, a timing belt 63, and a transport pulley 64 attached to one end of the driving roller 3. The code wheel 8 is coaxially attached to the transport pulley 64. Here, although the cord pulley 8 and the encoder sensor 9 are attached to one end of the driving roller 3, an encoder in which the code wheel and sensor are integrated into a single unit or a motor attached to which the encoder is coaxially attached may also be used. In addition, although the above-mentioned transmission mechanism is in the form of a transmission mechanism using pulleys and a timing belt, it may also be a transmission mechanism which uses gears or a mechanism which directly drives the driving roller with a motor.

[Correction of Fluctuations in Belt Movement Position Attributable to PLD Fluctuations]

Next, an explanation is provided of an example of a method for correcting fluctuations in belt movement position attributable to fluctuations in PLD.

First, an explanation is provided of the principle by which fluctuations in belt movement position occur due to fluctuations in PLD. Furthermore, although the following explanation is in relation to fluctuations in PLD, since the relationship between PLD and belt thickness is nearly constant in the case the belt is a single-layer belt made of a uniform material, and the absolute value of flexibility between the inside and outside of the belt is nearly equal, PLD fluctuations are the same even if substituted for fluctuations in belt thickness in this case.

Although belt movement velocity fluctuates for various causes, one cause is fluctuations in PLD in the portion of the belt wound around the driving roller during belt driving. These fluctuations in PLD occur due to uneven belt thickness occurring as a result of material thickness in the circumferential direction of the belt as is observed in, for example, belts made by centrifugal baking using a cylindrical mold. When such fluctuations in PLD occur, the belt movement velocity increases when a portion of the belt having a large PLD is wound around the drive roller (driving supporting rotating body) driving the belt, while conversely the belt movement velocity decreases when a portion of the belt having a small PLD is wrapped around the drive roller. Consequently, fluctuations occur in the belt movement velocity, and the distance the belt moves during each belt movement during intermittent movement of the belt changes according to the fluctuations in PLD. Accordingly, if driving is controlled without taking these fluctuations in PLD into consideration, each belt stopping position cannot be accurately controlled during intermittent belt movement. The following provides a specific explanation of the reason for the occurrence of fluctuations in belt movement velocity using the case in which the relationship between PLD and belt thickness is nearly constant.

Figure 5:
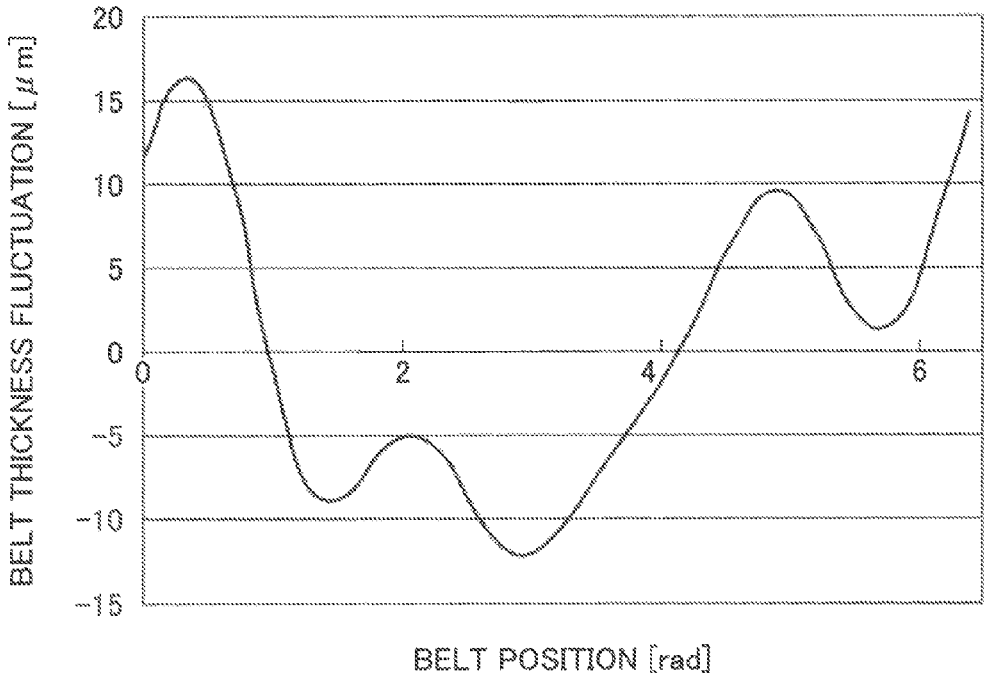
FIG. 5 is a graph showing an example of belt thickness unevenness (belt thickness uneven distribution) in the peripheral direction of a conveyor belt having a single-layer structure provided by the recording paper transport apparatus of FIG. 1.

FIG. 5 is a graph showing an example of uneven belt thickness (belt thickness uneven distribution) in the circumferential direction of the conveyor belt 2 having a single-layer structure used in the image forming apparatus shown in FIG. 2. On the horizontal axis of this graph, the length of one circumference of the belt (belt circumference) is substituted with an angle of $2\pi$ [rad]. The vertical axis represents the deviation of belt thickness using an average belt thickness (100 μm) in the circumferential direction as a reference (reference value: 0).

Figure 6:
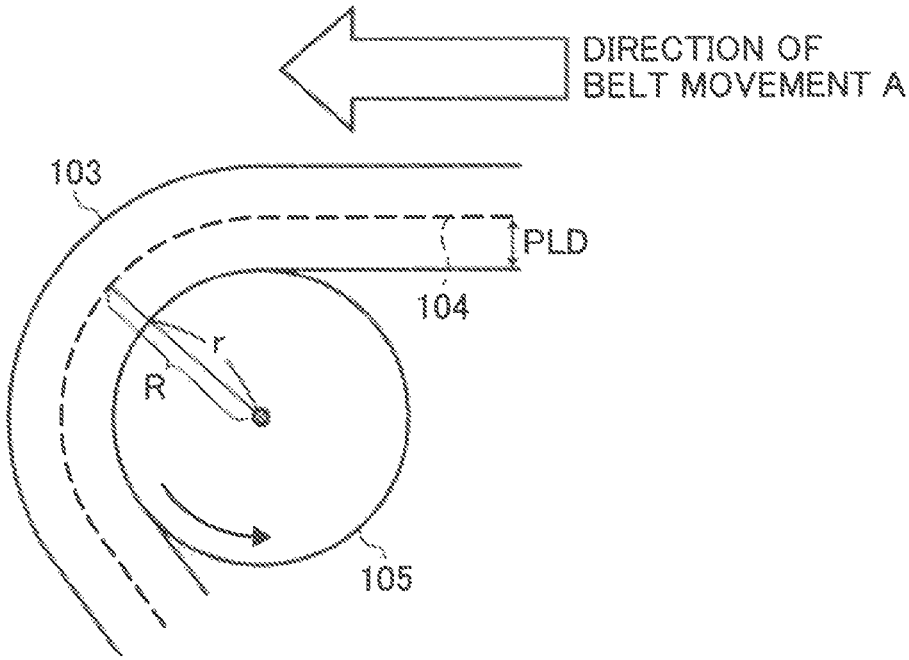
FIG. 6 is an enlarged view of the portion of a belt wound around a drive roller of the conveyor belt of FIG. 5 as viewed from the axial direction of the drive roller.

FIG. 6 is an enlarged view of a portion of a belt wound around a drive roller as viewed from the axial direction of the drive roller. A belt 103 is wound around a drive roller 105 as a result of the outside of the belt cross-section being stretched while the inside is compressed. Belt pitch line 104, which determines the movement velocity of the belt 103, is located in the center of the belt in the direction of thickness in the case of being a single-layer belt made of a uniform material and the flexibility of the outside and inside of the belt 103 being nearly equal. In a belt having multi-layer structure, as a result of the flexibility of a hard layer and a soft layer being mutually different, the location of the belt pitch line shifts from the center of the belt in the direction of thickness. The distance from the roller surface to this belt pitch line, namely PLD, can be represented by Eq. (1) shown below.

$$PLD=PLD_{ave}+f(d) \quad \text{Eq. (1)}$$

Here, $PLD_{ave}$ refers to the average value of PLD over one circumference of the belt, and in the case of a single-layer belt having an average thickness of 100 μm, $PLD_{ave}$ becomes 50 μm. In addition, f(d) is a function which indicates the fluctuation in PLD over one belt circumference. Here, "d" indicates the position from a point serving as a reference on the belt circumference (phase when belt circumference is defined as 2π), f(d) is a periodic function using belt circumference as the period thereof having a high correlation with the value of belt thickness deviation shown in FIG. 5. When this PLD changes, the belt transport velocity (transported amount) at which the belt is transported in accordance with a roller relative to the rotation angular velocity (rotating angle) of the driving roller, as well as the rotation angular velocity (rotating angle) of a roller rotating in accordance with the belt with respect to belt transport velocity (transported amount), change.

The relationship between belt movement velocity V and rotation angular velocity ω of the drive roller 105 is represented by the following Eq. (2). In this equation, "r" is the radius of the drive roller 105. In addition, there are cases in which the degree to which PLD fluctuation f(d) affects the relationship between belt movement velocity (amount of movement) and roller rotation angular velocity (rotating angle) varies according to the contact state and wound amount of the belt with respect to drive roller 105. This degree of affect is represented by an effective PLD fluctuation coefficient κ.

$$V=\{r+PLD_{ave}+\kappa f(d)\}\omega \quad \text{Eq. (2)}$$

In subsequent descriptions of the present specification, brackets { } shown in Eq. (2) above refer to the effective radius, while the constant portion of the equation in the form of ($r+PLD_{ave}$) is defined as effective radius R. f(d) refers to PLD fluctuation.

On the basis of the equation shown in Eq. (2) above, the relationship between the belt movement velocity V and rotation angular velocity ω of the drive roller 105 can be seen to change due to the presence of PLD fluctuation f(d) Namely, even if the drive roller 105 rotates at a constant rotation angular velocity (ω=constant), the movement velocity V of the belt 103 changes due to PLD fluctuation f(d). Here, in the case of a single-layer belt, when a portion of the belt having a thickness greater than the belt average thickness is wound around the drive roller 105, the effective radius increases when PLD fluctuation f(d), which demonstrates a high correlation with the thickness deviation of the belt 103, is a positive value. Consequently, even if the drive roller 105 is rotating at a constant rotation angular velocity (ω=constant), belt movement velocity V increases. Conversely, when a portion of the belt having a thickness less than the belt average thickness is wound around the drive roller 105, effective radius decreases when PLD fluctuation f(d) is a negative value. Consequently, even if the drive roller 105 is rotating at a constant rotation angular velocity (ω=constant), belt movement velocity V decreases.

Thus, even if the rotation angular velocity ω of the drive roller 105 is constant, the movement velocity of the belt 103 is not constant due to PLD fluctuation f(d). Consequently, even if driving of the belt 103 is attempted to be controlled based on the rotation angular velocity ω of the drive roller 105 alone, the belt 103 cannot be driven at a desired movement velocity.

In addition, the relationship between belt movement velocity V and the rotation angular velocity of a driven roller is similar to the above-mentioned relationship between belt movement velocity V and the rotation angular velocity ω of the drive roller 105. Namely, even in the case the rotation angular velocity of a driven roller is detected by a rotary encoder and so on, and belt movement velocity V is determined from that detected rotation angular velocity, the equation shown in Eq. (2) above can be used. Accordingly, when a portion of the belt having a thickness greater than the belt average thickness is wound around a driven roller, the roller effective radius increases in the same manner as the case of the drive roller 105 when PLD fluctuation f(d) of the belt 103 is a positive value. Consequently, even if the belt 103 is moving at a constant movement velocity (V=constant), the rotation angular velocity of the driven roller decreases. Conversely, when a portion of the belt having a thickness less than the average belt thickness is wound around the driven roller, the roller effective radius decreases when PLD fluctuation f(d) is a negative value. Accordingly, even if the belt 103 is moving at a constant movement velocity, the rotation angular velocity of the driven roller increases. Consequently, even if the movement velocity of the belt 103 is constant, the rotation angular velocity of the driven roller is not constant due to PLD fluctuation f(d). It is therefore necessary to control belt driving in consideration of belt thickness unevenness of a single-layer belt in this manner as well as the accompanying PLD fluctuation f(d).

However, since flexibility of the inside and outside of the belt are equal in the case of a single-layer belt made of a uniform belt material, as shown in FIG. 6, the belt pitch line 104, which determines the movement velocity of the belt, is located in the center of the belt in the direction of thickness. However, in the case of a belt in which different materials are laminated in a plurality of layers, the belt pitch line is not located in the center of the belt in the direction of thickness. In a multi-layer belt, in the case of a layer among the plurality of layers which compose the belt has an extremely large Young's modulus, the belt pitch line is located nearly in the center of that layer. This is because a layer having a large Young's modulus (to be referred to as a "stretching resistant layer") serves as the center line since it prevents stretching and contraction in the circumferential direction of the belt, while the other layers stretch and contract while being wound around a supporting roller. In such a case in which a stretching resistant layer having an extremely large Young's modulus is present, uneven thickness of this stretching resistant belt in the direction of belt circumference has a considerable effect on fluctuations in PLD. In other words, in multi-layer belts, PLD is mainly determined as a result of being affected by the layer having a large Young's modulus among the layers that compose the belt.

In addition, PLD also fluctuations in the case in which the position of the stretching resistant layer is displaced in the direction of belt thickness over one circumference of the belt. For example, if uneven thickness is present in a layer present between the stretching resistant layer and a supporting roller, the location of the stretching resistant layer in the direction of belt thickness changes corresponding to this uneven thickness, resulting in corresponding fluctuation in PLD.

In addition, in the case of an endless belt having a seam (seam belt), such belts are frequently produced by producing a poly(vinylidene fluoride) sheet to serve as the stretching resistant layer, overlapping about 2 mm of the ends of the sheet followed by melting and adhering to form an endless belt, and sequentially forming each of the other layers. In this case, the physical properties of the portion adhered by melting (seam portion) change, and since the flexibility thereof differs from that of other portions, even if the thickness is the same as that of other portions, the PLD at the seam portion differs greatly from the PLD of the other portions. At such portions, even if there are no fluctuations in belt thickness, PLD fluctuations occur and fluctuations in belt movement velocity occur when this portion is wound onto a drive roller. Furthermore, in comparison with seamless belts not having a seam which require a specific mold each time a product is produced having a mutually different belt circumference, seam belts having a seam do not require such a mold, and thereby offer the advantage of reduced production costs since belt circumference can be adjusted as desired.

Next, an explanation is provided of an overview of correcting fluctuations in belt movement velocity occurring due to fluctuations in PLD.

The present embodiment continuously detects rotation data (angular velocities $\omega_1$, $\omega_2$) of two rollers having different roller diameters, and determines PLD fluctuation f(t) from these two types of rotation data (angular velocities $\omega_1$, $\omega_2$). This PLD fluctuation f(t) is a periodic function indicating a time-based change in PLD fluctuation of a belt passing over a specific point on a belt movement path during the time the belt makes one revolution. Since this PLD fluctuation f(t) has a considerable effect on belt movement velocity V as previously described, the belt movement velocity V can be accurately controlled by accurately determining this PLD fluctuation f(t) from the roller rotation data, and controlling belt driving based on that PLD fluctuation f(t).

In the present embodiment, examples of two types of methods for accurately determining PLD fluctuation f(t) are indicated. The first method involves processing with a filter that does not have an effect on the above-mentioned positional relationship of the two rollers (PLD fluctuation recognition method 1). The second method comprises processing with a filter by defining the above-mentioned positional relationship of the two rollers (the belt transport distance between the two rollers) as an integer fraction of one period of the belt (PLD fluctuation recognition method 2).

(PLD Fluctuation Recognition Method 1)

Figure 7:
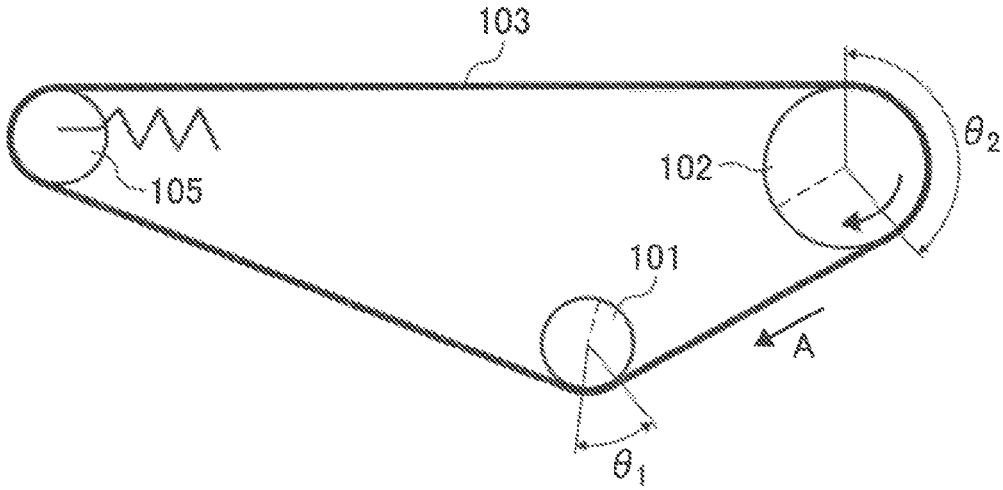
FIG. 7 is a schematic drawing showing an example of the constitution of a belt apparatus for explaining a PLD fluctuation recognition method 1.

FIG. 7 is a schematic drawing showing an example of the constitution of a belt apparatus.

This belt apparatus is equipped with a belt 103, and supporting rotating bodies in the form of a first roller 101, a second roller 102 and a third roller 105 on which this belt 103 is wrapped around. The belt 103 is wound around the first roller 101 at a belt winding angle $\theta_1$, and is wound around the second roller 102 at a belt winding angle of $\theta_2$. The third roller 105 is a tension roller which imparts a constant tension to the belt 103. The second roller 102 is a drive roller which drives in the direction indicated by the arrow. The belt 103 moves endlessly in the direction of arrow A in the drawing. Detection means in the form of rotary encodes are respectively provided on the first roller 101 and the second roller 102. These rotary encoders are only required to detect the rotation angular displacement or rotation angular velocity of each roller 101, 102. In the present embodiment, rotary encoders are used which are able to detect the rotation angular velocities $\omega_1$, $\omega_2$ of each roller 101, 102. Examples of rotary encoders which can be used include known optical encoders in which timing marks are concentrically formed at constant intervals on a disk made of a transparent member such as transparent glass or plastic, the disk is coaxially fixed to each roller 101, 102, and the timing marks are then detected optically. In addition, a magnetic encoder can also be used in which, for example, timing marks are recorded concentrically and magnetically on a disk made of a magnetic material, the disk is coaxially fixed to each roller 101, 102, and the timing marks are then detected with a magnetic head. In addition, known tachogenerators can also be used. In the present embodiment, a rotation angular velocity can be obtained by, for example, measuring the time interval of pulses continuously output from a rotary encoder, and then determining the rotation angular velocity from the inverse thereof. Furthermore, rotation angular displacement can be obtained by counting the number of pulses continuously output from a rotary encoder.

The relationships between rotation angular velocity and belt movement velocity V for the first roller 101 and the second roller 102 are represented by the following Eq. (3) and Eq. (4), respectively.

$$V=\{R_1+\kappa_1 f(t)\}\omega_1 \quad \text{Eq. (3)}$$

$$V=\{R_2+\kappa_2 f(t-\tau)\}\omega_2 \quad \text{Eq. (4)}$$

Here, "$\omega_1$" is the rotation angular velocity of the first roller 101, "$\omega_2$" is the rotation angular velocity of the second roller 102, "V" is the belt movement velocity, "$R_1$" is the effective radius R of the first roller 101, and "$R_2$" is the effective radius R of the second roller 102.

In addition, "κ1" is the effective PLD fluctuation coefficient of the first roller 101 determined by the belt winding angle $\theta_1$, belt material, belt layer structure and so on of the first roller 101, and is a parameter which determines the degree of the effect of PLD fluctuation on belt movement velocity V. Similarly, "$\kappa_2$" is the effective PLD fluctuation coefficient of the second roller 102. The reason why a different effective PLD fluctuation coefficient is used for each roller is that, since the belt winding state (deformation curvature) differs according to differences in roller diameter and the belt wound amount differs for each roller, there are cases in which the degree of the effect of PLD fluctuation on the relationship between belt movement velocity (amount of movement) and roller rotation angular velocity (rotating angle) differs.

In addition, "f(t)" indicates a time-based change in PLD fluctuation of a belt passing over a specific point on a belt movement path. This f(t) is a periodic function having the same period as the period of one revolution of the belt, and indicates a deviation from an average value of PLD in the circumferential direction of the belt over one circumference of the belt. Here, the specific point is the location where the belt is wound around the first roller 101. Thus, at a time t=0, the value of PLD fluctuation in a portion of the belt wound around the first roller 101 becomes f(0). Furthermore, the above-mentioned function f(d) may be used instead of time function f(t) as a function of PLD fluctuation. This is because f(t) and f(d) can be inter-converted.

In addition, "τ" is the average time required for the belt 103 to move from the first roller 101 to the second roller 102, and is hereinafter referred to as "delay time". This delay time τ refers to a phase difference between PLD fluctuation f(t) at a portion of the belt wound around the first roller 101 and PLD fluctuation f(t−τ) at a portion of the belt wound around the second roller 102.

Here, since belt movement velocity V at time t of a portion of the belt wound around the second roller 102 is the same as belt movement velocity V at time t f a portion of the belt wound around the first roller 101, the equation indicated in Eq. (5) below can be derived from the above-mentioned Eq. (3) and Eq. (4).

$$\omega_2 = \frac{\{R_1 + \kappa_1 f(t)\}}{\{R_2 + \kappa_2 f(t-\tau)\}}\omega_1 \quad \text{Eq. (5)}$$

Since PLD fluctuation f(t) is sufficient small with respect to the effective radius R1, R2 of each roller, the equation indicated in Eq. (5) can be approximated to the indicated in Eq. (6).

$$\omega_2 \cong \frac{R_1}{R_2}\omega_1 + \frac{R_1}{R_2}\omega_1\left\{\frac{\kappa_1}{R_1}f(t) - \frac{\kappa_2}{R_2}f(t-\tau)\right\} \quad \text{Eq. (6)}$$

The following provides an explanation of a method for accurately determining PLD fluctuation f(t) from the rotation angular velocities $\omega_1$, $\omega_2$ of the two rollers 101, 102. Furthermore, in the following example, although an example is used in which the diameter of the second roller 102 is larger than the diameter of the first roller 101 for the diameters of rollers 101, 102, the same principle can be used in the opposite case as well. Strictly speaking, this refers to the case in which, when comparing values obtained by dividing the effective radius R of a roller by the effective PLD fluctuation coefficient κ as described to follow, the value of the second roller 102 is larger than the value of the first roller 101.

The relationship for the rotation angular velocities $\omega_1$, $\omega_2$ between the first roller 101 and the second roller 102 is represented by the equation indicated in the above-mentioned Eq. (6), and transformation of this equation yields the equation indicated in the following Eq. (7).

$$\left(\omega_2 - \frac{R_1}{R_2}\omega_1\right)\frac{R_2}{\omega_1\kappa_1} = \left\{f(t) - \frac{\kappa_2 R_1}{\kappa_1 R_2}f(t-\tau)\right\} \quad \text{Eq. (7)}$$

In this manner, if the right side of Eq. (7) normalized so that the coefficient of f(t) is 1 is defined as gf(t), then the following Eq. (8) is obtained. However, "G" in this Eq. (8) is that indicated in Eq. (9).

$$gf(t) = \{f(t) - Gf(t-\tau)\} \quad \text{Eq. (8)}$$

$$G = \frac{\kappa_2 R_1}{\kappa_1 R_2} = \frac{R_1}{\kappa_1} \Big/ \frac{R_2}{\kappa_2} \quad \text{Eq. (9)}$$

G has a value of less than 1 based on the relationship between roller effective radius R and effective PLD fluctuation coefficient κ in each roller 101, 102. In addition, as can be understood from Eq. (7), gf(t) is obtained from the rotation angular velocities $\omega_1$, $\omega_2$ of each roller 101, 102 using effective radii $R_1$, $R_2$ and effective PLD fluctuation coefficients $\kappa_1$, $\kappa_2$. PLD fluctuation f(t) can then be determined from this gf(t).

Figure 8:
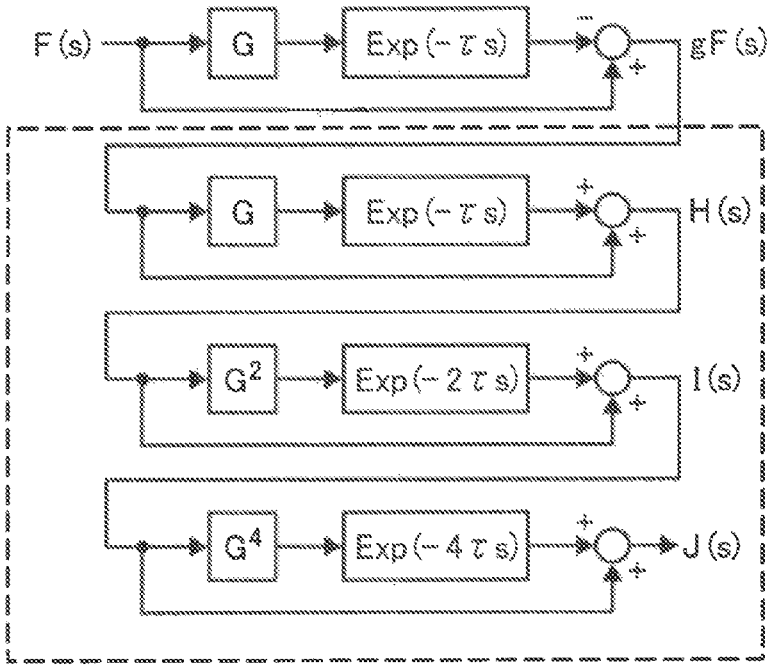
FIG. 8 is a block drawing showing the constitution of a control system for explaining the PLD fluctuation recognition method 1.

FIG. 8 shows the constitution of a control system for explaining this recognition method 1. Furthermore, in this drawing, F(s) resulting from Laplace conversion of the time function f(t) is used, and "s" in the drawing is the Laplace operator, and F(s)=L{f(t)} (where, L{x} indicates Laplace conversion of x). In addition, in FIG. 8, the 0th stage shown at the top of the drawing represents the above-mentioned Eq. (8) for the sake of convenience, while the 1st stage and beyond encircled with a broken line in the drawing is the filter section.

When gF(s), namely the left side of Eq. (7) (data obtained from the detected rotation angular velocities $\omega_1$, $\omega_2$) is entered into this filter section, the time function h(t) of output H(s) of the 1st stage, namely $L^{-1}\{H(s)\}$ (where, $L^{-1}\{y\}$ indicates inverse Laplace conversion of y; to apply similarly to I(s), J(s) hereinafter) is as indicated in the following Eq. (10).

$$\begin{aligned} h(t) &= [gf(t) + Ggf(t-\tau)] \quad \text{Eq. (10)} \\ &= [f(t) - Gf(t-\tau)] + G[f(t-\tau) - Gf(t-2\tau)] \\ &= f(t) - G^2 f(t-2\tau) \end{aligned}$$

At this time, since $G^2$ is sufficiently smaller than $G(G>>G^2)$, h(t) is closer to PLD fluctuation f(t) than the above-mentioned gf(t). The error $\epsilon_1$ at this time becomes as shown in the following Eq. (11).

$$\epsilon_1 = -G^2 f(t-2\tau) \quad \text{Eq. (11)}$$

In addition, time function i(t) of output I(s) of the 2nd stage becomes as shown in the following Eq. (12).

$$i(t) = f(t) - G^4 f(t-4\tau) \quad \text{Eq. (12)}$$

At this time, since $G^4$ is sufficiently smaller than $G^2$ ($G^2>>G^4$), i(t) becomes even closer to PLD fluctuation f(t) than h(t). The error $\epsilon_2$ at this time is as shown in the following Eq. (13)

$$\epsilon_3 = -G^4 f(t-4\tau) \quad \text{Eq. (13)}$$

Moreover, time function j(t) of output J(s) of the 3rd stage is as shown in the following Eq. (14).

$$j(t) = f(t) - G^8 f(t-8\tau) \quad \text{Eq. (14)}$$

At this time, since $G^8$ is sufficiently smaller than $G^4$ ($G^4>>G^8$), j(t) becomes even closer to PLD fluctuation f(t) than i(t). The error $\epsilon_3$ at this time is as shown in the following Eq. (15).

$$\epsilon_3 = -G^8 f(t-8\tau) \quad \text{Eq. (15)}$$

If PLD fluctuation f(t) is determined using the data on the left side of Eq. (7) in the form of data obtained from the detected rotation angular velocities $\omega_1$, $\omega_2$ in accordance with the following generalized sequence of the results described above, then PLD fluctuation f(t) can be accurately determined from the detected rotation angular velocities $\omega_1$, $\omega_2$ independent of the above-mentioned distance between rollers.

(1st Step)

Value $g_1(t)$ is determined by adding data delayed by delay time τ obtained by multiplying G by gf(t) and gf(t)

(2nd Step)

Value $g_2(t)$ is determined by adding data delayed by delay time 2τ, which is 2 times delay time τ, obtained by multiplying $G^2$ by $g_1(t)$, and $g_1(t)$.

(3rd Step)

Value $g_3(t)$ is determined by adding data delayed by delay time 4τ, which is 4 times delay time τ, obtained by multiplying $G^4$ by $g_2(t)$, and $g_2(t)$.

.

.

.

(nth Step)

Value $g_n(t)$ is determined by adding data obtained by delaying the product of multiplying $G^{2n-1}$ by $g_{n-1}(t)$ by an amount of time obtained by multiplying $2^{n-1}$ by delay time τ, and $g_{n-1}(t)$.

The operation on the nth stage in the filter section shown in FIG. 8 is such that the above input data (or signal) is added to data obtained by defining a delay element with respect to output data of the previous stage in the form of input data (or signal) to be $2^{n-1}$ times the delay time τ, and defining a gain element to be $2^{n-1}$ times the above-mentioned G. Output data $g_n(t)$ of the final stage is then determined as PLD fluctuation f(t). Furthermore, the recognition accuracy of PLD fluctuation f(t) increases as the number of steps n increases.

Figure 9:
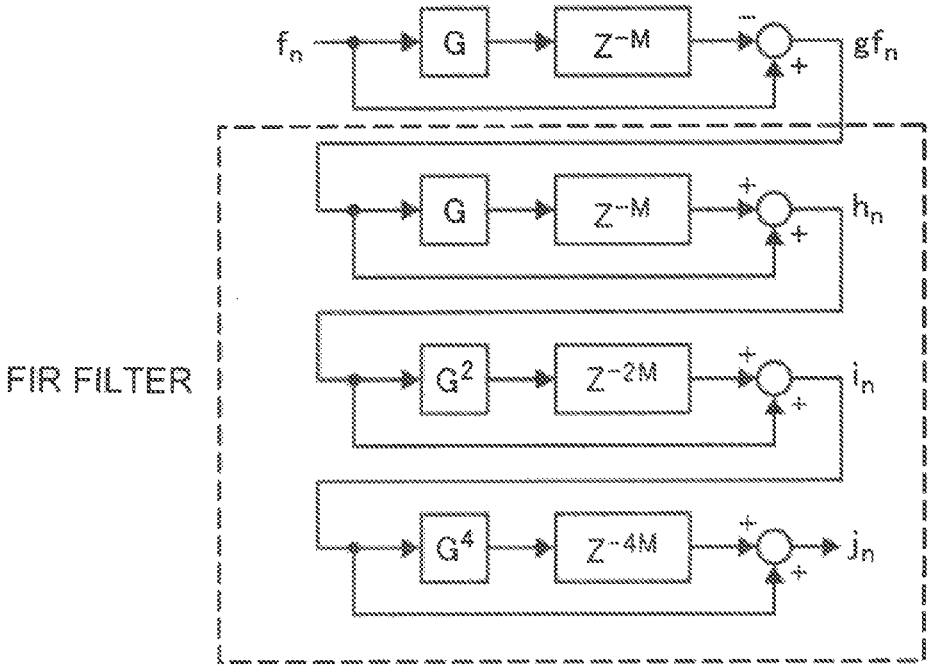
FIG. 9 is a block drawing showing the constitution of a control system represented by Z conversion of the block drawing of FIG. 8.

FIG. 9 shows the constitution of a control system represented by Z conversion of the control system of FIG. 8. Furthermore, in FIG. 9, gf(n) is represented as $gf_n$, while f(n) is represented as $f_n$.

The sampling time of input data input to the filter section (FIR filter) shown in FIG. 9 is defined as Ts, delay time τ is defined as M×Ts (where, M is a natural number), and the amount of time Tb for the belt 103 to make one revolution is defined as N×Ts (where, N is a natural number). In this case, the number of samples during one revolution of the belt 103 becomes N. PLD fluctuation f(t) as determined in accordance with this control system shown in FIG. 9 is comprised of a data string of N PLD fluctuation values f(n) obtained for each sampling time Ts. Since the processing in the filter section at this time is digital, the above-mentioned arithmetic processing can be performed using a digital signal processor (DSP) or μCPU and the like.

Figure 10A:
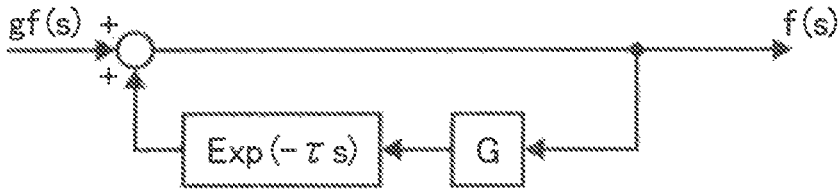

In addition, a multi-stage type of FIR filter shown in FIG. 9 can be converted to an IIR filter. FIG. 10A shows the result of representing the control system of FIG. 9 in the form of a continuous system, while a dispersed representation of this for digital processing is shown in FIG. 102.

(PLD Fluctuation Recognition Method 2)

As has been described above, in the PLD fluctuation recognition method 1, the layout has a high degree of freedom since there are no limitations on the layout of the rollers. However, arithmetic processing time is required through the 3rd step by the time the recognition error of PLD fluctuation f(t) becomes the above-mentioned Eq. (15). For example, in the processing of the 1st step, since processing is carried out using data delayed by a delay time τ, namely previous data by an amount of time τ, a time τ is required for the time function of the output of the 1st step to become Eq. (10). In addition, an additional time 2τ (time 3τ as a result of totaling with the 1st step) is required for the time function of the output to become Eq. (12) in the processing of the 2nd step. Similarly, an additional time 4τ (time 7τ as a result of totaling from the 1st step) is required for the time function of the output to become Eq. (15) in the processing of the 3rd step. Thus, a large number of steps and considerable processing time are required to accurately reduce the error for recognizing PLD fluctuation f(t). Therefore, an explanation is provided of this recognition method 2 for accurately determining PLD fluctuation f(t) in a short period of time from the rotation angular velocities $\omega_1$, $\omega_2$ of the two rollers 101, 102 in a constitution in which the layout of the two rollers is in a relationship such that the ratio between the belt transport interval (distance) between the rollers and the belt total transport interval (circumference) is 1:2 Nb (where, Nb is a natural number).

Figure 11:
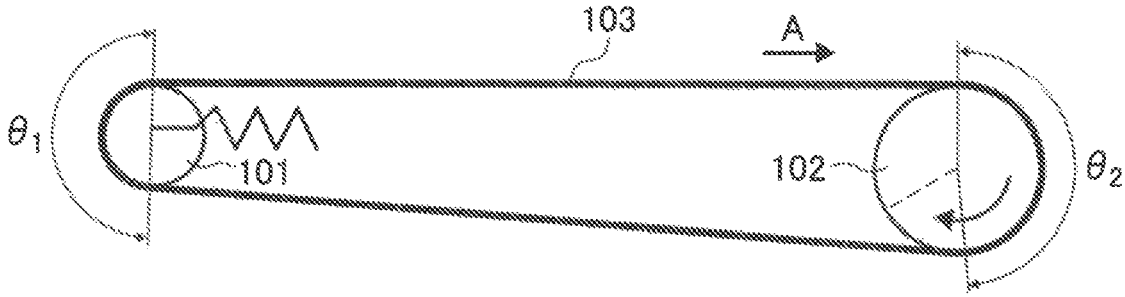
FIG. 11 is a schematic drawing of an example of the constitution of a belt for explaining a PLD fluctuation recognition method 2.

In this PLD fluctuation recognition method 2, the relationship of the layout of the two rollers is such that the ratio between the belt transport interval (distance) between the rollers and the belt total transport interval (circumference) is 1:2 Nb (where, Nb is a natural number). In other words, since the ratio of the transport intervals is 1:2 in the case Nb=1, the layout of the two rollers is in a positional relationship in which they are separated by the greatest distance in the belt transport path as shown in FIG. 11. Here, the first roller 101 is a tension roller, while the second roller 102 is a drive roller. When the roller layout satisfies the above condition in this manner, PLD fluctuation f(t) of the belt can be accurately determined in a shorter period of time using the same arithmetic processing as shown in the arithmetic block drawings of FIG. 8 and FIG. 9 explained for the previously described recognition method 1.

The following provides an explanation of processing for accurately determining PLD fluctuation f(t) of a belt in a short period of time using this recognition method 2.

An explanation is first provided for the case of Nb=1. The first roller 101 and the second roller 102 are installed at locations separated by the greatest distance on the belt transport path. The value of gf(t) shown in Eq. (8) is obtained from their respective rotation angular velocity $\omega_1$, $\omega_2$. Arithmetic processing for PLD fluctuation f(t) is then performed on this data by the same FIR filter processing (finite impulse response processing) of FIG. 8 or FIG. 9 explained in the recognition method 1. However, the number of required arithmetic processing steps is through the Nb step. In other words, since processing is carried out through the 1st step in the case Nb=1, processing is carried out until calculation of H(s) or $h_n$ to the 1st stage of the FIR filter of FIG. 8 or FIG. 9. The result of this processing becomes Eq. (10) as explained in recognition method 1. Here, if one revolution of the belt is taken to be 2π radians, then the positional relationship of the two rollers become π radians. In addition, since time τ indicates the belt transport time between the two rollers when the belt is transported at a certain prescribed velocity, 2τ becomes 2π radians when converted to a belt rotating angle. Since PLD fluctuation f(t) is a periodic function which repeats for each revolution of the belt, Eq. (10) can be transformed in the manner of Eq. (16) by redefining f(t−2τ) contained in the second term as f(t−2τ)=f(t).

$$h(t)=(1-G^2)f(t) \quad \text{Eq. (16)}$$

Thus, PLD fluctuation f(t) can be determined without error by dividing the 1st stage output data of the FIR filter by $(1-G^2)$. The amount of time required for performing this arithmetic processing is time τ since previous data by an amount of time τ is used. Accordingly, an accurate PLD fluctuation f(t) can be determined without recognition error in time τ with respect to the recognition method 1.

Similarly, in the case Nb=2, namely in the case the two rollers 101, 102 are arranged in a position relationship of ¼ total belt circumference as in the constitution shown in FIG. 7, the FIR filter performs processing through the 2nd step, in other words, performs processing through the second stage of calculating I(s) of the filter section in FIG. 8. the result of this processing is Eq. (12), and since 4τ becomes 2π radians when converted to a belt rotating angle, f(t−4τ)=f(t) and Eq. (12) can be transformed in the manner of Eq. (17).

$$h(t)=(1-G^4)f(t) \quad \text{Eq. (17)}$$

Thus, PLD fluctuation f(t) can be determined without error by dividing the output data of the 2nd stage of the FIR filter by $(1-G^4)$. The amount of time required for this arithmetic processing is time 3τ.

As has been described above, in recognition method 2, by adding the limitation that the layout of the two rollers is in a relationship such that the ratio between the belt transport interval (distance) between the rollers and the belt total transport interval (circumference) is 1:2 Nb (where, Nb is a natural number), PLD fluctuation f(t) is accurately determined without recognition error from the data following the Nb step of FIR filter processing of recognition method 1. In addition, PLD fluctuation f(t) can be derived in a shorter period of time than recognition method 1 since FIR filter processing is completed in the Nb step.

As has been described above, although the two rollers 101, 102 rotate with their respective rotation angular velocities $\omega_1$, $\omega_2$ being affected by PLD fluctuation f(t) and f(t−τ) having mutually different phases, since the effective radius R or effective PLD fluctuation coefficient κ of these rollers mutually differ, the proportions of the effective radius occupied by the PLD fluctuation component is respectively different. Consequently, the magnitude of fluctuations in rotation angular velocity mutually differ according to the detected PLD fluctuation. As a result of focusing on this point, the inventors of the present invention found that PLD fluctuation f(t) can be accurately derived independent of frequency characteristics by using the above-mentioned FIR filter and IIR filter as well as algorithm processing similar to these filters. Here, although the coefficient of f(t) was normalized to be 1 to derive PLD fluctuation f(t), in the case G is larger than 1, the coefficient of belt thickness fluctuation f(t−τ) may be normalized to be 1, and PLD fluctuation f(t−τ) may be derived using similar algorithm processing. At this time, the coefficient on the side of PLD fluctuation f(t) is the inverse of G. In other words, when t'=t−τ and τ'=Tb−τ (where, Tb is the amount of time for the belt to make one revolution), since the right side is represented as f(t')−(1/G)f(t'−τ') if the left side of Eq. (27) is multiplied by (−1/G), PLD fluctuation can be similarly detected using an FIR filter and IIR filter.

(Example of PLD Fluctuation Detection Apparatus)

In order to suitably correct a driving control value corresponding to PLD fluctuation using the above-mentioned PLD fluctuation f(t), it is necessary to determine the phase of PLD fluctuation on the belt 103 (phase when one revolution of the belt is defined as 2π). An example of a method for determining this phase comprises first pre-determining a home position mark on the belt 103 followed by detecting that mark and then determining the phase by using time measurement data obtained with a timer, drive motor rotating angle data, or rotating angle data from a rotary encoder output as in this example of a fluctuation detection apparatus.

Figure 12:
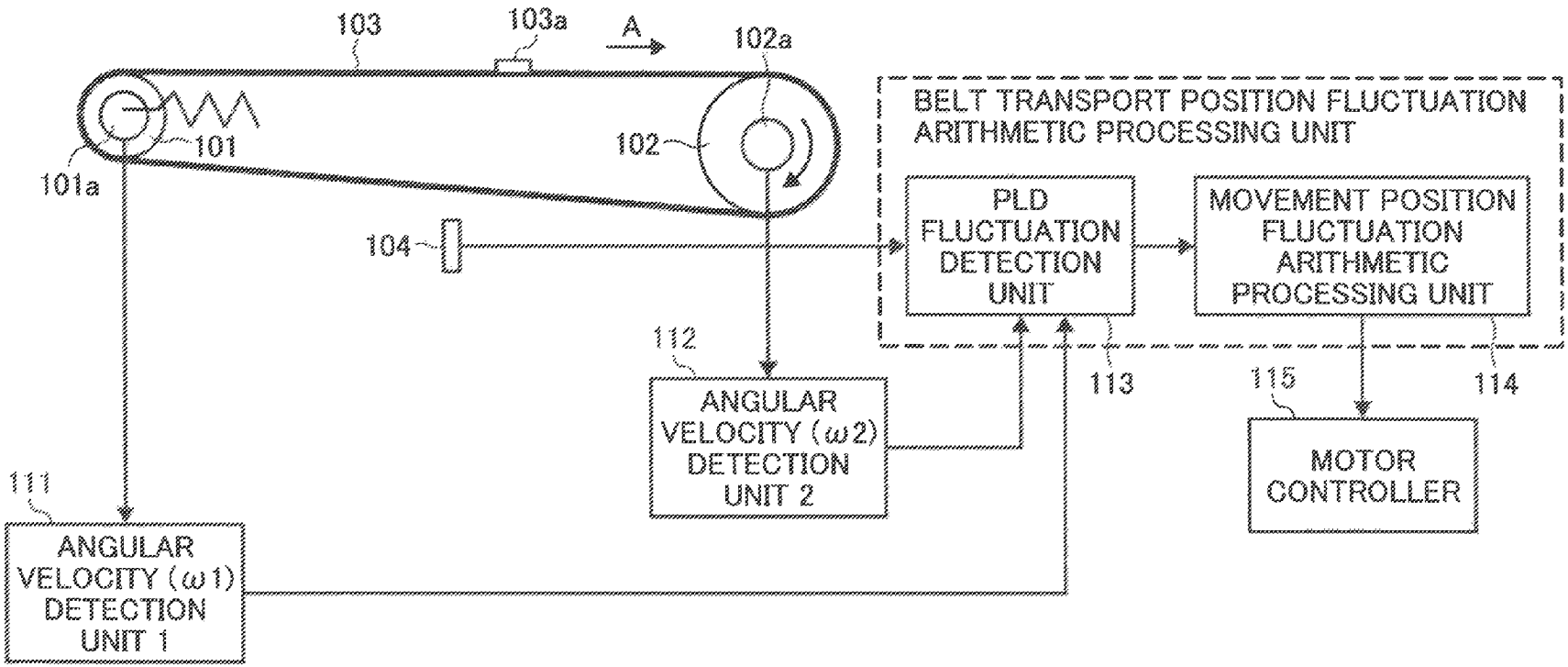
FIG. 12 is a drawing for explaining a control operation for detecting fluctuations in PLD of a belt.

Next, an explanation is provided of a control operation for detecting PLD fluctuation of a belt with reference to FIG. 12. FIG. 12 shows the constitution of an apparatus for detecting a home position mark on a belt 103. A home position mark 103*a* is provided on the belt 103, and by detecting this with mark detection means in the form of a mark detection sensor 104, the phase serving as a reference for one revolution of the belt is determined. In this example, a metal film affixed at a predetermined position on the belt 103 is used for the home position mark 103*a*, and a reflecting photosensor provided on a stationary member is used for the mark detection sensor 104. This mark detection sensor 104 outputs a pulse signal when the home position mark 103*a* passes a detection region. The position where the home position mark 103*a* is provided is at an edge in the direction of belt thickness on the inside or outside of the belt so as not to affect image formation. An image forming substance such as toner or ink may become adhered to the home position mark 103*a* or the sensor surface of the mark detection sensor 104. In this case, there is the risk of the home position of the belt 103 being recognized incorrectly. Accordingly, the mark detection sensor 104 is preferably provided with a function of accurately recognizing the belt home position while monitoring sensor output amplitude, pulse width and pulse interval to eliminate such recognition errors. Furthermore, although at least one home position mark 103*a* is required, a plurality may be provided in a pattern to facilitate elimination of recognition errors.

As shown in FIG. 12, rotary encoders are arranged on two driven rollers 101, 102 having mutually different diameters arranged at positions separated by the greatest distance on the belt path. In this case, PLD fluctuation f(t) can be accurately obtained using PLD fluctuation recognition method 2 as previously described.

In addition, the diameter ratio of the first roller 101 and the second roller 102 can be accurately determined by determining the average rotation angular velocity of the first roller 101 and the second roller 102. As a result, this diameter ratio can be corrected even if, for example, there are variations in the diameters of the first roller 101 and the second roller 102 that occurred during the course of production, the diameters thereof have changed due to environmental changes or the passage of time and so on, or the effective roller radii $R_1$, $R_2$ of each roller used when determining PLD fluctuation f(t) have shifted from their actual values.

Here, effective roller radius R indicates ($r+PLD_{ave}$) as previously described, and fluctuates due to variations in roller radius and the average $PLD_{ave}$ of the belt. In the above-mentioned Eq. (9), effective roller radius R is an important parameter, and improving the accuracy of this ratio leads to an increase in the detection accuracy of PLD fluctuation.

A first angular velocity detection unit 111 detects a rotation angular velocity $\omega_1$, of the first roller 101 from an output signal from a first rotary encoder 101*a*. Similarly, a second angular velocity detection unit 112 detects a rotation angular velocity $\omega_2$ of the second roller 102 from an output signal of a second rotary encoder 102*a*. First, belt 103 is driven. The belt 103 is driven so that, for example, the rotation angular velocity $\omega_1$ of the first roller 101 is constant. A PLD fluctuation detection unit 113 acquires data of PLD fluctuation f(t) from the rotation angular velocity $\omega_1$ (constant value) of the first roller 101 and the rotation angular velocity $\omega_2$ of the second roller 102 according to the previously described recognition method 1 or recognition method 2 based on a pulse signal from the mark detection sensor 104. An amount of fluctuation in belt transport position as predicted corresponding to the data of this PLD fluctuation f(t) is then calculated in a movement position fluctuation arithmetic processing unit 114, which in turn is output to a motor controller 115.

A belt drive apparatus may also be used for the purpose of reducing costs by eliminating the mechanism for detecting the home position.

Although basic processing is the same as in the previously described example of belt driving control, the home position of the belt 103 is determined using a virtual home position signal for virtually specifying the home position of the belt 103 instead of the pulse signal of the mark detection sensor 104. For example, the completion of one revolution by the belt 103 from an arbitrary position is predicted using a roller cumulative rotating angle obtained from the rotary encoders 101*a*, 102*a* and so on for the virtual home position signal. In this case, since the cumulative rotating angle when the rollers rotate during the time the belt 103 makes one revolution can be determined in advance, the belt 103 can be predicted to have made one revolution from that cumulative rotating angle. At this time, the time at which counting of the cumulative rotating angle begins becomes t=0 of PLD fluctuation f(t). This time corresponds to the time the pulse signal was received from the mark detection sensor in the above-mentioned example of the belt drive apparatus.

Furthermore, in this example of a belt drive apparatus, an error occurs in the prediction that the belt 103 makes one revolution with respect to the actual value due to such factors as the average value of PLD ($PLD_{ave}$) of the belt, component precision with respect to roller diameter and so on, environmental changes and changes over time in the components.

More specifically, the above-mentioned virtual home position signal is set so as to be generated for each rotation period of the belt 103. There are various possible methods for making this setting in addition to using the roller cumulative rotation angle as described above. For example, one possible method involves predicting that the belt 103 makes one revolution from an arbitrary position using a cumulative rotating angle of a drive motor 1106, and setting so that a virtual home position signal is generated when the cumulative rotating angle corresponding to one revolution of the belt has been reached. In addition, in another method, if the belt 103 is moved at a predetermined average movement velocity, the time required for the belt to make one revolution is predicted from that average movement velocity, and a virtual home position signal is set so as to be generated when the time corresponding to one revolution of the belt has been reached.

If there is error between one revolution of the belt as predicted from the virtual home position signal and an actual revolution of the belt, the phase of PLD fluctuation f(t) shifts cumulatively. Consequently, if the timing of transfer or printing is corrected according to the PLD fluctuation f(t) data, a considerable discrepancy occurs in the transfer or printing position. Causes of error between the virtual home position signal and an actual revolution of the belt include production error in belt circumference, environmental or time-based changes (stretching or contraction) in belt circumference, production error in average belt thickness, environmental or time-based changes in average belt thickness, production error in the controlling roller diameter, and environmental or time-based changes in controlling roller diameter.

Thus, the error (time difference) between the virtual home position obtained from a virtual home position signal and the actual home position is determined from production error and environmental or time-based changes in the presumed belt and rollers. It is also necessary to periodically update or correct PLD fluctuation data.

Next, an explanation is provided of the operation when updating previously determined PLD fluctuation f(t). Depending on the belt material, belt thickness may change due to wear caused by environmental changes (temperature and humidity) and use over time, or the Young's modulus may change due to repeated bending and stretching, resulting in changes in the PLD of the belt 103 over time. Thus, the PLD fluctuation of the belt 103 may change. In addition, there are also cases in which PLD fluctuation changes from the PLD fluctuation prior to belt replacement as a result of replacing the belt 103. In addition, in the case of using a virtual home position as described in the example of a belt drive apparatus, the home position may shift from the actual home position. In such cases, it is necessary to update PLD fluctuation f(t).

The methods for updating PLD fluctuation f(t) can broadly be divided into two methods consisting of intermittent updating and continuous updating. An example of the former method involves periodically updating PLD fluctuation f(t). An example of the latter method involves continuously updating PLD fluctuation f(t) by constantly determining PLD fluctuation f(t).

(Example of Detecting PLD Fluctuation)

Next, an explanation is provided of a specific example of detecting and updating PLD fluctuation f(t) (to be referred to as a "PLD fluctuation detection example") Furthermore, this PLD fluctuation detection example is used to explain the operation of the PLD fluctuation detection unit 113 of FIG. 12, and uses the data processing described in the above-mentioned recognition method. A constitution may also be employed in which there is no mechanism for detecting the home position of the belt 103.

Figure 13:
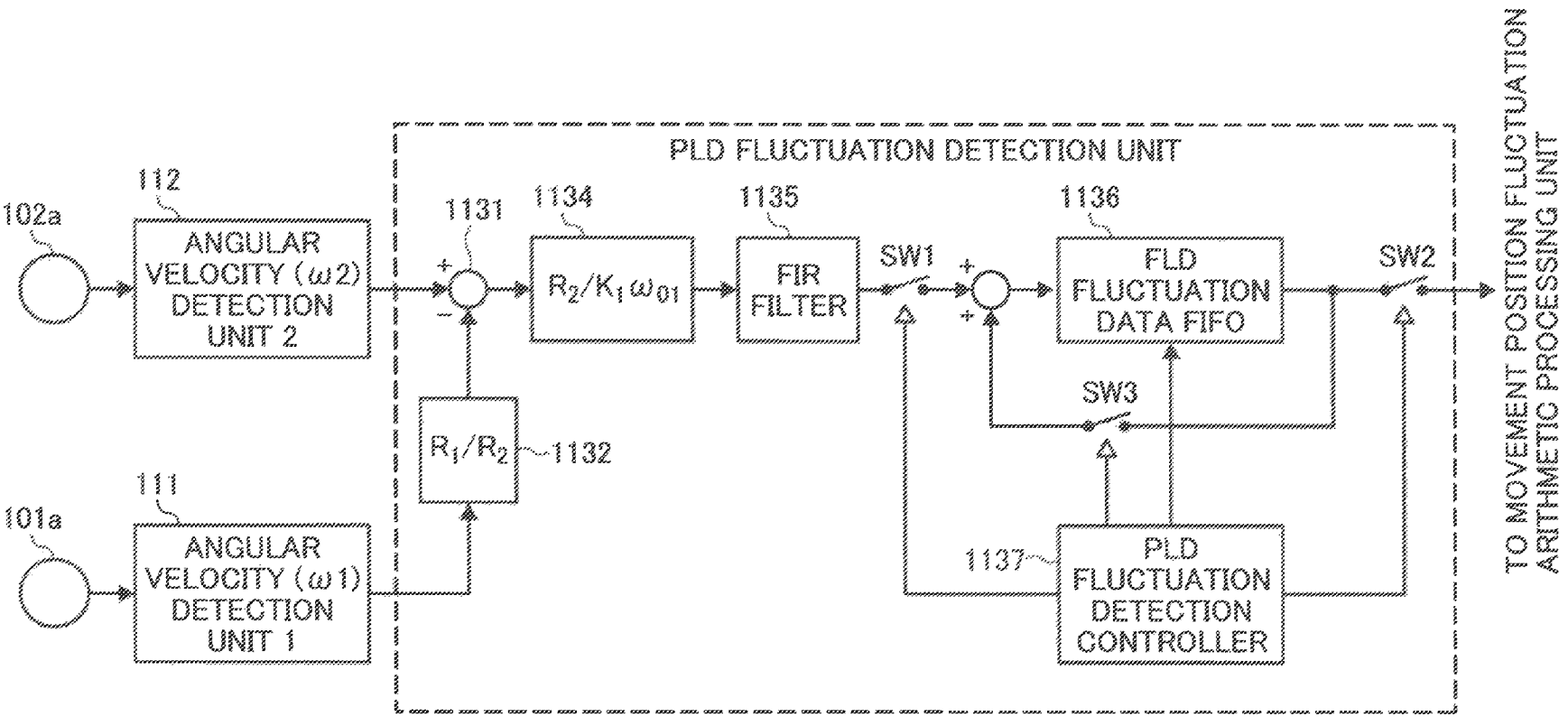
FIG. 13 is a drawing for explaining detection and updating processing in an example of detecting fluctuations in PLD.

The following provides an explanation of detection and updating processing in this PLD fluctuation detection example with reference to FIG. 13. Furthermore, the PLD fluctuation detection unit shown encircled with a broken line in the drawing indicates the fluctuation detection unit 113 of FIG. 12. The PLD fluctuation detection unit is composed of a digital circuit, DSP, μCPU, RAM, ROM, FIFO (First-In First-Out) and other components used for digital signal processing. There are naturally no limitations on the specific hardware configuration. Processing is performed according to arithmetic operations using firmware by the control block shown in the drawing.

In this PLD fluctuation detection example, in the case there is no mechanism for detecting the home position of the belt 103, a phase error occur resulting from a shift in the virtual home position as previously described. In addition, there is also the risk of the actual PLD fluctuation of the belt 103 changing due to environmental changes and changes over time. Consequently, it is necessary to update previously determined PLD fluctuation f(t). In this PLD fluctuation detection example, whether updating is to be performed intermittently or continuously can be determined arbitrarily according to the load and other factors of the CPU or other arithmetic processing unit. In the case of intermittent updating, updating processing may be performed periodically corresponding to operating time, operating capacity and so on of a main unit.

The following provides a detailed explanation of an example of detecting PLD fluctuation from the rotation angular velocities of the first roller 101 and the second roller 102 of FIG. 12. First, a controller 1137 turns switches SW1, SW2, SW3 off. Next, a belt drive apparatus drives the belt targeting reference signal data $\omega_{01}(=V_0/R_1)$ of rotation angular velocity. The rotation angular velocity $\omega_1$ of the first roller 101 determined by the angular velocity detection unit 111 and the rotation angular velocity $\omega_2$ of the second roller 102 determined by the angular velocity detection unit 112 become as shown in the following Eq. (18) from the previously indicated Eq. (6). The "G" in this Eq. (19) is the same as that indicated in Eq. (9). In addition, since the present embodiment is premised on digital processing, tn represented in a dispersed manner is used instead of time t. Thus, the previously described PLD fluctuation f(t) is changed to f(tn).

$$\omega_2 = \frac{R_1}{R_2}\omega_1 + \frac{\kappa_1}{R_2}\omega_{01}\{f(tn) - Gf(tn-\tau)\} \quad \text{Eq. (18)}$$

PLD fluctuation f(tn) is determined from this rotation data, and processing is performed in which the PLD fluctuation data for one revolution of the belt is housed in fluctuation data storage means in the form of FIFO 1136. In this processing, data $(R_1 \cdot \omega_1)/R_2$ determined in block 1132 for the simultaneously detected rotation angular velocity $\omega_1$ of the first roller 101 is subtracted by a subtractor 1131 from the detected rotation angular velocity $\omega_2$ of the second roller 102 with switches SW1, SW2 and SW3 off. Incidentally, although this data $(R_1 \cdot \omega_1/R_2$ is the same as fixed data $(R_1 \cdot \omega_{01})/R_2$ as a result of feedback control, in order to obtain more accurate PLD fluctuation calculation data, the simultaneously detected rotation angular velocity $\omega_1$ of the first roller 101 is used. The value output from this subtractor 1131 is multiplied by fixed data $R_2/(\kappa_1 \cdot \omega_{01})$ in block 1134, and that output data is input to the FIR filter of block 1135. In other words, the output data of block 1134 is in the form of $f(tn)-Gf(tn-\tau)$, and this data is input to the FIR filter. As explained for PLD recognition method 2, this FIR filter is responsible for processing through the 1st stage indicated by the broken line in FIG. 3, subtracting $(1-G^2)$ and outputting that result. The output data becomes the fn of each data (PLD fluctuation data) which composes the data string of PLD fluctuation f(tn). The controller 1137 switches SW1 on after the amount of time for output of accurate PLD fluctuation data fn from the FIR filter has elapsed. This is done to prevent accurate PLD fluctuation data fn from being output during initial filter operation since delay elements are contained in the FIR filter. Once the controller 1137 has counted the number of pulses of the encoder output of the first roller 101, or has confirmed from the average belt revolution time roughly determined from part specifications that the belt 103 has moved by one revolution (confirmation of belt home position), it switches SW1 off. PLD fluctuation data fn output from the FIR filter is accumulated in the PLD fluctuation data FIFO 1136 having a capable enabling storage of exactly the amount of PLD fluctuation data fn for one revolution of the belt. In this PLD fluctuation detection example, PLD fluctuation data fn is stored by switching SW1 on in the case there is no data in this FIFO 1136.

Next, as a result of switching switches SW2 and SW3 on after having switched switch SW1 off, the PLD fluctuation data fn accumulated in the FIFO 1136 is output to a transfer position shift calculation unit. Since the FIFO 1136 has the capacity of one revolution of the belt, PLD fluctuation data is output synchronous with one revolution of the belt. In other words, a signal input prior to one revolution of the belt is output. Here, since switch SW3 is on, the output data is again stored in the FIFO 1136. As a result, PLD fluctuation data is output synchronous with each revolution of the belt.

In addition, synchronous additive processing is performed as a result of switching both switches SW1, SW3 on. In other words, in the state in which PLD fluctuation data has been previously stored, PLD fluctuation data stored in the FIFO 1136 prior to one revolution and PLD fluctuation currently calculated by the FIR filter 1135 are added and stored in the FIFO 1136. As a result of this synchronous addition, the fluctuating component of the belt rotation period is emphasized relative to a random fluctuating component of the belt rotation period (noise component), thereby resulting in an improved S/N ratio. As a result of subtracting the number of synchronous additions from the data following synchronous addition in the transfer position shift calculation unit, average synchronous addition data is obtained, thereby enabling accurate detection of PLD fluctuation. As a result, random detection error attributable to gear backlash or noise and so on can be reduced.

In this manner, PLD fluctuation data fn is accumulated in the FIFO 1136 corresponding to the rotation of the belt 103. If the amount of fluctuation in belt transport position is predicted using this PLD fluctuation data fn, and a motor driving control value is corrected in accordance therewith, the belt is driven corresponding to PLD fluctuation f(tn).

Next, an explanation is provided of the case of continuous updating. In this case, PLD fluctuation data is constantly updated. In other words, both switches SW1, SW2 are on in FIG. 13.

More specifically, in the case of the FIFO 1136 not containing PLD fluctuation data, the controller 1137 first switches switch SW1 off and the belt 103 is driven at the target rotation angular velocity $\omega_{01}$ of the first roller 101. Once the output from the FIR filter 1135 has stabilized, switch SW1 is switched on, and PLD fluctuation data fn accumulates in the FIFO 1136 for one revolution of the belt. Subsequently, when both switches SW1, SW2 are switched on, the output data of the FIR filter 1135 is input to the FIFO 1136 resulting in new PLD fluctuation data fn.

Furthermore, in this PLD fluctuation detection example, although stored input data of PLD fluctuation data fn is realized using the FIFO 1136 which shifts according to a clock signal, it may also be realized with an address-controlled memory function.

Furthermore, in this PLD fluctuation detection example, a low pass filter may be inserted to remove fluctuations in the rotation periods of the first roller 101 and the second roller 102 as well as other periodic fluctuations, as well as high-frequency fluctuations containing noise, based on fluctuations in rotation angular velocities detected with the angular velocity detection unit. As a result, PLD fluctuation can be detected with higher accuracy and stability. This low pass filter may be provided before the FIR filter or after the angular velocity detection unit.

(Derivation from PLD Fluctuation to Belt Movement Position Fluctuation)

The movement position fluctuation arithmetic processing unit 114 calculates the amount of fluctuation in the belt movement position based on PLD fluctuation data fn output from the PLD fluctuation detection unit 113. Here, the relationship between roller micro-rotating angled θ and belt micro-transport amount Δd is shown in Eq. (19).

$$\Delta d=\{R+\kappa f(d)\}d\theta \qquad \text{Eq. (19)}$$

The relationship between roller rotating angle θ and belt transport amount D after integrating both sides by θ becomes as shown in Eq. (20).

$$D = R\theta + \kappa\int_0^{\theta} f(d)d\theta \qquad \text{Eq. (20)}$$

The second term on the right side of Eq. (20) is the fluctuation in the belt movement position attributable to fluctuation in the belt PLD. Accordingly, the amount of fluctuation in belt movement position can be calculated by integrating PLD fluctuation data fn. The movement position fluctuation arithmetic processing unit 114 calculates the amount of fluctuation in belt movement position from the integrated value of the integral of PLD fluctuation data fn and κ.

(Case of Detecting Rotating Angle)

Although the previous explanation related to a method for calculating PLD fluctuation data by detecting the rotation angular velocities ω of a first roller and a second roller, PLD fluctuation data and the amount of fluctuation in belt movement position attributable thereto can be calculated using similar arithmetic processing by detecting the rotating angles ω of the first roller 101 and the second roller 102 (the angular velocity detection unit in FIG. 12 and FIG. 13 is taken to be a rotating angle (θ) detection unit).

The above-mentioned Eq. (20) is similarly valid for the first roller 101 and the second roller 102. The relationship between the first roller rotating angle $\theta_1$ and the second roller rotating angle $\theta_2$ when the amount of belt transport D is equal is shown in the following Eq. (21). However, based on the relationship between roller rotating angle θ and belt movement distance x and the result of integrating after substituting dθ=dx/R for θR=x as in the following Eq. (22), the integral for belt movement distance x over the roller circumference of belt PLD fluctuation (to be referred to as cumulative PLD fluctuation) becomes Fd(d). In addition, τ' is the transport distance between the two rollers.

$$\theta_2 \cong \frac{R_1}{R_2}\theta_1 + \frac{1}{R_2}\left\{\frac{\kappa_1}{R_1}Fd(d) - \frac{\kappa_2}{R_2}Fd(d-\tau)\right\} \quad \text{Eq. (21)}$$

$$\int_0^{\theta} f(d)d\theta = \frac{1}{R}\int_0^{\theta R} f(x)dx = \frac{1}{R}Fd(x) \quad \text{Eq. (22)}$$

Since Eq. (21) has the same form as the previously indicated Eq. (6), accumulated PLD fluctuation Fd(d) can be obtained from the rotating angle data of the two rollers according to the previously described PLD fluctuation recognition method 1 and PLD Fluctuation recognition Method 2. In addition, cumulative PLD fluctuation Fd(d) can be converted to the amount of fluctuation ΔDd of belt movement position D (second term of Eq. (20)) from the above-mentioned Eq. (22) and Eq. (20). In addition, in the case of reflecting in the target rotating angle $\omega_{ref}$ of the motor controller, ΔDd/Rd(where Rd is the radius of the drive roller) can be calculated and then cancelled out.

[Correction Technique for Belt Movement Position Fluctuation Using Drive Roller Eccentricity or Encoder Disk Mounting Eccentricity]

Next, an explanation is provided of an example of a technique for correcting fluctuations in belt movement position based on drive roller eccentricity or encoder disk mounting eccentricity.

If there is eccentricity in the drive roller or mounting eccentricity in the encoder disk installed on the roller shaft, the movement position of the belt cannot be accurately controlled. Therefore, in the present embodiment, fluctuations in belt movement velocity (movement position fluctuations) occurring due to roller eccentricity or encoder disk mounting eccentricity are recognized. The motor controller is able to accurately control belt driving regardless of drive roller shaft accuracy or encoder disk mounting accuracy by feedback control of the motor based on the amount of the velocity fluctuation (movement fluctuation) thereof.

The following provides an explanation of the relationship between belt transport velocity V and roller rotation angular velocity ω when there is eccentricity present in the roller.

Figure 14A:
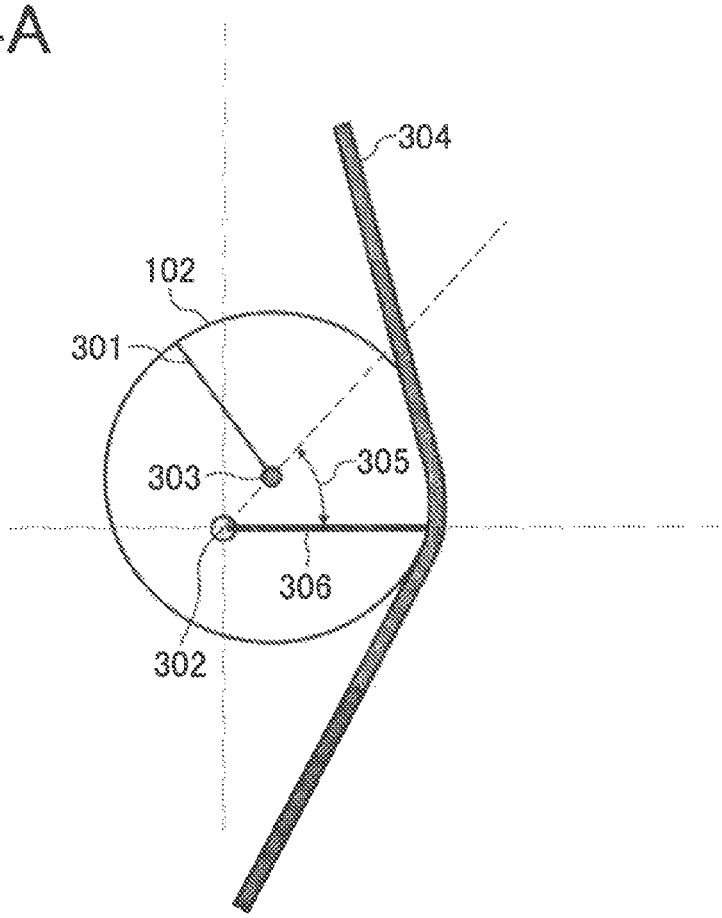

FIG. 14A shows a model of a belt wound around a second roller 102 (drive roller) having eccentricity.

As shown in FIG. 14A, a belt 304 is wound around the second roller 102 having a radius $R_2$. The center of rotation 302 and the circular cross-sectional center 303 of the second roller 102 are separated by an amount of eccentricity $\epsilon_2$ (straight line distance between the center of rotation 302 and the circular cross-sectional center 303). A straight line 306 in the drawing is a line connecting the center of rotation 302 of the roller and the center of the region where the belt contacts the roller. Assuming that the belt movement velocity is determined by the length of the straight line 306, and the length of the straight line 306 is taken to be the belt movement velocity determining distance $R_\epsilon$, then $R_\epsilon$ can be represented as shown in the following Eq. (23).

$$R_\epsilon \cong R + \epsilon \cos\theta \quad \text{Eq. (23)}$$

The following Eq. (24) can be derived from the previously indicated Eq. (1) if the belt movement velocity V describes the relationship between the rotation angular velocity $\omega_2$ of the second roller 102 having a radius $R_2$ and the belt movement velocity V after omitting the effect of belt thickness.

$$V = \{R_2 + \epsilon_2 \cos(\theta_2 + \alpha_2)\}\omega_2 \quad \text{Eq. (24)}$$

Here, $\theta_2+\alpha_2$ represents the rotating angle of the second roller 102, and $\alpha_2$ is the phase(angle) in the eccentric direction when $\theta_2$=0(time t=0).

Since the belt movement velocity V becomes a constant belt movement velocity $V_0$ from Eq. (24) above, the rotation angular velocity $\omega_{2ref}$ of the second roller 102 becomes as shown in the following Eq. (25).

$$\omega_{2ref} = \frac{V_0}{R_2 + \varepsilon_2\cos(\theta_2 + \alpha_2)} \cong \frac{V_0}{R_2} - \frac{\varepsilon_2 V_0}{R_2^2}\cos(\theta_2 + \alpha_2) \quad \text{Eq. (25)}$$

The second term of Eq. (25) can be seen to be the rotation velocity fluctuation component caused by eccentricity of the second roller 102. In other words, it can be seen that in order to rotate the belt at a constant velocity $V_0$, it is necessary for the rotation angular velocity $\omega_{2ref}$ of the second roller 102 to fluctuate corresponding to the eccentricity. In other words, in the case of desiring to make velocity constant by suppressing fluctuations in belt movement velocity, if the rotation angular velocity $\omega_2$ of the second roller 102 is controlled to be the reference rotation angular velocity $\omega_{2ref}$ of the second supporting roller, the fluctuation component of belt movement velocity is suppressed, and belt movement velocity V becomes a constant velocity $V_0$.

Accordingly, if the rotation velocity fluctuation component of the second roller 102 of the following Eq. (26) obtained by transforming Eq. (25) were able to be detected, then it would be possible to control the belt movement velocity to a constant velocity by feeding back the rotation angular velocity of the second roller 102.

$$Comp = \frac{\varepsilon_2 V_0}{R_2^2}\cos(\theta_2 + \alpha_2) \quad \text{Eq. (26)}$$

Here, the fluctuation component of the rotation velocity of the second roller 102 shown in Eq. (26) can be derived by detecting the rotation angular velocity of the first roller 101 and the second roller 102. For the sake of simplification, an explanation is provided of the case of controlling the rotation angular velocity $\omega_1$ of the first roller 101 having radius $R_1$ to a constant rotation angular velocity $\omega_{01}$. The rotation angular velocity $\omega_{2V}$ of the second roller 102 becomes as shown in the following Eq. (27) from the previously indicated Eq. (24) when the rotating angle of the first roller 101 is defined to be $\theta_1+\alpha_1$ {provided that the phase (angle) in the eccentric direction is $\alpha_1$ when $\theta_1$=0 (time t=0)}, and the eccentricity of the first roller 101 is defined to be $\epsilon_1$.

$$\omega_{2V} = \frac{R_1 + \varepsilon_1\cos(\theta_1 + \alpha_1)}{R_2 + \varepsilon_2\cos(\theta_2 + \alpha_2)}\omega_{01} \cong \frac{R_1}{R_2}\omega_{01}\left\{1 + \frac{\varepsilon_1}{R_1}\cos(\theta_1 + \alpha_1) - \frac{\varepsilon_2}{R_2}\cos(\theta_2 + \alpha_2)\right\} \quad \text{Eq. (27)}$$

According to Eq. (27), the rotation angular velocity $\omega_{2V}$ of the second roller 102 when the first roller 101 is rotated by a constant rotation angular velocity $\omega_{01}$ can be seen to contain fluctuation in rotation velocity caused by eccentricity of the first roller 101 (second term in brackets { } of the previously indicated Eq. (8)) and fluctuation in rotation velocity caused by eccentricity of the second roller 102 (second term in brackets { } of Eq. (8)).

In the case of desiring to detect either fluctuation in rotation velocity, since the rotation periods of the first roller 101 and the second roller 101 differ, namely the roller diameters differ, in the present embodiment, it is possible to separately detect each rotation velocity. Accordingly, if fluctuation in rotation velocity caused by eccentricity of the second roller 102 can be detected, it can be seen from Eq. (27) that feedback control is possible in which the rotation angular velocity of the second roller 102 is fed back to control the belt movement velocity V to a constant velocity $V_0$.

Here, an explanation is provided of the relationship between belt transport velocity V and a rotation angular velocity $\omega_s$ detected with detection means when there is mounting eccentricity in detection means attached to the second roller 102.

Figure 14B:
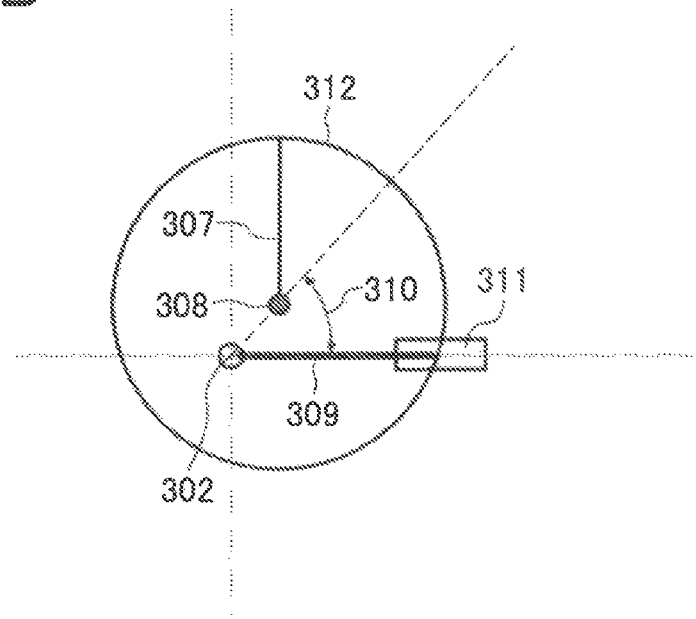
FIG. 14B is a drawing showing a model of the occurrence of mounting error in an encoder disk with respect to an axis of rotation and eccentric rotation by the encoder disk.

FIG. 14B shows a model of rotation in which mounting error occurs in an encoder disk with respect to an axis of rotation and eccentricity is present in the encoder disk.

In the drawing, reference symbol 312 indicates a center line of a timing mark 313 formed with marks at a fixed interval on the encoder disk. The rotation angular velocity of the second roller 102 is detected at the timing at which the timing mark on this center line passes a sensor 311. Center of rotation 308 of the encoder disk and center of rotation 302 of the roller are separated by an amount of eccentricity $\epsilon_s$. The velocity $V_s$ at which the timing mark of the encoder disk passes a sensor slit at this time is approximated in the manner described below. However, $\omega_2$ is the rotation angular velocity of the rotating shaft, and here, is the rotation angular velocity of the second roller 102. $\epsilon_s$ is the amount of eccentricity of the encoder disk, and $\alpha_s$ is the phase (angle) in the eccentric direction when $\theta_s=0$(time t=0).

$$V_s=\{R_s+\epsilon_s\cos(\theta_s+\alpha_s)\}\omega_2 \quad \text{Eq. (28)}$$

Here, when considering that the rotation angular velocity $\omega_s$ of the second roller 102 detected by the encoder is such that $\omega_s=V_s/R_s$, the relationship between belt movement velocity V and the rotation angular velocity $\omega_s$ detected by the encoder becomes as shown below by substituting Eq. (28) into Eq. (24).

$$V \cong \left\{R_2+\varepsilon_2\cos(\theta_2+\alpha_2)-\frac{R_2}{R_S}\varepsilon_S\cos(\theta_S+\alpha_S)\right\}\omega_S \quad \text{Eq. (29)}$$

In this manner, in the case of mounting eccentricity in the encoder disk, the fluctuation component of rotation velocity having the amount of mounting eccentricity of the encoder disk as the amplitude thereof can be seen to be detected as superimposing the fluctuation component of rotation velocity having the amount of roller eccentricity as the amplitude thereof in the relationship between the belt movement velocity and the rotation angular velocity of the second roller 102 detected by detection means.

Since the rotation velocity fluctuation component of roller eccentricity (the second term in brackets { } of Eq. (29)) and the rotation velocity fluctuation component of encoder disk mounting eccentricity (third term in brackets { } of Eq. (29)) are fixed to the same rotating shaft 302, their periods are the same. Therefore, the two rotation velocity fluctuation components can be combined into a single component, and that result is shown in Eq. (30). Furthermore, the process for subtracting the cosine is omitted.

$$V\cong\{R_2+\epsilon_{2s}\cos(\theta_{2s}+\alpha_{2s})\}\omega_s \quad \text{Eq. (30)}$$

Here, $\epsilon_{2s}$ and $\alpha_{2s}$ are calculated by combining the two cosine functions of Eq. (29). Although $\theta_{2s}$ indicates the rotating angle from a newly set reference shaft, in the case the wound portion of the belt and the sensor slit lie in the same plane, $\theta_2=\theta_s=\theta_{2s}$. In addition, in the case the wound portion of the belt and the sensor slit are at different locations, then calculations may be made using $\theta_2=\theta_{s+\beta}=\theta_{2s}$. Thus, even there is encoder mounting eccentricity in addition to roller eccentricity, if the fluctuation in rotation velocity attributable to the eccentricity of the second roller 102 and the mounting eccentricity of the detection means can be detected in the same manner as the explanation from Eq. (24) to Eq. (27) by considering the mounting eccentricity to be a single rotation velocity fluctuation combined with roller eccentricity, then feedback control is possible by feeding back the rotation angular velocity of the second roller 102 to control the belt movement velocity V to a constant velocity $V_0$.

(Detection Mechanism for Fluctuations in Belt Movement Velocity)

One means of recognizing fluctuations in rotation velocity (fluctuations in rotating angle) attributable to eccentricity of the second roller 102 or mounting eccentricity of detection means comprises installing rotation detection means on a supporting roller (first roller 101) having a different diameter than the second roller 102. The fluctuation component generated during the rotation period of the second roller 102 is recognized from rotation data of the two rollers obtained from each rotation detection means of the rollers 101, 102. Since the fluctuation component generated during the rotation period of the second roller 102 is the result of eccentricity of the second roller 102 and mounting eccentricity of the detection means, a motor driving control value of a motor controller is corrected so that this fluctuation component does not occur as a fluctuation in belt movement position.

The present embodiment has the characteristics indicated below in particular.

First, a low-resolution, simple encoder is used for the detection means installed on an uncorrected periodic rotation roller (first roller 101). Since this simple encoder has fewer output pulses per revolution than the high-precision rotary encoder installed on a corrected periodic rotation roller (second roller 102), costs can be reduced.

Next, a fluctuation component generated during the rotation period of the second roller 102 is recognized based on the rotation data of two rollers during an integer number of rotations of the first roller. This can be recognized accurately without being affected by the fluctuation component of the rotation period of the first roller 101.

Moreover, the diameters of the two rollers are in a relationship which satisfies the following Eq. (31). The rotating angle of the second roller during an integer number of rotations of the first roller is Ni$\pi$ [rad] (where, Ni is a natural number). This enables fluctuations in the rotation period of the second roller 102 to be recognized with the optimum sensitivity from the rotation data of the two rollers.

The detected rotation data of the two rollers comprises rotation velocity data, obtained by measuring the amount of time required for each roller 101, 102 to rotate by a predetermined rotating angle, and rotating angle data, obtained by measuring the rotating angle of the second roller 102 when the first roller 101 rotates by a predetermined rotating angle. The following provides an explanation of a method for recognizing the rotation period fluctuation component of the second roller 102 from the rotation velocity data, and a method for recognizing the rotation period fluctuation component of the second roller 102 from the rotating angle data.

(Recognition Method 1 Using Rotation Velocity Data)

Figure 15:
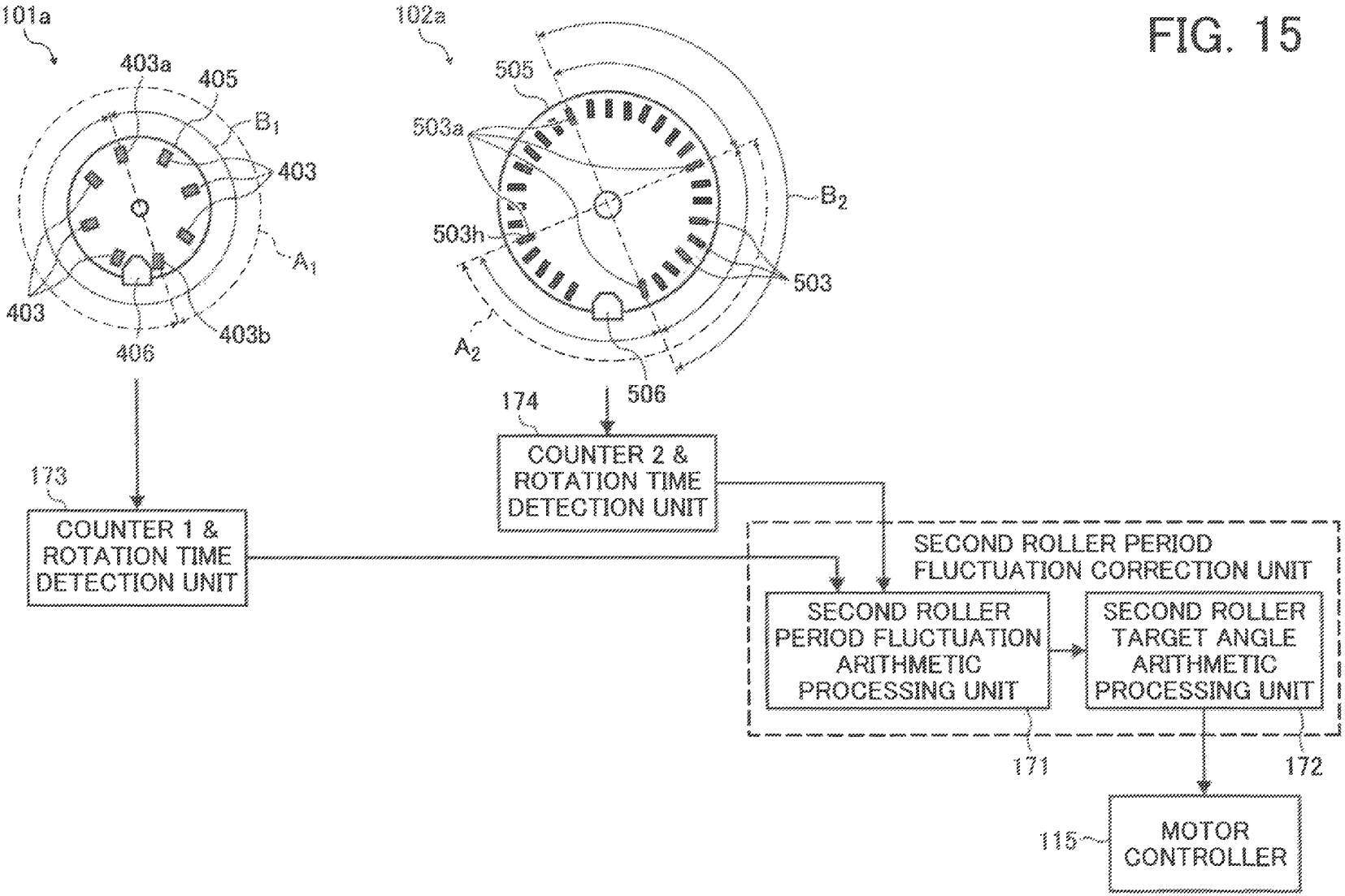
FIG. 15 is a block drawing showing the constitution of a control system for calculating motor control correction data for explaining the recognition method 1 using rotation velocity data.

FIG. 15 is a block drawing showing the constitution of a control system for recognizing a fluctuation in rotation velocity of the second roller 102, resulting from combining fluctuations attributable to roller eccentricity and encoder mounting eccentricity as previously described, and calculating correction data for motor control.

This control block is represented with a counter 2 and a rotation time detection unit 174 for the second roller 102, a counter 1 and a rotation time detection unit 173 for the first roller 101, a second roller target angle arithmetic processing unit 172, a second roller period fluctuation arithmetic processing unit 171, and a motor controller 115. The counter 1 and rotation time detection unit 173 measure the interval between passage times of specific slits 403*a*, 403*b* from a pulse signal of first detection means 101*a*, and output the result in the form of first roller 101 rotation data. In addition, the counter 2 and rotation time detection unit 174 measure the interval between passage times of a desired slit 503 from a pulse signal of second detection means 102*a*, and output that result in the form of second roller 102 rotation data. The second roller period fluctuation arithmetic processing unit 171 calculates amplitude A and phase $\alpha$ of the rotation velocity fluctuation of the second roller 102 based on the received first roller 101 rotation data and second roller 102 rotation data. The calculated amplitude A and phase $\alpha$ of the second roller 102 rotation period fluctuation are then transmitted to the second roller target angle arithmetic processing unit 172.

The second roller target angle arithmetic processing unit 172 stores the amplitude A and phase a of the rotation period fluctuation of the second roller 102 in a memory unit. The target rotating angle data of the second roller 102 is then output to the motor controller 115 based on the amplitude A, phase $\alpha$ and belt target movement velocity $V_0$ corresponding to the belt target movement velocity $V_0$ of the second roller 102.

The first detection means 101*a* is composed of an encoder disk 405 provided with a plurality of detection targets in the form of slits 403, and a detection unit in the form of a detector 406. The second detection means 102*a* is composed of an encoder disk 505, provided with a plurality of detection targets in the form of slits 503 at equal intervals on the circumference thereof, and a detection unit in the form of a detector 506. The number of slits of the first detection means 101*a* is sufficient for recognizing the belt PLD fluctuation described above at a desired resolution. Eight slits are provided around the circumference of the first detection means 101*a* in the present embodiment. In addition, the number of slits of the second detection means 102*a* is set in consideration of detection resolution so as to allow the obtaining of adequate control performance during feedback control of the conveyor belt 2. In the present embodiment, the number of slits is set to 512, which a multiple of 4, in order to set the detection interval of a rotating angle $\pi$ to be described later. In addition, it is essential that the diameters the first roller 101 and the diameter of the second roller 102 shown in the drawing be different. Moreover, in a constitution which satisfies the following Eq. (31) when the effective radii of the rollers in consideration of the average belt PLD are defined as $R_1$ and $R_2$, the detection interval of rotating angle $\pi$ to be described later can be set, thereby enabling more accurate detection.

$$mR_1 = \left(n + \frac{1}{2}\right)R_2 \qquad \text{Eq. (31)}$$

(where, m is a natural number and n is an integer)

The detectors 406, 506 are composed with a light-emitting device and a light-receiving device, and the light-emitting device and the light-receiving device are provided so as to be in opposition to each other about the encoder disks 405, 505. When slits 403, 503 pass a detector, the light of the light-emitting device is detected by the light-receiving device. When the light-receiving device detects light from the light-emitting device, a current is generated, and this is transmitted in the form of a pulse signal to the counter 1 and rotation time detection unit 173 and to the counter 2 and rotation time detection unit 174.

In the present embodiment, rotation data of the second roller 102 is detected by measuring the time from detection of a slit 503 by the detector 506 to detection of a specific slit. The detection interval set for detecting rotation data (interval between the slit and the specific slit) is preferably an integer multiple of the rotation period of the first roller 101. By setting in this manner, effects attributable to fluctuations in the rotation velocity of the first roller 101 can be virtually ignored. Fluctuations in the rotation velocity of the first roller 101 are caused by eccentricity of the first roller 101, and are based on one revolution of the first roller 101 being one period. Rotation velocity fluctuation caused by eccentricity of the first roller 101 has an effect on the detection of rotation velocity fluctuation of the second roller 102. However, since the rotation velocity fluctuation caused by eccentricity of the first roller 101 is composed of a component which fluctuates positively in a single period of the first roller 101 and a component which fluctuates negatively, and these components are equal, the error in the measurement time during a single period of the first roller 101 is eliminated. As a result, by making the detection interval an integer multiple of the rotation period of the first roller 101, fluctuations in the rotation period of the second roller 102 can be obtained without being affected by rotation velocity fluctuation of the first roller 101.

Moreover, by making the detection interval as $\pi$ and the phase difference between detection intervals ($\pi/2$), the sensitivity of the detection of the rotation velocity fluctuation of the second roller 102 can be maximally increased. For example, in the case a fluctuation in rotation velocity attributable to eccentricity of the second roller 102 and mounting eccentricity of the second detection means 102*a* is a cosine wave having an initial phase of 0, the interval from 0 to $\pi$ is the region in which angular velocity fluctuates positively with respect to the average angular velocity, and the interval in this region has the shortest measurement time. On the other hand, the interval from $\pi$ to $2\pi$ is the region in which angular velocity fluctuates negatively with respect to the average angular velocity, and the interval in this region has the longest measurement time. In this manner, if the detection interval is made to be $\pi$, a region in which angular velocity fluctuates positively with respect to average angular velocity and a region in which angular velocity fluctuates negatively with respect to average angular velocity can be detected for all fluctuation components, thereby making it possible to maximally increase the sensitivity at which rotation velocity fluctuation of the second roller 102 is detected.

However, in the case the rotation velocity fluctuation of the second roller 102 is a sine wave of phase 0 (cosine wave of phase ($\pi/2$)) even if the detection interval is set to $\pi$, for the interval from 0 to $\pi$, a region in which angular velocity fluctuates positively with respect to average angular velocity and a region in which angular velocity fluctuates negatively with respect to average angular velocity appear symmetrically bordering on ($\pi/2$). As a result, the components of the rotation velocity fluctuation of the second roller 102 are offset, and the interval from 0 to $\pi$ is the measurement time in the same manner as the case of having moved at the average angular velocity. In addition, for the interval from $\pi$ to $2\pi$ as well, the components of rotation velocity fluctuation are similarly offset, and the measurement time is the same as in the case of having moved at the average angular velocity, thereby preventing the rotation velocity fluctuation of the second roller 102 from being detected. Therefore, one detection interval is made to be from 0 to π, another detection interval is made to be from (π/2) to (3π/2), and the phase difference between detection intervals is made to be (π/2). As a result, the detection interval becomes a region in which angular velocity fluctuates negatively with respect to the average angular velocity from (π/2) to (3π/2) even in the case of a sine wave, and the measurement time is the longest. In this manner, by making the phase difference between the detection intervals to be (π/2), the detection sensitivity of rotation velocity fluctuation of the second roller 102 can be increased for any one of the detection intervals. In the case the rotation velocity fluctuation of the second roller 102 approaches a sine wave, the detection interval from (π/2) to (3π/2) results in higher detection sensitivity than the detection interval from 0 to π. On the other hand, in the case the rotation velocity fluctuation of detection error approaches a cosine wave, the detection interval from 0 to π results in higher detection sensitivity than the detection interval from (π/2) to (3π/2).

Furthermore, slits, edges or other detection targets may be formed from magnetic substances, and a magnetic sensor may be used for the detector. The detector for detecting the slits or edges may be formed to be of a reflective type by forming a light-emitting device and a light-receiving device on one of the fixed portions of a rotating disk.

In the present embodiment, it is necessary to set a home position serving as a reference for rotation for at least the second roller 102. This home position serves as a reference position when detecting the eccentricity of the second roller 102 or when performing feedback control of a detected rotation velocity fluctuation of the second roller 102. This detection may be carried out by providing a slit for detecting home position in the encoder disk 505 separate from a slit 503 for the detection interval.

In addition, the home position may be set arbitrarily in the case of a constitution in which the second detection means 102*a* is not provided with a separate slit for detecting home position. For example, once predetermined set conditions (such as constant rotation by a motor or constant rotation by a first supporting roller) have been detected during detection of a fluctuation in the rotation velocity of the second roller 102, slit 503 detected at a suitable timing is set as the home position (503*h*) and monitored. More specifically, a timer counter is reset simultaneous to the detection of a pulse signal received at a suitable timing once a motor and so on has reached constant rotation. The number of slits 503 provided in the encoder disk 505 of the second detection means 102*a* is preliminarily stored in memory, and once the number of pulse signals has reached the number of slits 503, the home position is treated as having been detected and the timer counter is reset. In this case, it is necessary to determine the home position and determine at least the phase of the rotation velocity fluctuation of the second roller 102 corresponding thereto each time the power is turned on. At this time, the determined location of the home position is constantly recognized with a circuit or firmware.

In the present embodiment, in the case of controlling driving while correcting any fluctuations in belt movement position attributable to drive roller eccentricity or encoder disk mounting eccentricity, as a preliminarily operation thereto, the rotation velocity fluctuation of the second roller 102 detected by the second detection means 102*a* is first recognized using detection means 101*a*, 102*a* installed on the first roller 101 and the second roller 102. In the case the home position of the encoder disk 505 can be set to a specific location, this preliminary operation can be carried out in a factory process prior to product shipment. In addition, in the case a home position has not been set, it is necessary to set an arbitrary home position and carry out the preliminary operation prior to turning on the power of the main unit. In addition, in the case, for example, slippage and so on occurs in a fastener between the detector 506 and the second roller 102 due to the passage of time or the environment, the preliminary operation is carried out corresponding to user usage status (at time when there are no printing requests) at predetermined time intervals, such as every predetermined number of sheets, to detect and update the rotation velocity fluctuation of the second roller 102. In addition, in the case of desiring to eliminate effects caused by eccentricity of other driven rollers, the rotation velocity fluctuation of the second roller 102 is detected and updated periodically since slippage and other phase relationships between that driven roller and the belt 103 change.

The following provides an explanation of a method for detecting fluctuations in rotation velocity of the second roller 102.

In the present embodiment, a fluctuation component attributable to eccentricity of the second roller 102 is detected by rotating the motor at a predetermined angular velocity. By installing rotation detection means in the form of the detection means 101*a*, 102*a* shown in FIG. 15 on the first roller 101 and the second roller 102, and detecting the second detection means 102*a* for four of the slits 503*a*, together with being able to set the detection intervals to a high detection sensitivity π for fluctuations in rotation velocity, the phase difference between each detection interval can be set to (π/2).

In the present embodiment, rotation data of the second roller 102 comprises data obtained by measuring the time from detection of a slit 503 by the detector 506 to the detection of a specific slit. Symbols $A_1$ and $B_1$ and symbols A2 and B2 in FIG. 15 indicate the detection intervals of the first roller 101 and the second roller 102. The detection intervals are set to an integer multiple of the rotation period of the first roller 101. As a result, the effects of fluctuations in the rotation velocity of the first roller 101 can be virtually ignored in this detection interval. It is necessary to measure the times of at least two intervals in a single period of the second roller 102 in order to detect the rotation velocity fluctuation of the second roller 102. If the detection interval is set to an integer multiple of the rotation period of the first roller 101, any combination of intervals may be used. For example, in the case shown in FIG. 15, two intervals (intervals C and D and intervals B and D) can also be set in addition to intervals A and B. In addition, detection may be carried out for intervals A and C or detection may be carried out for intervals A and B. In addition, it is not necessary that the detection interval be 180°. However, if the detection interval is made to be 180°, the detection sensitivity of rotation velocity fluctuation of the second supporting roller can be maximally increased. In addition, the combinations of intervals A and B, intervals B and C, intervals C and D and intervals D and A, in which the phase between detection intervals is shifted 90°, enable the detection sensitivity of the rotation velocity fluctuation of the second roller to be increased. In the following explanation, an explanation is provided of the case of detecting intervals A and B.

Pulses are emitted when each detection means 101*a*, 102*a* has detected the passage of a slit. These pulse signals are transmitted to the counter 1 and rotation time detection unit 173 and the counter 2 and rotation time detection unit 174, respectively. The counter 1 and rotation time detection unit 173 is provided with a synchronous 4-bit counter, this counter is composed so as to output a single pulse to a rotation time detector for every four pulses input thereto. In addition, the counter 2 and rotation time detection unit 174 is provided with a synchronous 8-bit counter, and this counter is composed so as to output a single pulse to a rotation time detector for every 128 pulses input thereto. In other words, two pulse signals are transmitted to a rotation time detector for one revolution of the first roller 101, while 4 pulses signals are transmitted to a rotation time detector for one revolution of the second roller 102. The pulse interval time data signals measured with each rotation time detector are respectively sent to the second roller period fluctuation arithmetic processing unit 171.

The timing of the counting between counter 1 of the counter 1 and rotation time detection unit 173 and counter 2 of the counter 2 and rotation time detection unit 174 is adjusted so that the timing at which slits 403*a* and 403*b* pass the detector 406 of the first detection means 101*a* and the timing at which slit 503*a* passes the detector 506 of the second detection means 102*a* are the same. Count timing is adjusted with a synchronous signal sent to each counter. When this synchronous signal is received, counter 1 resets the current count value and resumes counting from 0. In other words, the four slits 503*a* synchronized to the counter output pulse of the first roller 101 among all of the slits of the detection means 102*a* of the second roller 102 shown in FIG. 15 can be set at an arbitrary timing by transmitting a signal to the counter 2 in synchronization with the pulse output timing of the counter 1.

Figure 16:
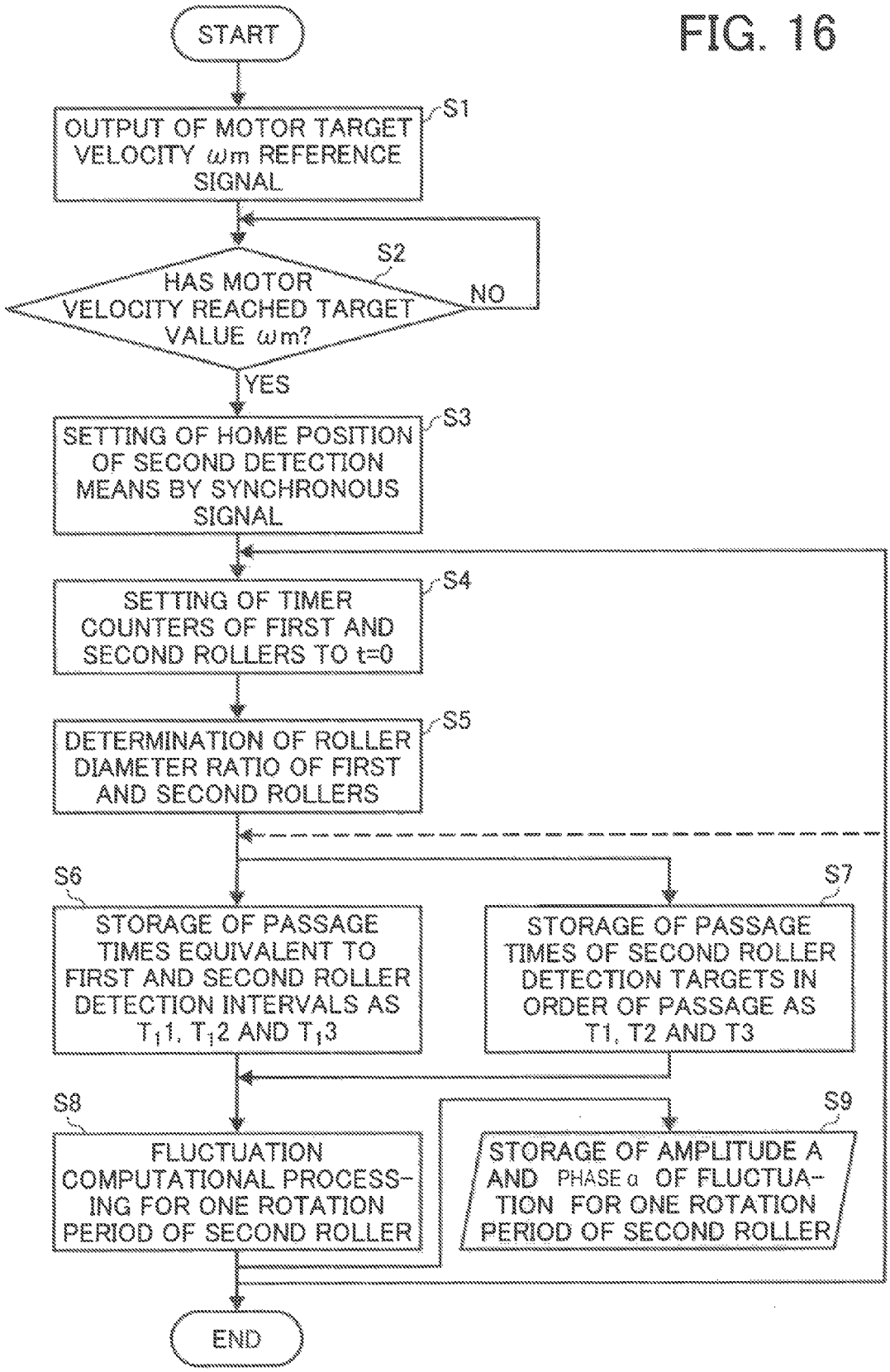
FIG. 16 is a flow chart showing detection processing for fluctuations in rotation velocity in the recognition method 1 using rotation velocity data.

FIG. 16 is a flow chart showing detection processing for fluctuations caused by eccentricity of the second roller 102 and mounting eccentricity of the second detection means 102*a* in the present embodiment.

In FIG. 16, after a motor controller has driven a belt by outputting a command signal for a motor target angular velocity $\omega_m$ suitable for stable rotation of a DC servo motor (S1), a judgment is made as to whether the DC servo motor has reached the target rotation velocity (S2). Here, the objective is to enable the motor to stably rotate at a predetermined speed to increase detection accuracy. In the case the DC servo motor has been judged to have reached the target rotation velocity (YES in S2), synchronous processing is carried out. A synchronous pulse signal is output to counter 2 corresponding to the second roller 102 simultaneous to an output pulse signal of counter 1 corresponding to the first roller 101. When the counter 2 corresponding to the second roller 102 receives the synchronous pulse signal, the current pulse count value is reset, and counting resumes starting from the next pulse.

For example, a synchronous pulse signal is output to counter 2 corresponding to the second roller 102 at the timing at which the slit 403*b* is detected of the first roller 101. Where upon, the count value of the counter 2 is reset, and the first slit 503*h* of the second roller 102 where counting is resumed is set for the home position of the second roller 102. After setting slit 503*h*, four pulses per revolution are output from the counter 2 based on this slit 503*h*. As a result, the output pulses are synchronous with the timing at which the passage of slits 403*a*, 403*b* of the first roller 101 is detected. According to this type of synchronous processing, one of the slits (503*h*) of the second roller 102 is set as the home position (S3). At this time, time is measured by setting the counter of the internal timer unit of the rotation time detector in the counter 2 and rotation time detection unit 174 to 0. In addition, time is simultaneously measured by also setting the counter of the internal timer unit of the rotation time detector in the counter 1 and rotation time detection unit 173 to 0 for the first roller 101 detected at nearly the same timing (S4). These rotation time detectors transmit data in the form of the time measured with the counters of the internal timer units when a pulse signal was received. A single revolution of the second roller 102 is detected as a result of preliminarily retaining the total number of set slits 503 of the second detection means 102*a* as data, and the total number of output pulse signals becoming the total number of slits preliminarily stored in memory. The average angular velocity $\omega_{2a}$ for one revolution of the second roller 102 is then calculated by measuring the time required for one revolution. In addition, the average angular velocity $\omega_{1a}$ is similarly calculated by measuring the time required for one revolution of the first roller 101. The current diameter ratio of the rollers is then accurately determined from the average angular velocities of the first roller 101 and the second roller 102 (S5). As a result of accurately determining the roller diameter ratio, detection error in rotation speed fluctuation attributable to changes in roller diameter caused by production error, environmental changes or changes over time can be corrected. In addition, accuracy may also be increased by determining the roller diameter ratio from averaged data obtained by rotating the first roller 101 and the second roller 102 a plurality of times.

After having determined the roller diameter ratio in this manner, passage time interval data is stored in the form of T1, T2, T3 in data memory contained in the second roller period fluctuation arithmetic processing unit 171 in the order in which the slits passed starting from re-detection of the home position for the second roller 102 (S6). In addition, the passage time intervals of slits passing nearly simultaneously, namely the half-revolution times, are simultaneously stored as $T_1$1, $T_1$2, $T_1$3 in data memory contained in the second roller period fluctuation arithmetic processing unit 171 for the first roller 101 (S7). Computational processing is then performed on the rotation velocity fluctuation of the second roller 102 using this passage time data $T_1$1, $T_1$2, $T_1$3, T1, T2, T3 (S8). As shown in FIG. 15, in the case slit 403*b* of the first roller 101 and slit 503*h* of the second roller 102 are synchronously processed, if the passage time intervals of the passing slits are taken to be $T_1$1, $T_1$2, $T_1$3 based on slit 403*b* for the first roller 101, then $T_1$1+$T_1$2 is the time for one revolution of the first roller 101, and becomes the passage time of interval $A_1$ indicated with the broken line arrow in FIG. 15. In addition, $T_1$2+$T_1$3 also is the time for one revolution of the first roller 101, and becomes the passage time of interval $B_1$ indicated with the solid line arrow in FIG. 15. On the other hand, in the second roller 102, the passage time intervals of passing slits based on slit 503*h* are T1, T2, T3. T1+T2 becomes the passage time of interval $A_2$ indicated with the broken line arrow in FIG. 15. Similarly, T2+T3 becomes the passage time of interval $B_2$ indicated with the solid line arrow. Computational processing is then performed on the rotation velocity fluctuation of the second roller 102 using $T_1$1, $T_1$2, $T_1$3, T1, T2, T3 obtained in this manner.

The computational processing for the rotation velocity fluctuation of the second roller 102 (S8) calculates the amplitude and phase of a rotation velocity fluctuation equivalent to one revolution of the second roller 102. More specifically, the amplitude of the rotation velocity fluctuation for one revolution of the second roller 102 is calculated as A, while the initial phase based on the home position is calculated as $\alpha$. The following provides an explanation of a method for calculating the amplitude and phase of the rotation velocity fluctuation of the second roller 102.

The amplitude and phase of the rotation velocity fluctuation of the second roller 102 are determined from the rotation time of a first interval (detection interval A in FIG. 15) composed of two slits, and the rotation time of a second interval (detection interval B in FIG. 15) composed of two different slits and having a different phase than the first interval, based on the home position (time 0). In addition, the average angular velocities $\omega_{02_1}$ and $\omega_{02_2}$ during the time the second roller 102 rotates through the first interval and the second interval are determined from rotation data of the first roller.

First, the rotation angular velocity $\omega_2$ of the second roller 102, which contains rotation velocity fluctuation attributable to eccentricity of the second roller 102, is defined as in following Eq. (32).

$$\omega_2=\omega=A\sin(\omega_{02}t+\alpha) \quad \text{Eq. (32)}$$

Here, the first term $\omega_{02}$ is the average rotation angular velocity of the second roller 102 which rotates accompanying transport of the belt. This is equivalent to converting belt movement velocity to a rotation angular velocity of a roller. The second term indicating the fluctuation components of rotation velocity attributable to the eccentricity of the second roller 102 and the mounting eccentricity of the detection means of amplitude A and phase $\alpha$ is superimposed on this average angular velocity.

Here, the relationship indicated in the following Eq. (33) is valid since the second roller 102 makes one-half revolution ($\pi$ radian rotation) in the first interval.

$$\pi = \int_0^{T1+T2} \omega_2 dt = \int_0^{T1+T2} [\omega_{02_1} + A\sin(\omega_{02_1}t+\alpha)]dt \quad \text{Eq. (33)}$$

Here, $\omega_{02_1}$ is the average rotation angular velocity of the second roller 102 in the first interval, and this is determined according to the detection data of the first roller 101 from the following Eq. (34).

$$\omega_{02_1} = \frac{R_1}{R_2}\frac{2\pi N}{(T_1 1 + T_1 2)} \quad \text{Eq. (34)}$$

The diameter ratio ($R_1/R_2$) of the first roller 101 and the second roller 102 uses the value determined in S5 of FIG. 16. "N" is the number of revolutions of the first roller 101 during measurement of the first detection interval. Here, since the roller diameter ratio is designed to be 1:2, N=1 since the first detection interval is rotating angle $\pi$ of the second roller 102. In addition, the following equation is valid in a form having a different integration range in the same manner as Eq. (33) in the second detection interval as well.

$$\pi = \int_{T1}^{T1+T2+T3} \omega_2 dt \quad \text{Eq. (35)}$$

-continued $$= \int_{T1}^{T1+T2+T3} [\omega_{02_2} + A\sin(\omega_{02_2}t+\alpha)]dt$$

Here, $\omega_{02_2}$ is the average rotation angular velocity of the second roller 102 in the second interval, and is determined according to rotation data of the first roller 101 from the following Eq. (36).

$$\omega_{02_2} = \frac{R_1}{R_2}\frac{2\pi N}{(T_1 2 + T_1 3)} \quad \text{Eq. (36)}$$

Fluctuation in rotation velocity occurs in the first roller 101 due to eccentricity of the first roller 101 and mounting eccentricity of the first detection means. However, the above-mentioned detection interval is nearly an integer multiple of the rotation period of the first roller 101. Consequently, since the average rotation angular velocity $\omega_{02_2}$ of the second roller 102 in the detection interval of the second roller 102 is determined from the measurement time when the first roller 101 rotates exactly an integral number of times, the fluctuation component of angular velocity attributable to the eccentricity of the first roller 101 can be represented with a trigonometric function such as a sine or cosine. In other words, since one half period fluctuates positively while the other half period fluctuates negatively, this fluctuation component is offset in one period of the first roller 101. As a result, the measurement time of the first roller 101 used to determine the average rotation angular velocity $\omega_{02_2}$ of the second roller 102 is hardly affected at all by the eccentricity of the first roller 101.

Amplitude A and phase $\alpha$ of the fluctuation component of the rotation velocity of the second roller 102 are determined by solving the equation indicated in the following Eq. (37) derived by transforming the previously indicated Eq. (33) and Eq. (35).

$$\begin{bmatrix} \sin\left(\frac{\omega_{02_1}(T1+T2)}{2}\right) & \cos\left(\frac{\omega_{02_1}(T1+T2)}{2}\right) \\ \sin\left(\frac{\omega_{02_2}(T3+T2+2T1)}{2}\right) & \cos\left(\frac{\omega_{02_2}(T3+T2+2T1)}{2}\right) \end{bmatrix} \begin{bmatrix} A\cos(\alpha) \\ A\sin(\alpha) \end{bmatrix} = \begin{bmatrix} \omega_{02_1}(\pi - \omega_{02_1}(T1+T2))/2\sin\left(\frac{\omega_{02_1}(T1+T2)}{2}\right) \\ \omega_{02_2}(\pi - \omega_{02_2}(T3+T2))/2\sin\left(\frac{\omega_{02_2}(T3+T2)}{2}\right) \end{bmatrix} \quad \text{Eq. (37)}$$

Eq. (37) may be solved by determining the inverse matrix of the left side matrix, or another numerical calculation technique may be used. As a result, amplitude A of the rotation velocity fluctuation of the second roller 102 and phase $\alpha$ based on the home position are determined. In an actual image forming apparatus, only the above-mentioned Eq. (37) is stored in the memory of the second roller period fluctuation arithmetic processing unit 171, and amplitude A and phase $\alpha$ are determined by substituting the measurement times (T1, T2, T3) and the average rotation angular velocities $\omega_{02_2}$, $\omega_{02_1}$ for the Eq. (37). Following arithmetic processing of this amplitude A and phase $\alpha$, the values are stored in data memory (S9) followed by setting the target rotation angular velocity $\omega_{2ref}$ of the second roller 102. The operation from S4 to S9 indicated with a solid line or the operation from S6 to S9 indicated with a broken line may be repeated to determine the average values of a plurality of amplitude A and phase $\alpha$ for the purpose of increasing detection accuracy.

The rotation angular velocity (target angular velocity) $\omega_{2ref}$ when the belt 103 has moved at a constant velocity is generated from amplitude A and phase $\alpha$ determined according to the previously indicated Eq. (37). This is transmitted to the motor controller 115, and feedback control is carried out based on that data.

The $\omega_2$ indicated in the previously indicated Eq. (32) is a representation of the average rotation angular velocity $\omega_{02}$ (belt movement velocity) of the second roller 102 rotating accompanying belt movement, and the rotation velocity fluctuation attributable to eccentricity of the second roller 102. Thus, from Eq. (32), the angular velocity (target rotation angular velocity) $\omega_{2ref}$ of the second roller 102 when the belt movement velocity is constant can be expressed as shown in the following Eq. (38).

$$\omega_{2ref}=\omega_{02}+A\sin(\omega_{02}t+\alpha) \quad \text{Eq. (38)}$$

Accordingly, as a result of feedback control of the rotation angular velocity of the second roller 102 so as to become the target rotation angular velocity $\omega_{2ref}$ indicated in Eq. (38), the belt movement position fluctuations attributable to drive roller eccentricity and encoder disk mounting eccentricity can be cancelled out, enabling belt movement velocity to be controlled to a constant velocity. Furthermore, the value of $\omega_{02}$ is suitably changed in the case of changing the roller target average velocity according to the image output mode.

In this manner, according to the present embodiment, fluctuations in rotation velocity attributable to eccentricity of the second roller 102 and mounting eccentricity of the second detection means 102*a* can be detected. Feedback control can be carried out based on rotation angular velocity data by setting the target angular velocity $\omega_{2ref}$ of the second roller 102 based on the preliminarily detected fluctuations in rotation velocity of the second roller 102. As a result, driving of the belt 103 can be controlled stably at a desired velocity without being affected by eccentricity of the second roller 102 or mounting eccentricity of the second detection means 102*a*.

Although the detection interval of the second roller 102 is made to be 180° in the present embodiment, the detection interval is not limited thereto. For example, the detection interval of the second roller 102 may be in the form of arbitrary angles $\gamma_1$ and $\gamma_2$. In this case, the following Eq. (39) is used to determine the amplitude and phase of the second roller 102.

$$\begin{bmatrix} \sin\left(\frac{\omega_{02_1}(T1+T2)}{2}\right) & \cos\left(\frac{\omega_{02_1}(T1+T2)}{2}\right) \\ \sin\left(\frac{\omega_{02_2}(T3+T2+2T1)}{2}\right) & \cos\left(\frac{\omega_{02_2}(T3+T2+2T1)}{2}\right) \end{bmatrix} \begin{bmatrix} A\cos(\alpha) \\ A\sin(\alpha) \end{bmatrix} = \begin{bmatrix} \omega_{02_1}(\gamma 1-\omega_{02_1}(T1+T2))/2\sin\left(\frac{\omega_{02_1}(T1+T2)}{2}\right) \\ \omega_{02_2}(\gamma 2-\omega_{02_2}(T3+T2))/2\sin\left(\frac{\omega_{02_2}(T3+T2)}{2}\right) \end{bmatrix} \quad \text{Eq. (39)}$$

By solving the equation of Eq. (39), the amplitude and phase attributable to eccentricity of the second roller 102 can be determined for any arbitrary angle other than 180°. In this case as well, detection accuracy can be increased by making the detection interval an integer multiple of the period of the first roller 101.

In addition, although period fluctuations attributable to eccentricity of the second roller 102 and mounting eccentricity of the second detection means are detected by providing two detection intervals A, B for the second roller 102 and measuring the time interval in these two detection intervals according to the explanation thus far, detection of period fluctuations is not limited thereto. For example, a plurality (n) of detection slits may be provided, a plurality of detection intervals for establishing a simultaneous equation may be set, and the amplitude and phase of the rotation velocity fluctuation of the second roller 102 may be respectively determined. The detection accuracy of the rotation velocity fluctuation of the second roller 102 can then be increased by averaging those values. For example, if three detection intervals are able to be set, then three combinations of detection intervals can be set, and three sets of phase and amplitude are determined for each combination after which they are averaged. If four detection intervals are able to be set, then six combinations of detection intervals can be set, and six sets of phase and amplitude are determined for each combination after they can be averaged.

In addition, there are cases in which the rotation velocity fluctuation of the second roller 102 changes due to environmental changes and use over time. If the rotation velocity fluctuation of the second roller 102 changes due to environmental changes or use over time in this manner, an error occurs in the previously detected rotation velocity fluctuation of the second roller 102. In this case, even if feedback control is carried out using the previously detected rotation velocity fluctuation of the second roller 102, the effect of the fluctuation in the second roller 102 appears in belt movement velocity, thereby resulting in the problem of being unable to drive the belt at a constant velocity. Therefore, a new reference rotation angular velocity $\omega_{2ref}$ of the second roller 102 is calculated by constantly carrying out the processing of S3 to S9 of FIG. 16.

In addition, in the present embodiment, the second detection means 102*a* is installed for outputting 512 pulses for one revolution of a drive roller in the form of the second roller 102. Since resolution is sufficiently high for detecting fluctuations in the rotation period of a motor or gear, fluctuations in belt movement velocity attributable to fluctuations in motor speed, gear eccentricity or gear cumulative pitch error and so on can be suppressed by feedback control. Moreover, in the present embodiment, the counter 2 and rotation time detection unit 174 and the second roller period fluctuation arithmetic processing unit 171 for detecting rotation velocity fluctuation attributable to eccentricity of the second roller 102 and mounting eccentricity of the second detection means 102*a* using counter 2 from the signal of the second detection means 102*a* function independently. As a result, rotation velocity fluctuation of the second roller 102 can be calculated and updated successively during feedback control. As a result, highly accurate feedback control in accommodation of environmental changes or changes over time in the second roller 102 can be realized.

(Recognition Method 2 Using Rotating Angle Data)

In the previously described recognition method 1, the rotation velocity fluctuation of the second roller 102 was calculated from the rotation times of a predetermined rotating angle (detection interval) of each of the rollers 101 and 102, or in other words, rotation velocity data. Here, an explanation is provided of the case of calculating fluctuations in the rotating angle of the second roller 102 from the rotating angle data of each roller 101 and 102.

Figure 17:
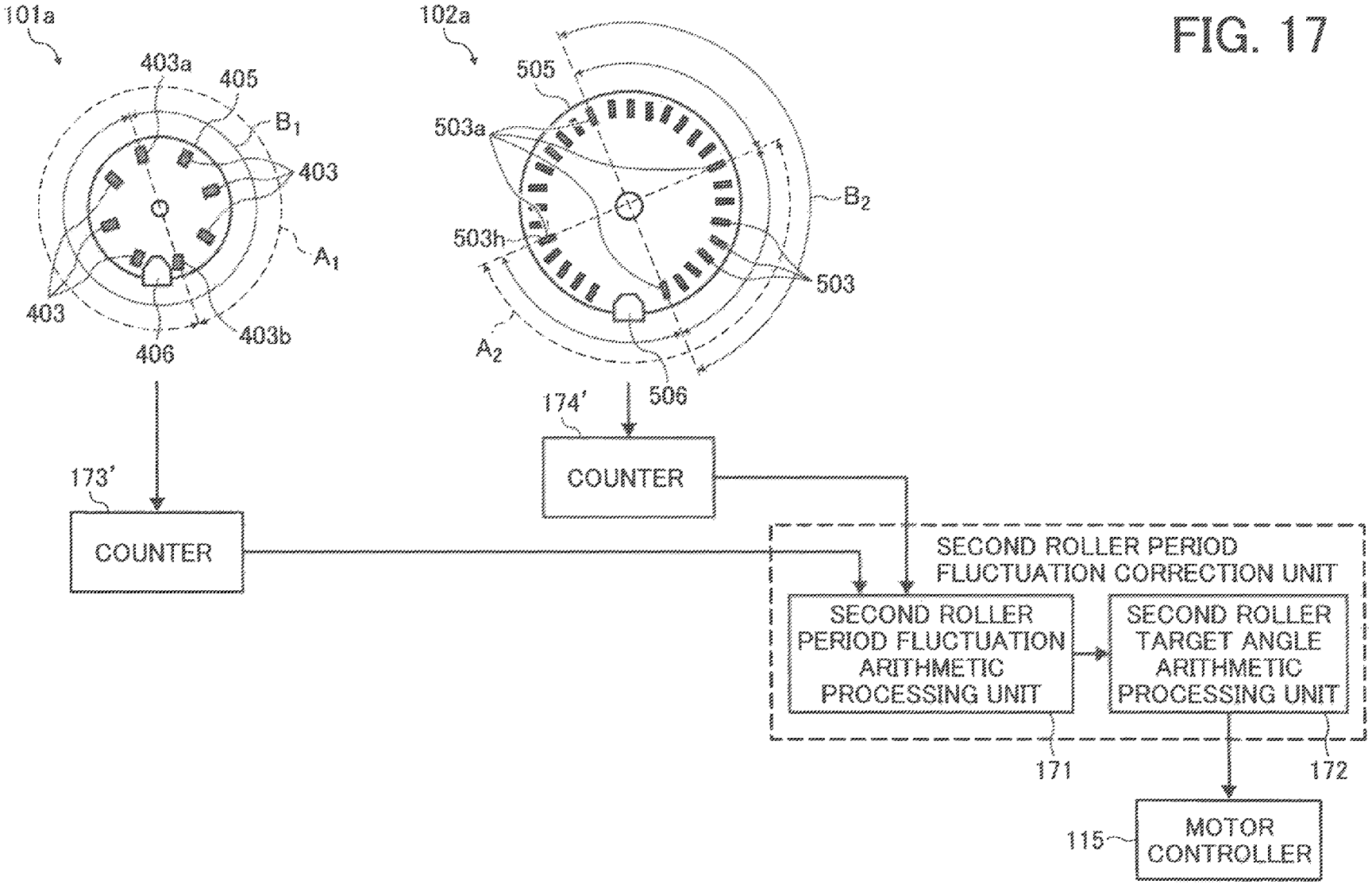
FIG. 17 is a block drawing showing the constitution of another control system for explaining the recognition method 1 using rotation velocity data.
Figure 18:
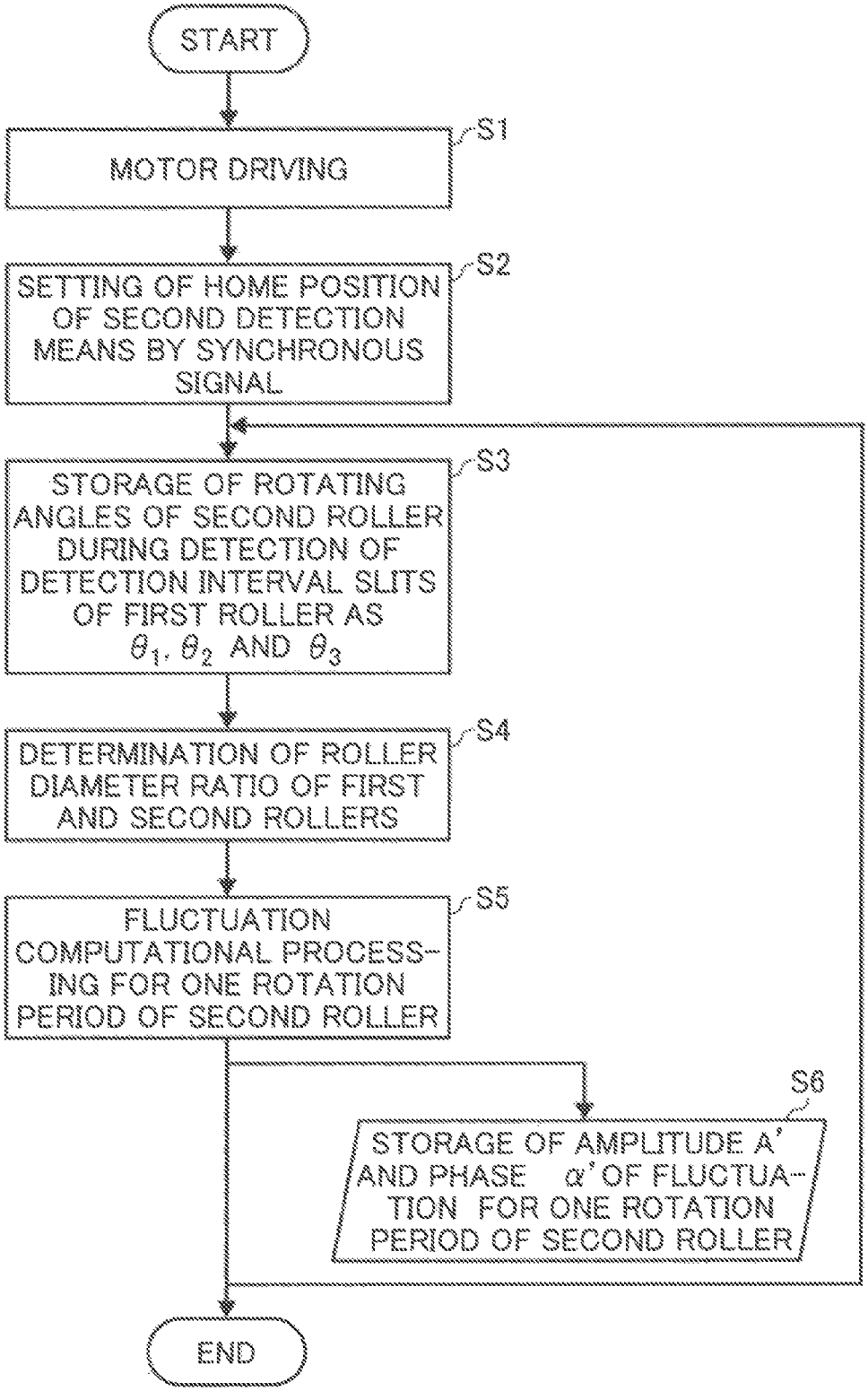
FIG. 18 is a flow chart showing another detection processing for fluctuations in rotation velocity in the recognition method 1 using rotation velocity data.

The constitution in the case of rotating angle detection is as shown in FIG. 17, the operation thereof is as shown in FIG. 18, and both are nearly the same as the case of the previously described recognition method using rotation velocity data.

The following provides an explanation of the case of rotating angle detection while focusing primarily on differences between the two methods.

Pulse signals are output when each detection means 101*a* and 102*a* in FIG. 17 detects the passage of a slit. These pulse signals are transmitted to a counter 173'. The counter 173' corresponding to the first roller 101 is composed with a synchronous 4-bit counter, and is composed so as to output a digital value of the current count. In addition, a counter 174' corresponding to the second roller 102 is composed with a synchronous 8-bit counter, and is composed so as to output a digital value of the current count. In other words, cumulative rotating angle data of the first roller 101 and the second roller 102 is set to the second roller period fluctuation arithmetic processing unit 171.

Processing for detecting fluctuations attributable to eccentricity of the second roller 102 and mounting eccentricity of the second detection means is according to the flow chart shown in FIG. 18. The motor controller 115 drives the belt by rotating a DC servo motor (S1). Here, the effect of the rotating status of the motor is not large in order to detect the rotating angle. Next, a home position to serve as a reference for synchronous processing and the rotation phase of the second roller 102 is set. Count data of the counter 174' is stored in memory simultaneous to the count of the counter 173' of the first roller 101 reaching a predetermined count. For example, the count data of the counter 174' is stored in memory when the counter 173' has reached a predetermined count by detecting slit 403*b* of the first roller 101 while monitoring the count data of the counter 173'. Whereupon, slit 503*h* of the second roller 102 counted by the counter 174' is set as the home position of the second roller 102 (S2). Following setting of slit 503*h*, the count data of the counter 2 is stored in memory at the rate of four times per one revolution based on slit 503*h* in synchronization with the time at which the counter 173' has reached a predetermined count by detecting passage of slits 403*a* and 403*b* of the first roller 101. This count data serves as count data in the vicinity of slits 503 which uses a single slit (503*h*) of the second roller 102 as a home position as a result of synchronous processing of slit 403*b* and slit 503*h*.

This count data is converted to a rotating angle of the second roller 102 and stored in the data memory contained in the second roller period fluctuation arithmetic processing unit 171 as $\theta_1$, $\theta_2$ and $\theta_3$ by defining the rotating angle when setting the home position as $\theta_0$ (S3). Since rotating angle data $\theta_0$, $\theta_1$, $\theta_2$ and $\theta_3$ is the rotating angle data of the second roller 102 when the first roller 101 rotates by half a revolution, the diameter ratio $R_1/R_2$ of the first roller 101 and the second roller 102 is determined from the rotating angle of the second roller 102 with respect to one revolution of the first roller 101 (S4).

Computational processing is then performed on the rotation velocity fluctuation of the second roller 102 using rotating angle data $\theta_0$, $\theta_1$, $\theta_2$ and $\theta_3$ and ratio $R_1/R_2$ (S5). The computational processing of the rotation velocity fluctuation of the second roller 102 (S5) calculates the amplitude and phase of a rotating angle fluctuation occurring during one revolution of the second roller 102. More specifically, the amplitude of the rotating angle fluctuation for one revolution of the second roller 102 is calculated as A', while the initial phase based on the home position is calculated as α'.

The following provides an explanation of a method for calculating the amplitude and phase of the rotating angle fluctuation of the second roller 102.

The amplitude and phase of the rotating angle fluctuation of the second roller 102 are determined from the rotating angle rotated by the second roller 102 during rotation through a first interval composed with two slits in the first roller 101 (detection interval A in FIG. 17) and a second interval similarly composed of two different slits and having a different phase than the first interval (interval B in FIG. 17), based on the home position.

First, the rotating angle $\theta_2$ of the second roller 102, which contains a rotating angle fluctuation attributable to eccentricity of the second roller 102 and so on, is defined as in the following Eq. (40).

$$\theta_2=\theta_{02}+A'\sin(\theta_2+\alpha') \qquad \text{Eq. (40)}$$

Here, the first term of $\theta_{02}$ is the ideal rotating angle of the second roller 102 rotating accompanying movement of the belt, and is equivalent to converting the amount of belt movement to a roller rotating angle. In other words, the rotating angle of the second roller 102 becomes $\theta_2$ in the case of an ideal roller and encoder that are free of eccentricity. The second term indicating rotating angle fluctuation components attributable to eccentricity of the second roller 102 and mounting eccentricity of the detection means 102*a* of amplitude A' and phase α' is superimposed on this rotating angle.

Here, although the relationship is similar to that of Eq. (40 above) for the rotating angle of the first roller 101 as well, the fluctuation component equivalent to the second term of Eq. (40) becomes 0 when the first roller 101 rotates by one revolution (2π) in detection interval A. The relationship between the ideal rotating angle θ02 of the second roller 102 and the rotating angle of the first roller 101 is as shown in the following Eq. (41).

$$\theta_{02}=\frac{R_1}{R_2}\theta_{01}=\frac{R_1}{R_2}2N\pi \qquad \text{Eq. (41)}$$

The diameter ratio ($R_1/R_2$) of the first roller 101 and the second roller 102 uses the value determined in S4 of FIG. 18. "N" is the number of rotations of the first roller 101 when rotating through a detection interval. Here, since the roller diameter ratio is designed to be 1:2, N=1 since the first detection interval is rotating angle π of the second roller 102. The following Eq. (42) is valid as a result of substituting Eq. (41) in Eq. (40) for the rotating angle data acquired when the first roller 101 rotates through detection interval A.

$$\theta 2-\theta 0=\frac{R_1}{R_2}2N\pi+A'\{\cos\alpha'(\sin\theta 2-\sin\theta 0)++\sin\alpha'(\cos\theta 2-\cos\theta 0)\} \qquad \text{Eq. (42)}$$

Similar to Eq. (42) above, the amplitude A' and phase α' of the rotating angle fluctuation component of the second roller 102 are determined by solving the following Eq. (43) derived by transforming from the equation valid in detection interval $$\begin{bmatrix}\sin(\theta 2-\theta 0) & \cos(\theta 2-\theta 0)\\ \sin(\theta 3-\theta 1) & \cos(\theta 3-\theta 1)\end{bmatrix}\begin{bmatrix}A\cos(\alpha)\\ A\sin(\alpha)\end{bmatrix}=\begin{bmatrix}\theta 2-\theta 0-\frac{R_1}{R_2}2N\pi\\ \theta 3-\theta 1-\frac{R_1}{R_2}2N\pi\end{bmatrix} \qquad \text{Eq. (43)}$$

As a result, amplitude A' of the rotating angle fluctuation of the second roller 102 and the phase α' based on the home position are determined. Following completion of this arithmetic processing of amplitude A' and phase α', the values are stored in data memory (S6) followed by setting the target rotating angle $\theta_{2ref}$ of the second roller 102. The operation from S3 to S6 indicated with a solid line may be repeated to determine the average values of a plurality of amplitude A' and phase α' for the purpose of increasing detection accuracy.

The rotating angle (target angle) $\theta_{2ref}$ of the second roller 102 when the belt has moved by a constant amount is generated from amplitude A and phase α' determined according to the previously indicated Eq. (43), and feedback control is carried out based on that data.

Thus, the rotating angle (target rotating angle) $\theta_{2ref}$ of the second roller 102 when the amount of belt movement is constant can be represented as shown in the following Eq. (44) from the previously indicated Eq. (40).

$$\theta_{2ref}=\theta_{02}'+A'\sin(\theta_{02}'+\alpha') \quad \text{Eq. (44)}$$

Accordingly, as a result of feedback control of the rotating angle of the second roller 102 so as to become the target rotating angle $\theta_{2ref}$ indicated in Eq. (44), the amount of belt movement can be suitably controlled. Furthermore, $\theta_{02}'$ is the drive roller rotating angle obtained by dividing the amount of belt movement by the drive roller radius. In the present embodiment, the data of the second term of Eq. (44) is transmitted to the motor controller 115 as Δθr.

(Recognition Method 3 Using Rotation Velocity Data in Consideration of PLD Fluctuation)

If PLD fluctuation (fluctuations in belt thickness) is present in the direction of belt circumference during recognition of revolution fluctuation of the second roller 102, a recognition error occurs since the PLD fluctuation has effects of different phase attributable to the PLD on the rotation of each roller.

Accordingly, in the present embodiment, an attempt is made to recognize PLD fluctuation from the rotation data (rotation velocity) of the first roller 101 and the second roller 102 according to the previously described PLD fluctuation recognition method 1 and PLD fluctuation recognition method 2, calculate the detection error predicted to occur during measurement of the rotation time of the first roller 101 and the second roller 102, and then correct the rotation time measurement error of the first roller 101 and the second roller 102 based on that result.

More specifically, PLD fluctuation during one revolution of the belt is first detected. PLD fluctuation is detected by driving the belt for one revolution or more to obtain the respective rotation velocity from the first roller 101 and the second roller 102. At this time, since period fluctuation attributable to roller eccentricity ends up being detected, in the case of detecting rotation velocity fluctuation according to the PLD fluctuation of the belt 103, rotation velocity data for the first roller 101 and the second roller 102 is obtained using a filter which isolates the band of the roller rotation period. Rotation velocity fluctuation attributable to PLD fluctuation of the belt is contained in each rotation velocity. A result is obtained from the two rotation velocities in which the rotation velocity fluctuations caused by two PLD fluctuations having different phase and amplitude are superimposed according to the roller diameters and positional relationship. However, one of the PLD fluctuations can be recognized from the superimposed data by performing processing on parameters such as the positional relationship of the two rollers and their roller diameters predetermined at the time of design, and on the previously described recognition method 1 and PLD fluctuation recognition method 2.

Continuing, the measurement error in the rotation time caused by PLD fluctuation of the first roller 101 and the second roller 102 is corrected using the recognized PLD fluctuation. More specifically, the error in the measurement of rotation time caused by PLD fluctuation of the first roller 101 and the second roller 102 is corrected by detecting the rotation velocity fluctuation attributable to the PLD fluctuation. The rotation period fluctuation attributable to eccentricity of the second roller 102 and mounting eccentricity of the encoder disk is then calculated based on the methods described above. At this time, the rotation data of the first roller 101 and the second roller 102 becomes rotation data for which the rotation velocity fluctuation component attributable to PLD fluctuation has been corrected. Accordingly, the rotation period fluctuation of the second roller 102 can be determined more accurately. Subsequently, once the rotation period fluctuation of the second roller 102 has been calculated based on this corrected rotation data, the previously set band isolation filter is removed and the rotation velocity fluctuation caused by PLD fluctuation is detected again. At this time, since the rotation data of the second roller 102 is that from which the rotation velocity fluctuation attributable to eccentricity of the second roller 102 and so on has been removed, even if the band isolation filter is removed, there is no occurrence of error in the rotation velocity fluctuation caused by PLD fluctuation of the belt calculated from the rotation velocity fluctuation of the second roller 102. In addition, as a result of this second detection of the rotation velocity fluctuation caused by PLD fluctuation of the belt, rotation velocity fluctuation attributable to fluctuations in belt thickness can be detected over a wider band (more complex fluctuations), thereby making it possible to more accurately detect rotation velocity fluctuation caused by PLD fluctuation of the belt.

Subsequently, feedback control is carried out by determining the target rotation velocity of the second roller 102 when carrying out feedback control using the rotation velocity data caused by PLD fluctuation determined in the manner described above and the rotation period fluctuation attributable to eccentricity of the second roller 102 and the second detection means. Since the rotation velocity of the second roller 102 determined at this time takes into consideration the rotation velocity fluctuation caused by PLD fluctuation and the rotation period fluctuation attributable to eccentricity of the second roller 102 and the second detection means, belt transport can be controlled more accurately.

[Correction Method for Fluctuations in Belt Movement Position Caused by Thermal Expansion of Drive Roller]

The thermal expansion of a drive roller in the form of the second roller 102 can be estimated as a result of obtaining rotation data of the second roller as in the present embodiment. In other words, roller temperature change and roller thermal expansion can be estimated from a change in the amount of rotation of one roller with respect to a predetermined amount of rotation of the other roller based on the encoder outputs (rotation information) of two rollers 101 and 102. The following provides a simple example thereof.

The first roller 101 and the second roller 102 are designed to have a different rate of change in diameter per unit temperature. The amount of change in diameter (diameter rate of change) per 1[° C.] of temperature of each roller is determined in advance. When the diameter of each roller at a reference temperature (25[° C.]) is 32 [mm] for the diameter of the first roller 101 and 16 [mm] for the diameter of the second roller 102, then their diameter ratio is 2. Here, when the first roller 101 has been rotated by 100 [rad], and there is assumed to be no slippage between the belt 103 and the rollers, then the second roller 102 rotates by 200 [rad].

Next, when the roller temperature has risen by 5 [° C.] relative to the reference temperature to 30 [° C.], the diameter of the first roller is taken to be 32.04 [mm], while the diameter of the second roller 102 is taken to be 16.01 [mm]. Although the diameter ratio does not change if the proportion of thermal expansion is the same, the amounts of thermal expansion of the two rollers differ here, with the diameter ratio being 2.0012. Now, when the first roller 101 is rotated by 100 [rad] the second roller 102 rotates by 200.12 [rad].

This change in the amount of rotation of the second roller 102 (here, 0.12 [rad]) can is detected from a rotary encoder output. Roller temperature change can be determined from this result using a calculation formula explained below. In addition, the roller diameter that has changed can be determined from the previously calculated rate of change in roller diameter per unit temperature. A change in average velocity of the belt caused the above-mentioned change in roller diameter is determined by recognizing the thermal expansion of the roller. The average rotation velocity of the motor is then adjusted so that this change in average velocity does not occur.

More specifically, the first roller 101 and the second roller 102 are first designed to have different rates of change in diameter per unit temperature. Although the rate of change in diameter varies depending on whether the rollers are solid or hollow, and the structure of the rollers even if they are made of the same material, they are designated to be made from materials having different coefficients of thermal expansion to enlarge the difference in the diameter rate of change between the first roller 101 and the second roller 102. In the present embodiment, the second roller 102 (drive roller) was made of rubber, while the first roller 101 was made of aluminum. As a result of using rubber and metal for the combination of materials of the second roller 102 and the first roller 101, a large difference in their rates of change in diameter is able to be set. In addition, EP rubber was used for the rubber of the second roller 102 to minimize the occurrence of slippage with the transfer belt, and was manufactured to have a hardness of 60°. In addition, the aluminum of the first roller 101 was made to be hollow and designed to have a low inertial moment. As a result, the rollers closely followed the fluctuations in velocity of the belt and were resistant to the occurrence of slippage.

Here, an explanation is provided of the process for detecting roller temperature change from rotation data. When the radius of the second roller 102 at the reference temperature is defined as $R_d$, the radius of the first roller 101 at the reference temperature is defined as $R_e$, the amount of change in diameter per 1 [° C.] of temperature of the second roller 102 is defined as β, the amount of change in diameter per 1 [° C.] of temperature of the first roller 101 is defined as α, the temperature change of the second roller 102 from the reference temperature is defined as T1, the temperature change of the first roller 101 from the reference temperature is defined as T2, and the average value of PLD is defined as Bt, and it is assumed that slippage does not occur between the belt 103 and the rollers, then the relationship between rotating angle $\theta_d$ of the second roller 102 and the rotating angle $\theta_e$ of the first roller 101 becomes as shown in the following Eq. (45)

$$(R_d+\beta T1+Bt)\theta_d=(R_e+\alpha T2+Bt)\theta_e \quad \text{Eq. (45)}$$

The rotating angle $\theta_e$ of the first roller 101 becomes as shown in the following Eq. (46) by transforming and approximating Eq. (45) when considering that the amounts of radius temperature change βT1 and αT2 are sufficiently small with respect to the effective roller radii (Rd+Bt) and (Re+Bt).

$$\theta_d = \frac{R_e + Bt}{R_d + Bt}\left\{1 + \frac{\alpha T2}{R_e + Bt} - \frac{\beta T1}{R_d + Bt}\right\}\theta_e \quad \text{Eq. (46)}$$

The amount of change in the rotating angle $\Delta\theta_d$ of the second roller 102 that occurs due to a change in roller temperature is indicated with the following Eq. (47).

$$\Delta\theta_d = \frac{R_e + Bt}{R_d + Bt}\left\{\frac{\alpha T2}{R_e + Bt} - \frac{\beta T1}{R_d + Bt}\right\}\theta_e \quad \text{Eq. (47)}$$

Eq. (47) represents the amount by which the rotating angle of the second roller 102 changes in the case of the occurrence of a temperature rise in the roller with respect to the rotating angle of the second roller 102 at the reference temperature.

Here, the second roller 102 and the first roller 101 frequently exhibit roughly the same temperature rise due to thermal conductivity from the belt and so on. In other words, this represents the cases in which the relationship T1=T2 is valid. The following Eq. (48) results when Eq. (47) is transformed by substituting in T1=T2.

$$T1 = \frac{\Delta\theta_d(R_d + Bt)^2}{\{(R_d + Bt)\alpha - (R_e + Bt)\beta\}\theta_e} \quad \text{Eq. (48)}$$

According to Eq. (48), temperature T1 of the second roller 102 can be calculated by detecting the change in the rotating angle $\Delta\theta_d$ of the second roller 102 with respect to the rotating angle $\theta_e$ of the first roller 101. If the temperature change of the rollers is known, the amounts of change in the rotating angles can be recognized using the amounts of change in diameter α and β, thereby making it possible to correspondingly adjust the average rotation velocity or average rotating angle of the motor.

Figure 19:
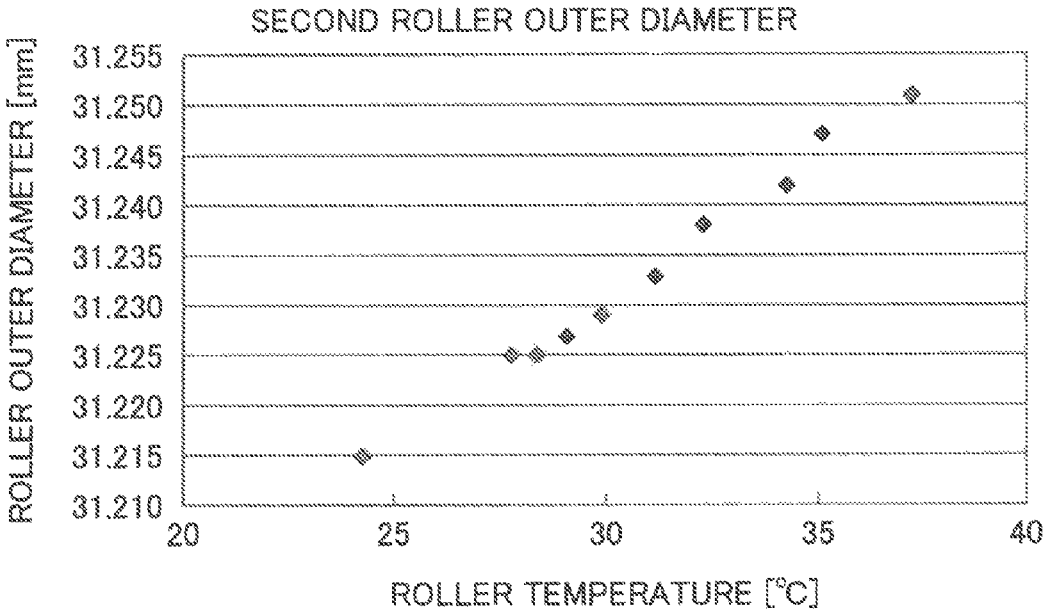
FIG. 19 is a graph showing the results of measuring changes in outer diameter of a second roller attributable to temperature rise.
Figure 20:
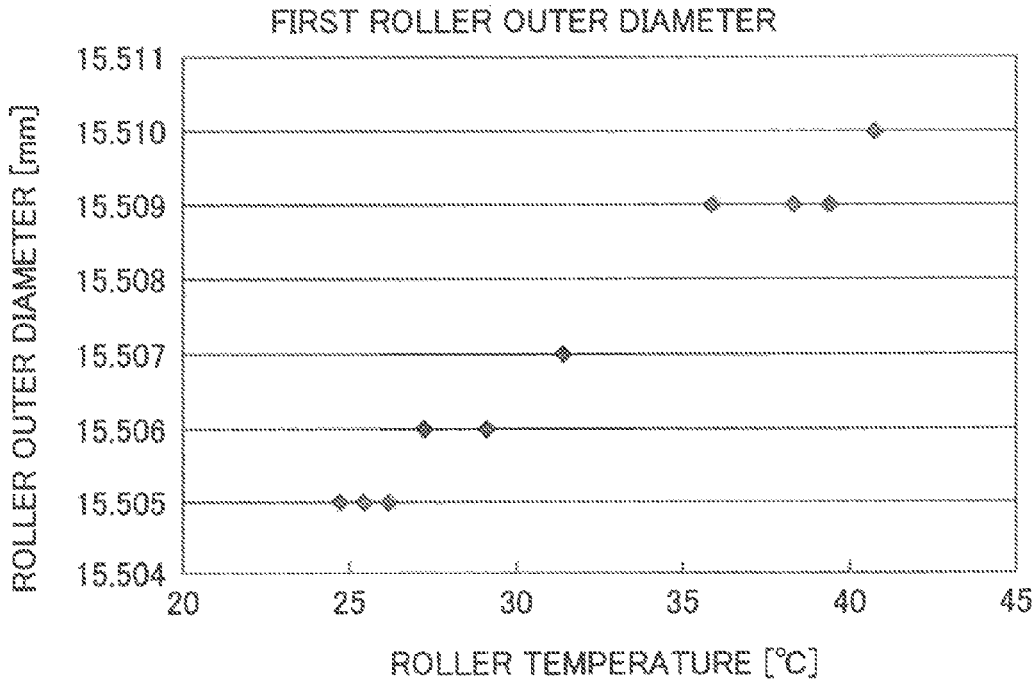
FIG. 20 is a graph showing the results of measuring changes in outer diameter of a first roller attributable to temperature rise.

In calculating the roller temperature from the previously indicated Eq. (48), the parameter required to be measured in advance is the amount of change in roller diameter per unit temperature. The results of measuring the change in outer diameter caused by a temperature rise for the second roller 102 (material: EP rubber) and the first roller 101 (material: aluminum) used in the present embodiment are shown in FIG. 19 and FIG. 20. FIG. 19 shows the case where the second roller 102 is used, and FIG. 20 shows the case where the first roller 101 is used. When the slope of each plotted data was determined to determine the amount of change in diameter per 1 [° C.] of temperature, β of the second roller 102 was found to be 0.00289 [mm] (rate of change: 0.0092 [%]), while α of the first roller 101 was found to be 0.00031 [mm] (rate of change: 0.0020 [%]).

Figures 23, 24:
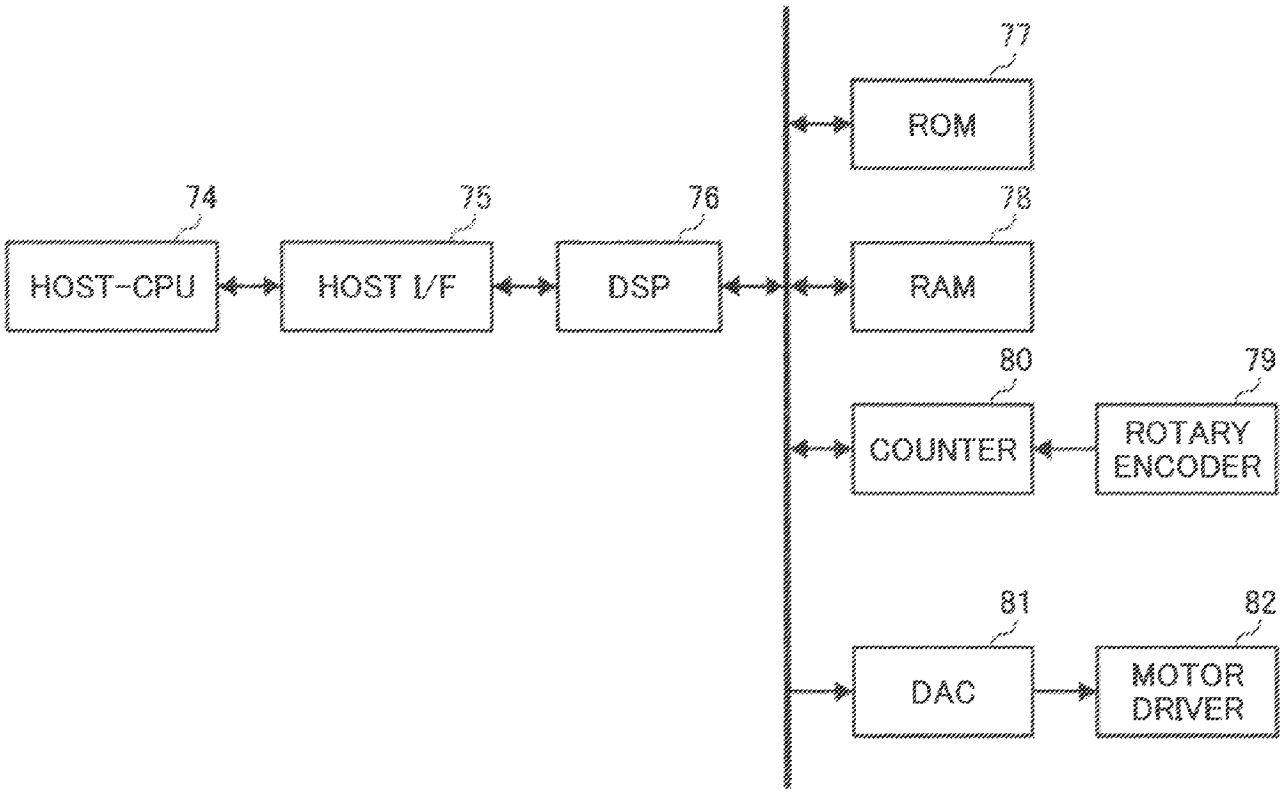
FIG. 23 is a drawing showing the hardware configuration of a positioning controller.
FIG. 24 is a drawing showing the results of calculating a temperature rise, roller diameter at that time, and the diameter ratio between a second roller and a first roller from the amount of change in roller diameter per unit temperature and a standard temperature.

The results of calculating the temperature rise from the reference temperature, the roller diameter at that time, and the diameter ratio between the second roller 102 and the first roller 101 based on the amount of change in roller diameter per unit temperature are shown in FIG. 24. The diameter ratio can be seen to change as the temperature rises. The temperature change of the rollers is recognized by evaluating this change in diameter ratio based on the rotation data of the second roller 102 and the first roller 101.

The roller diameter ratio can be calculated using the data of roller diameter ratio computational processing during computational processing of the rotation period fluctuation of the second roller 102 (S5 in FIG. 16). In addition, the roller diameter ratio can be calculated more accurately by using a longer data sampling period, or accuracy can be improved by increasing the amount of sample data. As indicated in the previously mentioned FIG. 24, when the temperature rises 5 [° C.] from the reference temperature, the diameter ratio changes from 2.0 to 2.0007. At this time, the rotating angle of the first roller 101 when the second roller 102 has been rotated by 200 [rad] becomes 100.0 [rad] at 0 [° C.], 99.96 [rad] at [5° C.], and $\Delta\theta_d$ becomes 0.04 [rad]. If the first roller 101 is rotated by 2000 [rad], then $\Delta\theta_d$ becomes 0.4 [rad]. Thus, it is possible to improve the S/N ratio by lengthening the data sampling period.

In the present embodiment, the amount of temperature change of the second roller 102 and the first roller 101 are calculated from the amount of change in the rotation thereof by preliminarily substituting the roller diameters, average PLD value, and amount of change in roller diameter per unit temperature into the previously indicated Eq. (48). It is necessary to detect the amount of rotation of the second roller 102 with respect to the amount of rotation of the first roller 101 twice to obtain the amount of change in the amount of rotation of the second roller 102. As a result, the roller temperature that has changed from the first detection to the second detection can be known.

The first detection may be carried out at any time. For example, the first detection may be carried out in a factory environment. By again detecting the amount of rotation during image output in a user environment following shipment, the amount of the change in roller temperature can be known with respect to the amount of change at the time of production (factory environment).

In addition, in another example, the first detection is carried out during a registration correction operation. The second detection is then repeated as the occasion demands, followed by monitoring the roller temperature change from the first detection and correcting the motor average velocity. The following provides an explanation of the advantage of carrying out the first detection during a registration correction operation. A registration correction operation is a known operation that is carried out by many image forming apparatuses. In this operation, the amount of paper transport and the timing of ink discharge are corrected by preparing a plurality of types of registry detection patterns, and a user selecting a suitable pattern from the detection patterns formed on paper. This type of registration correction operation has a function which corrects fluctuations in image forming position attributable to component accuracy, as well as registry shifts occurring due to a change in the average amount of movement of the belt. By aligning the timing of this registration correction operation with the detection of roller temperature change and correction of the average amount of motor rotation of the present invention, each function acts effectively, and the number of registration correction operations is reduced considerably. In other words, the first detection is carried out during the registration correction operation. At this time, any shifts in the registry are corrected and a satisfactory image is obtained. In the case diameter changes have occurred due to changes in roller temperature, the roller diameter change with respect to the first detection is recognized by the second detection carried out as the occasion demands, and the average amount of motor rotation is adjusted. In the present embodiment, since changes in the average amount of movement of the belt caused by changes in roller diameter are suppressed, the number of times the registration correction operation is performed, which was required to be performed in response to changes in apparatus internal temperature, is reduced. Conversely, unless the first detection is synchronized with the registration correction operation, the adjustment of the average amount of motor rotation of the present invention is carried out immediately after registration has been corrected, resulting in the occurrence of a registry shift.

[Belt Positioning Control Method]

Next, an explanation is provided of a typical positioning control apparatus as an apparatus for controlling the positioning of the above-mentioned motor controller 115.

Figure 21:
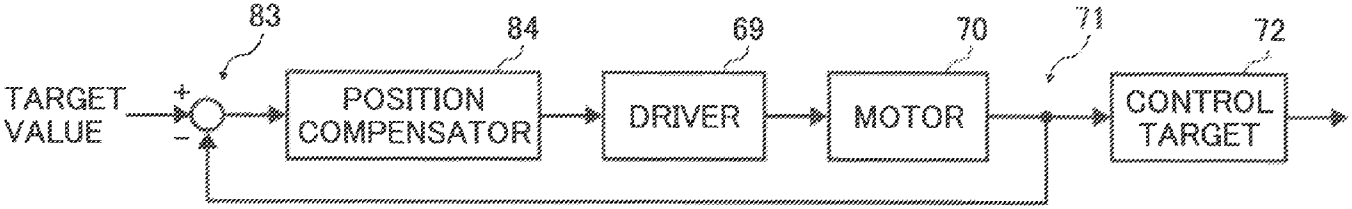
FIG. 21 is a block line drawing showing the constitution of a positioning controller composed only of a position feedback loop.
Figure 22:
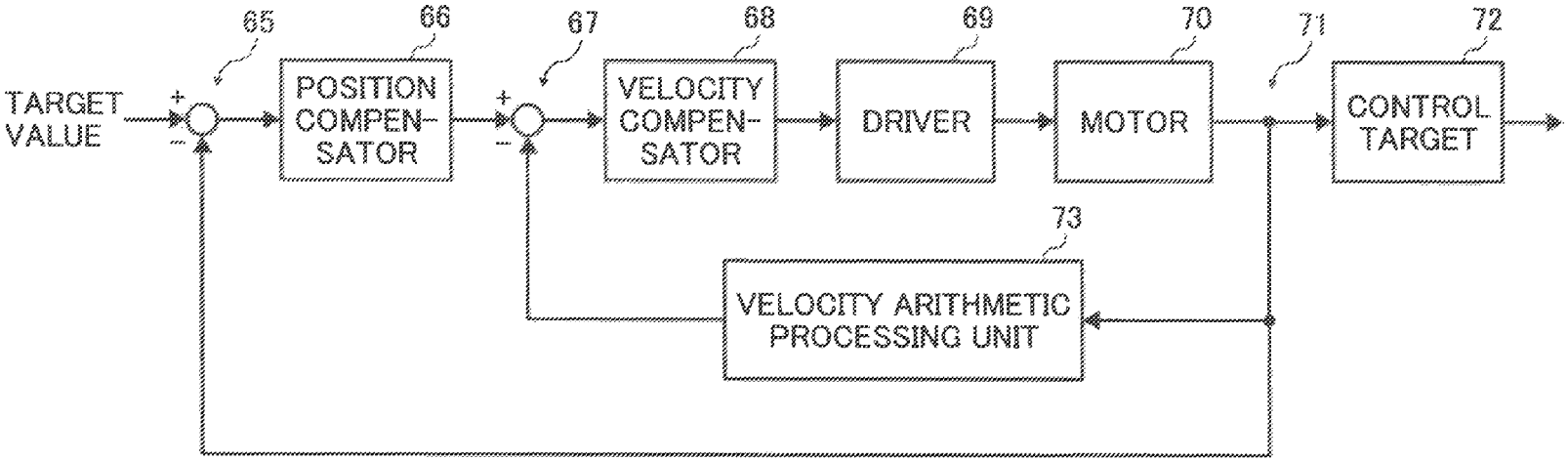
FIG. 22 is a block line drawing showing the constitution of a positioning controller composed of position and velocity feedback loops.

FIG. 21 and FIG. 22 are block line drawings of a typical positioning control apparatus referred to as a semi-closed loop. FIG. 21 shows a positioning control apparatus consisting only of a position feedback loop, while FIG. 22 shows a positioning control apparatus composed of position and velocity feedback loops.

An explanation is first provided of the block line drawing of FIG. 21. A target value (target position) and feedback position data are compared in a comparator 83, and input to a position compensator 84 in the form of a position deviation. In the position compensator 84, multiplication of a predetermined gain and a predetermined filter processing are carried out, the results are output in the form of a voltage command value or current comment value, which are input to a driver 69. The position compensator 84 may use a classical control theory such as PID, phase advance or phase delay, or although not shown in the drawings, status feedback based on a modern control theory employing feedback of a status parameter of a control target 72, or a robust control theory exemplified by H∞ control. The driver 69 is composed of a voltage control driver which applies a motor voltage corresponding to the voltage command value, or a current control driver which applies a motor current corresponding to the current command value. Here, the explanation uses a current control driver having simple transmission characteristics. A servo motor 70 is driven with a motor current corresponding to the command current from the position compensator 84 by the current driver 69. The rotating position of a motor shaft or drive shaft is detected by a position detector 71. The drive force of the motor drives the control target 72 by means of a transmission mechanism. The position detector 71 is equivalent to the code wheel 8 and the encoder sensor 9 shown in FIG. 1. Position data detected with the position detector 71 is fed back to the comparator 83. A DC brush motor, DC brushless motor or AC servo motor and soon can be used for the servo motor 70. The driving method of the driver 69 (single phase, 3-phase, Hall device input and so on) also changes according to the type of the servo motor.

Next, an explanation is provided of the block line drawing of FIG. 22.

A target value (target position) and feedback position data are compared in a comparator 65, and input to a position compensator 66 in the form of a position deviation. In the position compensator 66, multiplication of a predetermined gain and a predetermined filter processing are carried out, and a target velocity is output. The output target velocity and feedback velocity data are compared in the comparator 67, and input to a velocity compensator 68. Following multiplication of a predetermined gain and predetermined filter processing in the velocity compensator 68, the results are output in the form of a voltage command value or current comment value which are input to a driver 69. The position compensator 66 and the velocity compensator 68 may use a classical control theory such as PID, phase advance or phase delay, or although not shown in the drawings, status feedback based on a modern control theory employing feedback of a status parameter of a control target 72, or a robust control theory exemplified by H∞ control. The driver 69 is composed of a voltage control driver which applies a motor voltage corresponding to the voltage command value, or a current control driver which applies a motor current corresponding to the current command value. Here, the explanation uses a current control driver having simple transmission characteristics. A servo motor 70 is driven with a motor current corresponding to the command current from the velocity compensator 68 by the current driver 69. The rotating position of a motor shaft or drive shaft is detected by a position detector 71. The drive force of the motor drives the control target 72 with a transmission mechanism. The position detector 71 is equivalent to the code wheel 8 and the encoder sensor 9 shown in FIG. 1. Position data detected with the position detector 71 is fed back to the comparator 65. Position data detected with the position detector 71 is input to a velocity arithmetic processing unit 73, converted to velocity data and fed back to the comparator 67. In the velocity arithmetic processing unit, velocity data is obtained by a method which measures a difference in position data at a predetermined period or measures the period of position data (F/V conversion and the like). A DC brush motor, DC brush-less motor or AC servo motor and soon can be used for the servo motor 70. The driving method of the driver 69 (single phase, 3-phase, Hall device input and so on) also changes according to the type of the servo motor.

Next, an explanation is provided of the form of the control system in the case of installing in the previously mentioned ink jet recording apparatus.

The positioning control apparatus can be composed of an analog circuit, ASIC or other dedicated circuit, or arithmetic processor such as a CPU or DSP. Here, the explanation is based on FIG. 23 as an example of the dedicated use of a DSP for the positioning control apparatus. A host CPU may also be time-shared for control processing as another form of arithmetic processing.

A dedicated DSP 76 for control arithmetic processing and a host CPU 74 perform transfer of target value data and other data by means of a host interface 75. Examples of the host interface 75 include a serial interface, parallel interface, shared memory and predetermined register. The DSP 76 performs control arithmetic processing based on an arithmetic processing program of the ROM 77. Data during arithmetic processing is stored in a RAM 78. In addition, the program in the ROM 77 may also be loaded into the RAM 78 during initialization and run in RAM to accelerate control arithmetic processing. An incremental rotary encoder 79 is used for the encoder, and when A phase and B phase pulses are output from the encoder, the pulses from the encoder are counted by a counter 80. In general, values resulting from multiplying the A phase and B phase pulses by four are counted, and whether the pulses are counted up or down is judged from the phase difference between the A and B phases. The DSP 76 reads position data from the counter 80, and sets a value corresponding to a command current value to a DAC 81 based on the result of predetermined control arithmetic processing. The DAC 81 imparts a voltage corresponding to a current value to a motor driver 82, and the motor driver 82 drives a motor. Here, although the driver 82 drives the motor based on current control and current control is carried out within the driver, a constitution may also be employed in which a detected motor drive current is fed back to the DSP through an ADC not shown to carrying current control by the DSP. In addition, a constitution may also be employed for the motor driver which is capable of setting a voltage value directly through a DSP bus from the DSP 76. Although a PWM system is typically used for the drive system of the motor driver, a linear system may be employed for accurate driving. In the case of detecting velocity from encoder pulses, a method in which differential arithmetic processing is performed by the DSP 76, a method using a F/V conversion circuit not shown, or a method employing a velocity counter which measures a pulse interval with a reference clock not shown may be employed.

In the case of calculating the previously explained amount of correction for belt thickness fluctuation or the amount of correction of drive roller eccentricity or encoder mounting eccentricity by using the DSP 76 in FIG. 23, a correcting rotary encoder and counter not shown are arranged on the DSP 76 bus. The amount of recording paper fed by the ink jet recording apparatus is instructed from the host CPU 74 to the DSP 76 by means of the host interface 75 corresponding to image quality. For example, the feed amount for a head printing width is instructed following a scan by a carriage equipped with the printing head. The instructed value for the feed amount from the host CPU 74 may be a feed amount of the recording paper or a rotating angle of a drive roller equivalent thereto. Here, a target rotating angle $\theta_{ref}$ is received. After having received the target rotating angle $\theta_{ref}$, the DSP 76 calculates a correction value for belt thickness fluctuation corresponding to the amount of movement, and correction amounts of drive roller eccentricity and encoder mounting eccentricity, and then corrects the target rotating angle $\theta_{ref}$ using these correction values. The corrected target rotating angle $\theta_{ref}$ is set as a target value of the above-mentioned positioning control apparatus shown in FIG. 21 or FIG. 22 to carry out positioning to the corrected target value.

For example, if the result of dividing an amount of fluctuation $\Delta D_d$ in a belt movement position D (second term in the previously indicated Eq. (20)) by the radius $R_d$ of a drive roller 3 as $\Delta\theta_b=\Delta D_d/R_d$, then the corrected target rotating angle $\theta_{ref}'$ is determined from the eccentricity $\Delta\theta_r$ of the drive roller (second term of the previously indicated Eq. (44)) as shown in the following Eq. (49).

$$\theta_{ref}'=\theta_{ref}-\Delta\theta_b+\Delta\theta_r \qquad \text{Eq. (49)}$$

Although rads or degrees are typically used for the units of the target rotating angle, since a digital encoder is used, the setting units of the rotating angle may also be encoder pulses. In this case, the feedback units become pulses for position and pulses/sec for velocity.

In addition, although determination of the target rotating angle $\theta_{ref}$ is explained as being carried out by the DSP 76, a target rotating angle $\theta_{ref}'$ may be calculated, and the corrected target rotating angle $\theta_{ref}'$ may be transferred to the DSP 76 by having the CPU 74 monitor the correction value for belt thickness fluctuation and the corrected amounts of drive roller eccentricity and encoder mounting eccentricity. In addition, in the case of a positioning control apparatus which time shares a host CPU, the entire processing from target value correction to control is performed by the host CPU.

As has been described above, an ink jet recording apparatus as claimed in the present embodiment is provided with a recording material transport member in the form of a conveyor belt 2 wrapped around a plurality of supporting rotating bodies in the form of supporting rollers comprising a driven supporting rotating body in the form of a tension roller 4, which rotates accompanying movement of an endless belt, and a driving supporting rotating body in the form of a drive roller 3, which transmits a drive force to the belt, driving means in the form of a servo motor 70 for imparting a drive force to the drive roller 3, belt drive controller which controls driving of the conveyor belt 2, and image forming means in the form of a carriage 21, which forms images on a recording material in the form of recording paper supported and transported on the conveyor belt 2 moved intermittently by the driving control of the belt drive controller. This belt drive controller is provided with detection means 101*a* and 102*a* comprising rotary encoders which detect a rotation angular displacement or rotation angular velocity in two supporting rollers 101 and 102 having mutually different diameters of the plurality of supporting rollers, and has control means for controlling driving of the second roller 102 serving as a drive roller so that the position of the belt 103 in the direction of movement reaches a predetermined target position based on rotation data detected by the detection means. According to this type of belt drive controller, it is possible to recognize fluctuations in belt movement position occurring due to fluctuations in pitch line distance in the circumferential direction of the belt 103 or fluctuations in belt thickness, fluctuations in belt movement position occurring with the rotation period of the supporting rollers attributable to eccentricity of the two supporting rollers 101 and 102 used to control driving of the belt 103 or assembly error of the detection means 101*a* and 102*a*, and fluctuations in belt movement position caused by changes in the diameters of the supporting rollers 101 and 102 attributable to temperature changes, wear over time and so on. As a result, each belt stopping position during belt intermittent movement can be controlled in consideration the recognized fluctuations in belt movement position. Thus, it becomes possible to accurately control each belt stopping position during belt intermittent movement, and image quality deterioration in the form of white lines, black lines and banding is adequately suppressed, thereby enabling the formation of high-quality and highly stable images.

In addition, in the present embodiment, driving control is carried out so that a position of the belt 103 in the direction of movement reaches a predetermined target position by reducing fluctuations in movement position of the belt 103 occurring due to fluctuations in pitch line distance (PLD) in a portion of the belt wound around a drive roller in the form of the second roller 102 based on rotation data of the two supporting rollers 101 and 102. Accordingly, driving control can be carried out which suppresses fluctuations in belt movement position occurring due to fluctuations in PLD, there by enabling accurate control of each belt stopping position during belt intermittent movement.

In addition, in the present embodiment, driving control is carried out so that a position of the belt 103 in the direction of movement reaches a predetermined target position by reducing fluctuations in movement position of the belt 103 occurring due to fluctuations belt thickness in a portion of the belt wound around a drive roller in the form of the second roller 102 based on rotation data of the two supporting rollers 101 and 102. Accordingly, driving control can be carried out which suppresses fluctuations in belt movement position occurring due to fluctuations in belt thickness, thereby enabling accurate control of each belt stopping position during belt intermittent movement.

In addition, in the present embodiment, driving control is carried out by carrying out processing which reduces an amount of fluctuation indicated by the rotation fluctuation data of one of two sets of rotation fluctuation data having different phases included in the rotation fluctuation data of one or both of the two supporting rollers 101 and 102, and using the results of that processing to carryout driving control. As was previously described, a belt period fluctuation component obtained from the rotation data of the two supporting rollers 101 and 102 is the result of superimposition of the effects of portions of the belt at two locations wrapped around each roller. In other words, two belt period fluctuation components having different phases are superimposed. Consequently, one of the fluctuations can be recognized by using processing which reduces the other fluctuation. Accordingly, driving control can be carried out which further suppresses fluctuations in belt movement position attributable to fluctuations in PLD or fluctuations in belt thickness, thereby enabling more accurate control of each belt stopping position during belt intermittent movement.

In addition, in the present embodiment, the above-mentioned processing comprises carrying out additive processing on data obtained by giving a distance between the two supporting rollers 101 and 102 in a belt movement path and a gain based on the diameters of the two supporting rollers 101 and 102, to two sets of rotation fluctuation data having different phases included in the rotation data of one or both of the two supporting rollers 101 and 102 as indicated in FIG. 8 and FIG. 9, and then repeating that additive processing n ($n \geqq 1$) times on the results of that processing. This processing is carried out by using the product of multiplying a gain G during the first additive processing by $2^{n-1}$ for the gain during nth round of additive processing, and using the product of multiplying a belt passage time by $2^{n-1}$ for the delay time of the nth round of additive processing. By using a finite impulse response (FIR) filter operation in the manner of the continuous data processing shown in FIG. 8 or the dispersed data processing shown in FIG. 9 for the processing for reducing one of the belt revolution fluctuations superimposed in this manner, one of the belt revolution components can be accurately recognized.

In addition, in the present embodiment, the two supporting rollers 101 and 102 are arranged so that the ratio of the belt movement path length between these supporting rollers and the belt circumference is 2Nb (wherein, Nb is a natural number), processing for reducing one of the superimposed belt period fluctuations comprises carrying out additive processing on data obtained by giving a distance between the two supporting rollers 101 and 102 in a belt movement path and a gain based on the diameters of the two supporting rollers 101 and 102, to two sets of rotation fluctuation data having different phases included in the rotation data of one or both of the two supporting rollers 101 and 102, and then repeating that additive processing Nb times on the results of that processing. This processing is carried out by using the product of multiplying a gain G during the first additive processing by $2^{n-1}$ for the gain during nth round of additive processing, and using the product of multiplying a belt passage time by $2^{n-1}$ for the delay time of the nth round of additive processing. By limiting the arranged positions of the two supporting rollers 101 and 102 so that the ratio between the belt movement path length between the rollers and the belt circumference is 2Nb, processing through the Nb stage of the additive processing shown in FIG. 8 and FIG. 9 can be carried out accurately and in a short period of time.

Figure 10B:
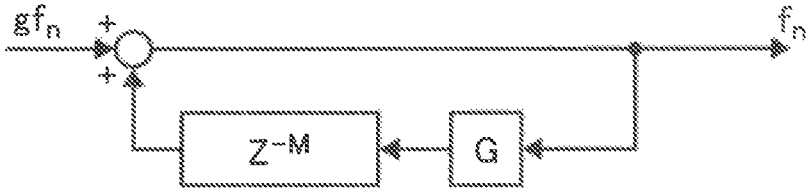
FIG. 10B is a block drawing in the form of a dispersed representation of FIG. 9 for digital processing.

In the present embodiment, as shown in FIG. 10, the above-mentioned processing may also comprise using data obtained by giving a distance between the two supporting rollers 101 and 102 in a belt movement path and a gain based on the diameters of the two supporting rollers 101 and 102, to two sets of rotation fluctuation data having different phases included in the rotation data of one or both of the two supporting rollers 101 and 102 as output data, and feeding back that output data and adding the output data to the two sets of rotation fluctuation data. This processing comprises infinite impulse response (IIR) filter processing of an equivalent conversion of the result of adding an infinite number of steps to the finite impulse response (FIR) filter operation shown in FIG. 8 and FIG. 9. The use of this processing makes it possible to accurately recognize one of the belt period fluctuation components with a small number of arithmetic operations.

In addition, the present embodiment has fluctuation data storage means which stores rotation fluctuation data obtained during the period in which the belt 103 makes one revolution.

As a result, since previously recognized PLD fluctuation data for one revolution of the belt can be retained in memory, belt driving can be controlled based on past recognition data even at the start of belt driving control (state in which PLD fluctuations have not yet been recognized). In particular, is processing is carried out which re-determines rotation fluctuation data at predetermined time intervals, the stored PLD fluctuation data can be periodically updated, thereby making it possible to accommodate PLD fluctuations changing with the environment and over time. In addition, if driving is controlled while carrying out processing which determines rotation fluctuation data, new PLD fluctuations can be recognized simultaneous to controlling driving based on the stored PLD fluctuation data, thereby making it possible to enhance responsiveness to environmental changes and changes over time.

In addition, in the present embodiment, driving control is carried out by providing mark detection means in the form of a mark detection sensor 104 for detecting a home position mark 103*a* indicating a reference position on the belt to determine a reference position of the belt 103 in the direction of belt movement, and acquiring rotation fluctuation data based on the detection timing of this mark detection sensor 104. As a result, the current rotation phase of the belt can be determined. Accordingly, belt driving can be suitably controlled without any phase difference with the determined PLD fluctuation. In addition, driving may also be controlled after having determined relational data between rotation fluctuation data and the position of the belt in the direction of movement based on a belt circumference. The current rotation phase of the belt 103 can be determined from each parameter (belt circumference and average belt transport velocity or distance) and rotation data of the supporting rollers 101 and 102 as previously described without having to physically provide the home position mark 103*a*. Accordingly, belt driving can be suitably controlled without any phase difference with a determined PLD fluctuation without providing the home position mark 103*a*.

In addition, in the present embodiment, driving is controlled by simultaneously measuring the time when the second roller 102, having the larger diameter of the two supporting rollers 101 and 102, rotates by a predetermined rotating angle, and the time when the first roller 101, having the smaller diameter of the two supporting rollers 101 and 102, rotates by a rotating angle corresponding to a belt movement distance when the second roller 102 rotates by the predetermined rotating angle, carrying out that measurement at least twice at different phases for one rotation period of the second roller 102, subsequently carrying out derivational processing of deriving the amplitude and phase of a rotation velocity fluctuation of one rotation period of the second roller 102 based on those measurement results, and carrying out driving control so as to reduce a movement position fluctuation of the belt 103 occurring during the rotation period of the second roller 102 based on the amplitude and phase derived by this derivational processing. As a result, fluctuations in belt movement position occurring during a rotation period of the second roller 102 attributable to eccentricity of the two supporting rollers 101 and 102 used for controlling driving of the belt 103 or assembly error of the detection means 101*a* and 102*a* can be recognized from the rotation data of the two supporting rollers 101 and 102, the driving can be controlled so that a position of the belt 103 in the direction of movement reaches a predetermined target position based on a recognized fluctuation in movement position. Accordingly, driving control can be carried out which suppresses fluctuations in belt movement position occurring due to fluctuations in the rotation period of the second roller 102 in the circumferential direction of the belt 103, thereby enabling accurate control of each belt stopping position during belt intermittent movement. In particular, since the diameters of the first roller 101 and the second roller 102 are mutually different in the present embodiment, a rotation period fluctuation of the first roller 101 and a rotation period fluctuation of the second roller 102 can be determined separately. In addition, if measurement of the rotation time of a detection interval having the same circumference for the two supporting rollers 101 and 102 is carried out twice at different phases during the rotation period of the second roller 102, a fluctuation component occurring in the rotation period of the second roller 102 can be recognized with the least number of measurements.

In addition, in the present embodiment, derivational processing is carried out in which, during the time the first roller 101 having the smaller diameter of the two supporting rollers 101 and 102 rotates by a rotating angle corresponding to a belt movement distance when the second roller 102 having the larger diameter of the two supporting rollers 101 and 102 rotates by a predetermined rotating angle, the rotating angle rotated by the second roller is measured, and that measurement is carried out at least twice at different phases for a single revolution period of the second supporting roller 102, followed by deriving the amplitude and phase of the rotating angle fluctuation for one rotation period of the second supporting roller 102 based on the measurement result. Driving control may then be carried out so that a movement position fluctuation of the belt 103 occurring in the rotation period of the second supporting roller 102 is reduced based on the amplitude and phase derived by this derivational processing. In this case as well, driving control can be carried for suppressing fluctuations in belt movement position occurring due to fluctuations in the rotation period of the second roller 102 in the circumferential direction of the belt 103, thereby enabling accurate control of each belt stopping position during belt intermittent movement. Moreover, rotating angle fluctuation can also be arithmetically determined while carrying an intermittent positioning operation by using a rotating angle instead of the duration of rotation.

In addition, in the present embodiment, a belt movement distance when the second supporting roller 102 rotates by a predetermined rotating angle is an integer multiple of the belt movement distance when the first supporting roller 101 makes one revolution. As a result, since data is obtained which is unaffected by fluctuations in the rotation period of the first supporting roller 101 when calculating fluctuations in the rotation period of the second supporting roller 102, rotation period fluctuation of the second supporting roller 102 can be calculated more accurately.

In addition, in the present embodiment, a predetermined rotating angle is ½ the rotation period of the second supporting roller 102. As a result, rotation period detection sensitivity can be maximized. At this time, if the diameter of the second supporting roller 102 is taken to be 2n (wherein, n is a natural number) times the diameter of the first supporting roller 101, since data can be obtained which is unaffected by fluctuations in rotation period of the first roller 101 when calculating a rotation period fluctuation of the second roller 102, fluctuations in the rotation period of the second roller 102 can be calculated more accurately. Moreover, if the above-mentioned measurement is carried out twice at different phases for one rotation period of the second supporting roller 102, and these two measurements of time are carried out at a phase difference equivalent to ¼ the rotation period of the second supporting roller 102, since the phase difference between the two detection intervals becomes a phase difference angle of π/2 between the two detection intervals, detection sensitivity is maximized.

In addition, in the present embodiment, a high-resolution detector 102*a* is used for the above-mentioned detection means to detection rotation data of the second supporting roller 102, while a low-resolution detector 101*a*, which transmits a signal of at least one pulse when the first roller 101 makes one revolution, is used to detection rotation data of the first supporting roller 101. As a result, since the detection means corresponding to the first roller 101 can be composed inexpensively and simply, costs can be reduced. In the present embodiment in particular, the high-resolution detector 102*a* may be used to detect rotation data of a drive roller in the form of the second roller 102.

In addition, in the present embodiment, the high-resolution detection means 102*a* uses that composed of a plurality of detection targets in the form of slits 503, which are arranged in the form of a ring centering on the axis of rotation of the second supporting roller 102, and a detection unit in the form of a detector 506, which outputs a pulse signal when these slits 503 have passed, and the above-mentioned derivational processing is carried out by using one slit 503*h* of the slits 503 as a phase reference. As a result, when detecting a rotation period fluctuation of the second roller 102, an arbitrary slit in the form of the slit 503*h* can be used as a home position serving as a phase reference of rotation period fluctuation, thereby eliminating the need to install a separate home position mark for the second roller 102. In particular, driving control is preferably carried out based on the above-mentioned slit 503*h* serving as a phase reference. Similar to detection of a period fluctuation of the second roller 102, in the case of controlling based on a detected period fluctuation, it is necessary to align the roller rotation phase and the period rotation phase. Accordingly, if driving is controlled based on the slit 503*h* serving as a phase reference, it is not necessary to install a separate home position mark for driving control.

In addition, in the present embodiment, two detection units may be provided for the above-mentioned high-resolution detector 102*a* which respectively detect slits 503 at positions shifted in phase by 180°. The effect of eccentricity of the encoder disk 505 can be eliminated by using such a constitution in the case of desiring to correct and control only roller eccentricity or in the case of realizing higher accuracy.

In addition, in the present embodiment, the previously described derivational processing is carried when the power supply is turned on. In this case, fluctuations in rotation period can be recognized by arbitrarily setting a home position each time the power supply is turned on even if the home position for fluctuations in rotation period is not fixed. In addition, the previously mentioned derivational processing may be carried out at fixed intervals. In this case, it is possible to accommodate environmental changes and changes over time during operation. In addition, the previously mentioned derivational processing may be carried out successively. In this case, it is possible to rapidly accommodate environmental changes and changes over time during operation.

In addition, in the present embodiment, the amount of change in a rotation angular velocity of one supporting roller 102 with respect to a rotation angular velocity of the other supporting roller 101 among the two supporting rollers 101 and 102 having mutually different rates of change in diameter per unit temperature change is determined based on rotation data detected with the above-mentioned detection means 101*a* and 102*a*, the temperature changes of the two supporting rollers 101 and 102 are calculated from the determined amount of change, and driving control is carried out corresponding to the calculation results so as to reduce fluctuations in movement position of the belt 103 caused by temperature changes. As a result, the temperature change of each supporting roller 101 and 102 can be recognized without having to install a thermometer inside the apparatus. Accordingly, the driving of the belt 103 can be controlled while suppressing fluctuations in belt movement position attributable to changes in roller diameter caused by temperature changes without having to install a thermometer inside the apparatus, thereby making it possible to accurately control each belt stopping position during belt intermittent movement.

In addition, in the present embodiment, the second roller 102 is composed of a rubber material, while the first roller 101 is composed of a metal material. As a result, the detection accuracy of roller temperature changes improves since the difference in the coefficients of thermal expansion between the two rollers can be increased with inexpensive materials.

In addition, in the present embodiment, the sampling times for rotation angular velocity when determining the amount of change in a rotation angular velocity of one supporting roller 102 with respect to a rotation angular velocity of the other supporting roller 101 among two supporting rollers 101 and 102 in which the ratio of the rotation period is an integral ratio are set to times equivalent to common multiples of the rotation periods of the two supporting rollers 101 and 102. As a result, changes in rotation angular velocity can be accurately detected without being affected by fluctuations in movement velocity of the belt 103 attributable to eccentricity of the first roller 101 or rotation detection error attributable to eccentricity of the second roller 102.

In addition, in the present embodiment, the sampling times for rotation angular velocity when determining the amount of change in a rotation angular velocity of one supporting roller 102 with respect to a rotation angular velocity of the other supporting roller 101 among the two supporting rollers 101 and 102 in which the ratio of the rotation period is an integral ratio may also be set to times equivalent to common multiples of the rotation period of the supporting roller 102 and the movement period of the belt 103. In this case, changes in rotation angular velocity can be accurately detected without being affected by fluctuations in movement velocity of the belt 103 attributable to fluctuations in the thickness of the belt 103 or fluctuations in PLD, or by rotation detection error attributable to eccentricity of the second roller 102.

As has been explained above, since each belt stopping position during belt intermittent movement can be controlled in consideration of fluctuations in belt movement position occurring due to the previously described causes, the superior effect is demonstrated by which each belt stopping position during belt intermittent movement can be accurately controlled.

Various modifications will become possible for those skilled in the art after receiving the teachings of the present disclosure without departing from the scope thereof.

What is claimed is:

1. A belt drive controller for controlling the driving of an endless belt so as to intermittently move said belt wrapped around at least two supporting rotating bodies including a driven supporting rotating body, which rotates accompanying movement of said belt, and a driving supporting rotating body which transmits a driving force to said belt, comprising:

a detection unit that detects a first rotation angular displacement or a first rotation angular velocity of a first of the two supporting rotating bodies and a second rotation angular displacement or a second rotation angular velocity of a second of the two supporting rotating bodies, the first and second supporting rotating bodies having mutually different diameters among the two supporting rotating bodies; and a control unit that controls driving of the driving supporting rotating body based on rotation data detected by said detection unit so that the position of the belt in the direction of movement becomes a predetermined target position.

2. The belt drive controller as claimed in claim 1, wherein the control unit controls the driving so that the position of the belt in the direction of movement becomes the predetermined target position by reducing fluctuations in movement position of the belt occurring due to fluctuations in pitch line distance in a portion of the belt wrapped around the driving supporting rotating body based on rotation data of the two supporting rotating bodies.

3. The belt drive controller as claimed in claim 2, wherein the control unit carries out processing for reducing the amount of fluctuation indicated by one set of rotation fluctuation data among two sets of rotation fluctuation data of different phases included in one or both sets of rotation data of the two supporting rotating bodies, and controls the driving using the results of the processing.

4. The belt drive controller as claimed in claim 3, wherein the processing comprises carrying out additive processing on data obtained by giving a distance between the two supporting rotating bodies in a belt movement path and a gain based on the diameters of said two supporting rotating bodies, to two sets of rotation fluctuation data of different phases included in the rotation data of one or both of said two supporting rotating bodies, repeating said additive processing n ($n \geqq 1$) times on the results of the processing, and using the product of multiplying a gain G during the first additive processing by $2^{n-1}$ for the gain during the nth round of additive processing, and using the product of multiplying a belt passage time by $2^{n-1}$ for the delay time of the nth round of additive processing.

5. The belt drive controller as claimed in claim 3, wherein the two supporting rotating bodies are arranged so that the ratio between belt movement path length and belt total circumference between the two supporting rotating bodies is 2Nb (wherein, Nb is a natural number), and the processing comprises carrying out additive processing on data obtained by giving a distance between the two supporting rotating bodies in a belt movement path and a gain based on the diameters of said two supporting rotating bodies, to two sets of rotation fluctuation data of different phases included in the rotation data of one or both of said two supporting rotating bodies, repeating said additive processing Nb times on the results of the processing, and using the product of multiplying a gain G during the first additive processing by $2^{n-1}$ for the gain during the nth round of additive processing, and using the product of multiplying the belt passage time by $2^{n-1}$ for said delay time of the nth round of additive processing.

6. The belt drive controller as claimed in claim 3, wherein the processing comprises using data obtained by giving a distance between the two supporting rotating bodies in a belt movement path and a gain based on the diameters of said two supporting rotating bodies, to two sets of rotation fluctuation data having different phases included in the rotation data of one or both of said two supporting rotating bodies as output data, and feeding back said output data and adding the output data to said two sets of rotation fluctuation data.

7. The belt drive controller as claimed in claim 3, further comprising:

a fluctuation data storage unit that stores rotation fluctuation data obtained during the time the belt makes one revolution.

8. The belt drive controller as claimed in claim 7, wherein the control unit carries out processing for again determining the rotation fluctuation data at a predetermined timing.

9. The belt drive controller as claimed in claim 7, wherein the control unit controls the driving while carrying out processing for determining the rotation fluctuation data.

10. The belt drive controller as claimed in claim 3, further comprising:

a mark detection unit that detects a mark which indicates a reference position on the belt for determining a reference position of said belt in the direction of belt movement, the control unit acquiring the rotation fluctuation data based on a detection timing according to said mark detection unit while also controlling the driving.

11. The belt drive controller as claimed in claim 3, wherein the control unit controls the driving after having determined relational data between the rotation fluctuation data and the position of the belt in the direction of movement based on a belt circumference.

12. The belt drive controller as claimed in claim 1, wherein the control unit controls the driving so that the position of the belt in the direction of movement becomes the predetermined target position by reducing fluctuations in the movement position of said belt occurring due to fluctuations in belt thickness in a portion of the belt wrapped around the driving supporting rotating body based on rotation data of the two supporting rotating bodies.

13. The belt drive controller as claimed in claim 12, wherein the control unit carries out processing for reducing the amount of fluctuation indicated by one set of rotation fluctuation data among two sets of rotation fluctuation data of different phases included in one or both sets of rotation data of the two supporting rotating bodies, and controls the driving using the results of the processing.

14. The belt drive controller as claimed in claim 13, wherein the processing comprises carrying out additive processing on data obtained by giving a distance between the two supporting rotating bodies in a belt movement path and a gain based on the diameters of said two supporting rotating bodies, to two sets of rotation fluctuation data of different phases included in the rotation data of one or both of said two supporting rotating bodies, repeating said additive processing n ($n \geqq 1$) times on the results of the processing, and using the product of multiplying a gain G during the first additive processing by $2^{n-11}$ for the gain during the nth round of additive processing, and using the product of multiplying a belt passage time by $2^{n-1}$ for the delay time of the nth round of additive processing.

15. The belt drive controller as claimed in claim 13, wherein the two supporting rotating bodies are arranged so that the ratio between belt movement path length and belt total circumference between the two supporting rotating bodies is 2Nb (wherein, Nb is a natural number), and the processing comprises carrying out additive processing on data obtained by giving a distance between the two supporting rotating bodies in a belt movement path and a gain based on the diameters of said two supporting rotating bodies, to two sets of rotation fluctuation data of different phases included in the rotation data of one or both of said two supporting rotating bodies, repeating said additive processing Nb times on the results of the processing, and using the product of multiplying a gain G during the first additive processing by $2^{n-1}$ for the gain during the nth round of additive processing, and using the product of multiplying the belt passage time by $2^{n-1}$ for said delay time of the nth round of additive processing.

16. The belt drive controller as claimed in claim 13, wherein the processing comprises using data obtained by giving a distance between the two supporting rotating bodies in a belt movement path and a gain based on the diameters of said two supporting rotating bodies, to two sets of rotation fluctuation data having different phases included in the rotation data of one or both of said two supporting rotating bodies as output data, and feeding back said output data and adding the output data to said two sets of rotation fluctuation data.

17. The belt drive controller as claimed in claim 13, further comprising:

a fluctuation data storage unit that stores rotation fluctuation data obtained during the time the belt makes one revolution.

18. The belt drive controller as claimed in claim 17, wherein the control unit carries out processing for again determining the rotation fluctuation data at a predetermined timing.

19. The belt drive controller as claimed in claim 17, wherein the control unit controls the driving while carrying out processing for determining the rotation fluctuation data.

20. The belt drive controller as claimed in claim 13, further comprising:

a mark detection unit that detects a mark which indicates a reference position on the belt for determining a reference position of said belt in the direction of belt movement, the control unit acquiring the rotation fluctuation data based on a detection timing according to said mark detection unit while also controlling the driving.

21. The belt drive controller as claimed in claim 12, wherein the control unit controls the driving after having determined relational data between the rotation fluctuation data and the position of the belt in the direction of movement based on a belt circumference.

22. The belt drive controller as claimed in claim 1, wherein the control unit controls the driving by simultaneously measuring the time when the second supporting rotating body, having the larger diameter of the two supporting rotating bodies, rotates by a predetermined rotating angle, and the time when the first supporting rotating body, having the smaller diameter of said two supporting rotating bodies, rotates by a rotating angle corresponding to a belt movement distance when said second supporting rotating body rotates by said predetermined rotating angle, carrying out that measurement at least twice at different phases for one rotation period of said second supporting rotating body, subsequently carrying out derivational processing of deriving the amplitude and phase of a rotation velocity fluctuation of one rotation period of said second supporting rotating body based on the measurement results, and carrying out driving control so as to reduce a movement position fluctuation of the belt occurring during the rotation period of said second supporting rotating body based on the amplitude and phase derived by this derivational processing.

23. The belt drive controller as claimed in claim 22, wherein the belt movement distance when the second supporting rotating body rotates by the predetermined rotating angle is an integer multiple of the belt movement distance when the first supporting rotating body makes one revolution.

24. The belt drive controller as claimed in claim 22, wherein the predetermined rotating angle is ½ the rotation period of the second supporting rotating body.

25. The belt drive controller as claimed in claim 24, wherein the diameter of the second supporting rotating body is 2n (wherein, n is a natural number) times the diameter of the first supporting rotating body.

26. The belt drive controller as claimed in claim 25, wherein the control unit carries out the measurement twice at different phases for one rotation period of the second supporting rotating body, and these two time measurements are carried out at a phase difference equivalent to ¼ the rotation period of said second supporting rotating body.

27. The belt drive controller as claimed in claim 22, wherein the detection unit has a high-resolution detector for detecting rotation data of the second supporting rotating body, and a low-resolution detector for detecting rotation data of the first supporting rotating body which transmits a signal of at least one pulse when said first supporting rotating body makes one revolution.

28. The belt drive controller as claimed in claim 27, wherein the high-resolution detector is used to detect the rotation data of the driving supporting rotating body in the form of the second supporting rotating body.

29. The belt drive controller as claimed in claim 27, wherein the high-resolution detector is provided with a plurality of detection targets arranged in the form of a ring centering on the axis of rotation of the second supporting rotating body, and a detection unit which outputs a pulse signal when the detection targets have passed, and the control unit carries out the derivational processing by using one of said detection targets as a phase reference.

30. The belt drive controller as claimed in claim 29, wherein the control unit controls the driving based on one of the detection targets serving as the phase reference.

31. The belt drive controller as claimed in claim 27, wherein the high-resolution detector is provided with two detection units which respectively detect detection targets at positions shifted in phase by 180°.

32. The belt drive controller as claimed in claim 27, wherein the control unit carries out the derivational processing when the power supply is turned on.

33. The belt drive controller as claimed in claim 22, wherein the control unit carries out the derivational processing at fixed intervals.

34. The belt drive controller as claimed in claim 22, wherein the control unit successively carries out the derivational processing.

35. The belt drive controller as claimed in claim 1, wherein the control unit controls the driving by measuring a rotating angle of the second supporting rotating body within the time the first supporting rotating body having the smaller diameter of the two supporting rotating bodies rotates by a rotating angle corresponding to a belt movement distance when said second supporting rotating body having the larger diameter of said two supporting rotating bodies rotates by a predetermined rotating angle, carrying out that measurement at least twice at different phases for one rotation period of said second supporting rotating body, subsequently carrying out derivational processing of deriving the amplitude and phase of a rotating angle fluctuation of one rotation period of said second supporting rotating body based on the measurement results, and carrying out driving control so as to reduce a movement position fluctuation of the belt occurring during the rotation period of said second supporting rotating body based on the amplitude and phase derived by this derivational processing.

36. The belt drive controller as claimed in claim 35, wherein the belt movement distance when the second supporting rotating body rotates by the predetermined rotating angle is an integer multiple of the belt movement distance when the first supporting rotating body makes one revolution.

37. The belt drive controller as claimed in claim 35, wherein the predetermined rotating angle is ½ the rotation period of the second supporting rotating body.

38. The belt drive controller as claimed in claim 37, wherein the diameter of the second supporting rotating body is 2n (wherein, n is a natural number) times the diameter of the first supporting rotating body.

39. The belt drive controller as claimed in claim 38, wherein the control unit carries out the measurement twice at different phases for one rotation period of the second supporting rotating body, and these two time measurements are carried out at a phase difference equivalent to ¼ the rotation period of said second supporting rotating body.

40. The belt drive controller as claimed in claim 35, wherein the detection unit has a high-resolution detector for detecting rotation data of the second supporting rotating body, and a low-resolution detector for detecting rotation data of the first supporting rotating body which transmits a signal of at least one pulse when said first supporting rotating body makes one revolution.

41. The belt drive controller as claimed in claim 40, wherein the high-resolution detector is used to detect the rotation data of the driving supporting rotating body in the form of the second supporting rotating body.

42. The belt drive controller as claimed in claim 40, wherein the high-resolution detector is provided with a plurality of detection targets arranged in the form of a ring centering on the axis of rotation of the second supporting rotating body, and a detection unit which outputs a pulse signal when the detection targets have passed, and the control unit carries out the derivational processing by using one of said detection targets as a phase reference.

43. The belt drive controller as claimed in claim 42, wherein the control unit controls the driving based on one of the detection targets serving as the phase reference.

44. The belt drive controller as claimed in claim 40, wherein the high-resolution detector is provided with two detection units which respectively detect detection targets at positions shifted in phase by 180°.

45. The belt drive controller as claimed in claim 40, wherein the control unit carries out the derivational processing when the power supply is turned on.

46. The belt drive controller as claimed in claim 35, wherein the control unit carries out the derivational processing at fixed intervals.

47. The belt drive controller as claimed in claim 35, wherein the control unit successively carries out the derivational processing.

48. The belt drive controller as claimed in claim 1, wherein the control unit controls the driving by determining the amount of change in a rotation angular velocity of one supporting rotating body with respect to a rotation angular velocity of the other supporting rotating body among the two supporting rotating bodies having mutually different rates of change in diameter per unit temperature change based on rotation data detected with the detection unit, calculating the temperature changes of said two supporting rotating bodies from the determined amount of change, and carrying out driving control corresponding to the calculation results so as to reduce fluctuations in movement position of the belt caused by temperature changes.

49. The belt drive controller as claimed in claim 48, wherein the control unit calculates the temperature changes of the two supporting rotating bodies by using a supporting rotating body composed of a rubber material for one of the supporting rotating bodies, and using a supporting rotating body composed of a metal material for the other supporting rotating body.

50. The belt drive controller as claimed in claim 48, wherein the sampling times for rotation angular velocity when determining the amount of change in a rotation angular velocity of one supporting rotating body with respect to a rotation angular velocity of the other supporting rotating body among the two supporting rotating bodies in which the ratio of the rotation period is an integral ratio are set to times equivalent to common multiples of the rotation periods of said two supporting rotating bodies.

51. The belt drive controller as claimed in claim 48, wherein the sampling times for rotation angular velocity when determining the amount of change in a rotation angular velocity of one supporting rotating body with respect to an angular velocity of the other supporting rotating body among the two supporting rotating bodies in which the ratio of the rotation period is an integral ratio are set to times equivalent to common multiples of the rotation period of said one supporting rotating body and the movement period of the belt.

52. An image forming apparatus comprising:

a recording material transport member comprising an endless belt wrapped around at least two supporting rotating bodies including a driven supporting rotating body, which rotates accompanying movement of said belt, and a driving supporting rotating body which transmits a driving force to said belt;

a driving unit which imparts a driving force to said driving supporting rotating body;

a belt drive controller for controlling driving of said recording material transport member; and an image forming unit that forms an image on a recording material supported and transported on said recording member transport member moved intermittently by the driving control of said belt drive controller, the belt drive controller comprising a detection unit that detects a first rotation angular displacement or a first rotation angular velocity of a first of the two supporting rotating bodies and a second rotation angular displacement or a second rotation angular velocity of a second of the two supporting rotating bodies, the first and second supporting rotating bodies having mutually different diameters among two supporting rotating bodies; and a control unit that controls driving of the driving supporting rotating body based on rotation data detected by said detection unit so that the position of the belt in the direction of movement becomes a predetermined target position.

53. A belt drive controller for controlling the driving of an endless belt so as to intermittently move said belt wrapped around at least two supporting rotating bodies including a driven supporting rotating body, which rotates accompanying movement of said belt, and a driving supporting rotating body which transmits a driving force to said belt, comprising:

detection means for detecting a first rotation angular displacement or a first rotation angular velocity of a first of the two supporting rotating bodies and a second rotation angular displacement or a second rotation angular velocity of a second of the two supporting rotating bodies, the first and second supporting rotating bodies having mutually different diameters among the two supporting rotating bodies; and control means for controlling driving of the driving supporting rotating body based on rotation data detected by said detection means so that the position of the belt in the direction of movement becomes a predetermined target position.

* * * * *